US012091934B2

(12) United States Patent
Shpak et al.

(10) Patent No.: US 12,091,934 B2
(45) Date of Patent: Sep. 17, 2024

(54) PRESSURE MANAGEMENT DEVICE FOR DRILLING SYSTEM

(71) Applicant: Opla Energy Ltd., Calgary (CA)

(72) Inventors: Vitaliy Shpak, Calgary (CA); Elvin Mammadov, Calgary (CA); Hossein Khorshidian, Calgary (CA)

(73) Assignee: Opla Energy Ltd., Calgary (CA)

( * ) Notice: Subject to any disclaimer, the term of this patent is extended or adjusted under 35 U.S.C. 154(b) by 0 days.

(21) Appl. No.: 17/864,356

(22) Filed: Jul. 13, 2022

(65) Prior Publication Data

US 2022/0349275 A1 Nov. 3, 2022

Related U.S. Application Data

(63) Continuation of application No. PCT/CA2021/050042, filed on Jan. 15, 2021.

(60) Provisional application No. 62/962,120, filed on Jan. 16, 2020.

(51) Int. Cl.

| | |
|---|---|
| ***E21B 34/02*** | (2006.01) |
| ***E21B 21/08*** | (2006.01) |
| ***E21B 21/10*** | (2006.01) |
| ***E21B 33/06*** | (2006.01) |

(52) U.S. Cl.

CPC ..... *E21B 34/025* (2020.05); *E21B 21/08* (2013.01); *E21B 21/106* (2013.01); *E21B 33/06* (2013.01)

(58) Field of Classification Search

CPC ..... E21B 34/025; E21B 21/08; E21B 21/106; E21B 33/06; E21B 21/019

See application file for complete search history.

(56) References Cited

U.S. PATENT DOCUMENTS

| | | | | |
|---|---|---|---|---|
| 4,046,191 | A * | 9/1977 | Neath | E21B 21/001 175/25 |
| 4,848,472 | A | 7/1989 | Hopper | |
| 6,371,208 | B1 | 4/2002 | Norman et al. | |
| 6,571,873 | B2 * | 6/2003 | Maus | E21B 21/082 166/250.07 |
| 10,253,585 | B2 * | 4/2019 | Hickie | E21B 21/106 |
| 2001/0011592 | A1 | 8/2001 | Baker | |
| 2005/0081916 | A1 | 4/2005 | Williams et al. | |

(Continued)

OTHER PUBLICATIONS

International Search Report dated Mar. 15, 2021 in corresponding International Application No. PCT/CA2021/050042 filed Jan. 15, 2021; total 6 pages.

(Continued)

*Primary Examiner* — Steven A MacDonald
(74) *Attorney, Agent, or Firm* — Snell & Wilmer L.L.P.

(57) ABSTRACT

A pressure management device (PMD) for direct connection to a blowout preventor stack of a managed pressure drilling system, the PMD comprising a housing, one or more chokes, and a directional valve. The directional valve has a choke position and a bypass position. When the directional valve is in the choke position, the PMD operates to divert fluid entering the housing to one or more of the chokes. When the directional valve is in the bypass position, the PMD operates to divert fluid entering the housing to bypass the chokes. The inlet and outlet of each choke may be controlled by a dual shutoff valve, to selectively permit and restrict fluid flow through each choke.

32 Claims, 29 Drawing Sheets

(56) References Cited

U.S. PATENT DOCUMENTS

| | | | | |
|---|---|---|---|---|
| 2010/0147591 | A1* | 6/2010 | Pomerleau | E21B 21/14 175/61 |
| 2011/0024189 | A1* | 2/2011 | Saeed | E21B 44/00 175/40 |
| 2012/0165997 | A1 | 6/2012 | Lewis et al. | |
| 2013/0092394 | A1 | 4/2013 | Holderman et al. | |
| 2015/0152700 | A1 | 4/2015 | Lovorn et al. | |
| 2016/0298401 | A1* | 10/2016 | Cotten | E21B 21/106 |
| 2017/0335654 | A1* | 11/2017 | Olsen | E21B 21/08 |
| 2018/0283113 | A1* | 10/2018 | Hickie | E21B 34/16 |
| 2018/0320464 | A1* | 11/2018 | Heitmann | E21B 31/035 |

OTHER PUBLICATIONS

Written Opinion of the International Searching Authority dated Mar. 15, 2021 in corresponding International Application No. PCT/CA2021/050042 filed Jan. 15, 2021; total 5 pages.

Extended European Search Report dated May 15, 2024 in corresponding European Application No. 2012741602 filed Jan. 15, 2021; total 12 pages.

* cited by examiner

PRESSURE MANAGEMENT DEVICE FOR DRILLING SYSTEM

CROSS-REFERENCE TO RELATED APPLICATIONS

This application is a continuation application under 35 U.S.C. § 111(a) of International Patent Application No. PCT/CA2021/050042 filed Jan. 15, 2021, which claims the benefit of U.S. Provisional Application No. 62/962,120, filed Jan. 16, 2020, the content of which is hereby incorporated by reference in its entirety.

FIELD

The present disclosure relates generally to oil and gas exploration and production operations and, more particularly, to a pressure management device for a drilling system, and to related systems and methods.

BACKGROUND

FIG. 1 illustrates a prior art managed pressure drilling ("MPD") system which is generally referred to by the reference numeral 100. The drilling system 100 includes a wellhead 102, a blowout preventer ("BOP") stack 5, a rotating control device ("RCD") 7, shutoff valves 8*a* and 8*b*, mud handling equipment 9, an MPD manifold 10, an MPD control shack 11, a rig pump 6, a top drive 3 supported on a drilling rig 2, and a drill string 4. The wellhead 102 is located at the top or head of an oil and gas wellbore 1 that penetrates one or more subterranean formations and is used in oil and gas exploration and production operations such as, for example, drilling operations. The BOP stack 5 is operably coupled to the wellhead 102 to prevent blowout, i.e., the uncontrolled release of formation fluids and/or gasses from the wellbore 1 during drilling operations. The BOP stack 5 may comprise two or more BOPs. The BOP stack 5 may also include various spools, adapters, and piping outlets to permit the circulation of wellbore fluids under pressure in the event of a blowout. A drilling tool (not shown) is operably coupled to the drill string 4 and extends within the wellbore 1. The drill string extends into the wellbore 1 through the BOP stack 5 and the wellhead 102. Moreover, the RCD 7 is operably coupled to the BOP stack 5, opposite the wellhead 102, and forms a seal around the drill string 4. The wellhead 102 is fluidly connected to the RCD via an equalization line 15.

The mud handling equipment 9 may include variety of apparatus, including for example shale shakers, mud tank, degasser, etc., and a skilled person in the art can appreciate that the specific apparatus to be used in equipment 9 may vary depending on drilling needs. In drilling system 100 the mud handling equipment 9 is operably coupled to, and in fluid communication with, the RCD 7 via a low pressure mud return line 13. The shutoff valve 8*a* is configured to selectively restrict or allow fluid flow in mud return line 13. The MPD manifold 10 is operably coupled to, and in fluid communication with, the RCD 7 via a high pressure MPD line 16. The shutoff valve 8*b* operates to selectively restrict or allow fluid flow in high pressure MPD line 16. The MPD manifold 10 is also operably coupled to, and in fluid communication with the mud handling equipment 9 via a low pressure MPD line 17. The MPD control shack is operably coupled to, and in communication with, the MPD manifold 10 via a communication line 18. The MPD control shack comprises one or more processors for controlling the MPD manifold 10. The MPD control shack is also operably coupled to, and in communication with, the drilling rig 2 via a communication line 19 to allow the MPD control shack to receive data from the rig 2.

The mud handling equipment 9 is operably coupled to, and in fluid communication with, the rig pump 6 via a pump suction line 14. The rig pump 6 is operably coupled to, and in fluid communication with, the top drive 3 via a mud pump line 12. The top drive 3 is operably coupled to the drill string 4 and the top drive 3 is configured to control the drill string 4.

With reference to FIG. 2, drilling system 100 may optionally include a flow diverter 20 that is operably coupled to, and in fluid communication with, the top drive 3, the rig pump 6, and the RCD 7. The flow diverter is positioned along the mud pump line and fluidly communicates with the RCD 7 via a flow diverter line 21. The flow diverter 20 operates to redirect rig pump flow from the top drive 3 and drill string 4 to the RCD 7 and MPD manifold 10 to allow continuous fluid circulation to maintain the desired pressure in the wellbore 1 while adding drill pipes to the drill string 4.

In operation, the drilling system 100 is used to extend the reach or penetration of the wellbore 1 into the one or more subterranean formations. To this end, the drill string 4 is rotated, and weight-on-bit is applied to the drilling tool, thereby causing the drilling tool to rotate against the bottom of the wellbore 1. At the same time, the rig pump 6 circulates drilling fluid to the drilling tool, via the drill string 4. The drilling fluid is discharged from the drilling tool into the wellbore 1 to clear away drill cuttings from the drilling tool. The drill cuttings are carried back to the surface by the drilling fluid via an annulus of the wellbore 1 surrounding the drill string 4. The drilling fluid and the drill cuttings, in combination, are also referred to herein as "drilling mud."

The drilling fluid flows into the RCD 7 through the wellhead 102 and the BOP stack 5. The RCD 7 sends the flow of the drilling fluid to the MPD manifold 10 via MPD line 16 while preventing communication between the annulus of the wellbore 1 and the atmosphere. In this manner, the RCD 7 enables the drilling system 100 to operate as a closed-loop system. The MPD manifold 10 receives the drilling fluid from the RCD 7 and provides adjustable surface backpressure to the drilling fluid to maintain a desired pressure profile within the wellbore 1. The mud handling equipment 9 receives the drilling fluid from the MPD manifold 10 via MPD line 17. The drilling fluid is then recirculated by the rig pump 6 to the drilling tool, via the drill string 4.

As illustrated, in conventional drilling systems, the MPD manifold 10 is a separate component from the RCD 7 and is positioned on the wellsite at some distance away the RCD 7. The MPD manifold 10 may be mounted to a skid, freestanding on the ground, or mounted to a trailer that can be towed between operational sites, which may be an onshore or offshore rig platform. The drilling mud has to travel from the RCD 7 through the MPD line 16 to reach the MPD manifold 10. Also, the MPD manifold typically has a large footprint and takes up a lot of space at the wellsite. For example, a conventional MPD manifold, including its skid, is about 120" in width, about 230" in length, and about 112" in height. Further, conventional MPD manifolds are often difficult to transport due to its size and weight (e.g., about 6 to 10 tons). Further, the chokes of the conventional MPD manifold require repair or maintenance from time to time. The chokes of the MPD manifold are bulky and difficult to replace, as they need to be unbolted by technicians and lifted by a crane to be removed from the manifold.

Therefore, a need exists for an improved drilling system configuration.

SUMMARY

According to a broad aspect of the present disclosure, there is provided a pressure management device (PMD) for use in a drilling system having a blowout preventor (BOP) stack and a drill string, the PMD comprising: an inlet for direct fluid connection with the BOP stack; a housing having defined therein a choke gut line, a first choke inlet passage, and a first choke outlet passage, the choke gut line configured to fluidly connect the inlet and the outlet; and a first choke having a first choke inlet and a first choke outlet, the first choke operably coupled to the housing such that the first choke inlet and first choke outlet are fluidly connected to the first choke inlet passage and the first choke outlet passage, respectively, the choke gut line bypassing the first choke, and the PMD having a PMD bypass position and a PMD single-choke position, wherein in the PMD single-choke position, the first choke inlet and the first choke outlet are open, and the choke gut line is blocked, to permit fluid communication between the inlet and the outlet through the first choke; and in the PMD bypass position, one or both of the first choke inlet and the first choke outlet are closed or the first choke is shut-in, and the choke gut line is unblocked, to permit fluid communication between the inlet and the outlet through the choke gut line.

According to another broad aspect of the present disclosure, there is provided a method comprising: connecting an inlet of a housing of a pressure management device (PMD) directly to a blowout preventor (BOP) stack of a drilling system, the housing having an outlet and having defined therein a choke gut line between the inlet and outlet; releasably attaching and fluidly connecting one or more chokes to the housing; and providing a flow path from the inlet to the outlet, wherein providing the flow path comprises one of: blocking the choke gut line and opening at least one choke of the one or more chokes to allow fluid communication between the at least one choke and the inlet and outlet; blocking the choke gut line, opening a first choke of the one or more chokes, and closing a second choke of the one or more chokes to allow fluid communication between the first choke and the inlet and outlet; and unblocking the choke gut line and closing the one or more chokes to restrict fluid communication between the one or more chokes and the inlet and outlet, and to allow fluid communication between the inlet and outlet via the choke gut line.

According to another broad aspect of the present disclosure, there is provided a choke assembly comprising: a choke cartridge; a choke housing having a first end, a second end, a wall with an inner surface defining a chamber, and a choke inlet and a choke outlet extending through the wall and in fluid communication with the chamber, the first end having an opening providing open access to the chamber, and the chamber configured to removably receive at least a portion of the choke cartridge via the opening; and a dual shutoff valve in communication with one or both of the choke inlet and the choke outlet, the dual shutoff valve having an closed position in which the dual shutoff valve blocks one or both of the choke inlet and the choke outlet; and an open position in which the dual shutoff valve unblocks the choke inlet and the choke outlet.

According to another broad aspect of the present disclosure, there is provided a method comprising: inserting a choke cartridge into a choke housing, via an open first end of the choke housing, the choke housing being operably coupled to a housing in fluid connection a blowout preventor stack of a drilling system.

The details of one or more embodiments are set forth in the description below. Other features and advantages will be apparent from the specification and the claims.

BRIEF DESCRIPTION OF THE DRAWINGS

Embodiments will now be described by way of example only, with reference to the accompanying simplified, diagrammatic, not-to-scale drawings. Any dimensions provided in the drawings are provided only for illustrative purposes, and do not limit the scope as defined by the claims. In the drawings:

In FIG. 8, the pressure management device is shown with other components of the drilling system.

FIGS. 14A and 14B may be collectively referred to herein as FIG. 14.

FIGS. 15A, 15B, and 15C may be collectively referred to herein as FIG. 15. In FIG. 15, the choke housing is shown without a choke cartridge installed therein.

FIGS. 16A and 16B may be collectively referred to herein as FIG. 16.

FIGS. 17A to 17C may be collectively referred to herein as FIG. 17.

FIGS. 19A to 19C may be collectively referred to herein as FIG. 19. In FIG. 19, the pressure management device is shown with a bearing assembly.

In FIG. 20, the pressure management device is shown with some components of the drilling system.

FIGS. 24A to 24D may be collectively referred to herein as FIG. 24.

DETAILED DESCRIPTION OF THE EMBODIMENTS

All terms not defined herein will be understood to have their common art-recognized meanings. To the extent that the following description is of a specific embodiment or a particular use, it is intended to be illustrative only, and not limiting. The following description is intended to cover all alternatives, modifications and equivalents that are included in the scope, as defined in the appended claims.

According to embodiments herein, a pressure management device ("PMD") provides the functions of the MPD manifold and optionally the RCD such that the need to include a standalone MPD manifold in the drilling system at some distance from the BOP stack may be reduced or eliminated. In some embodiments, the PMD is configured for direct connection to the BOP stack 5 of the drilling system such that the footprint of the PMD at the wellsite may be reduced or minimized. According to embodiments herein, a choke assembly that may be more compact and/or easier to replace than conventional chokes in the MPD manifold is described.

Figure 1:
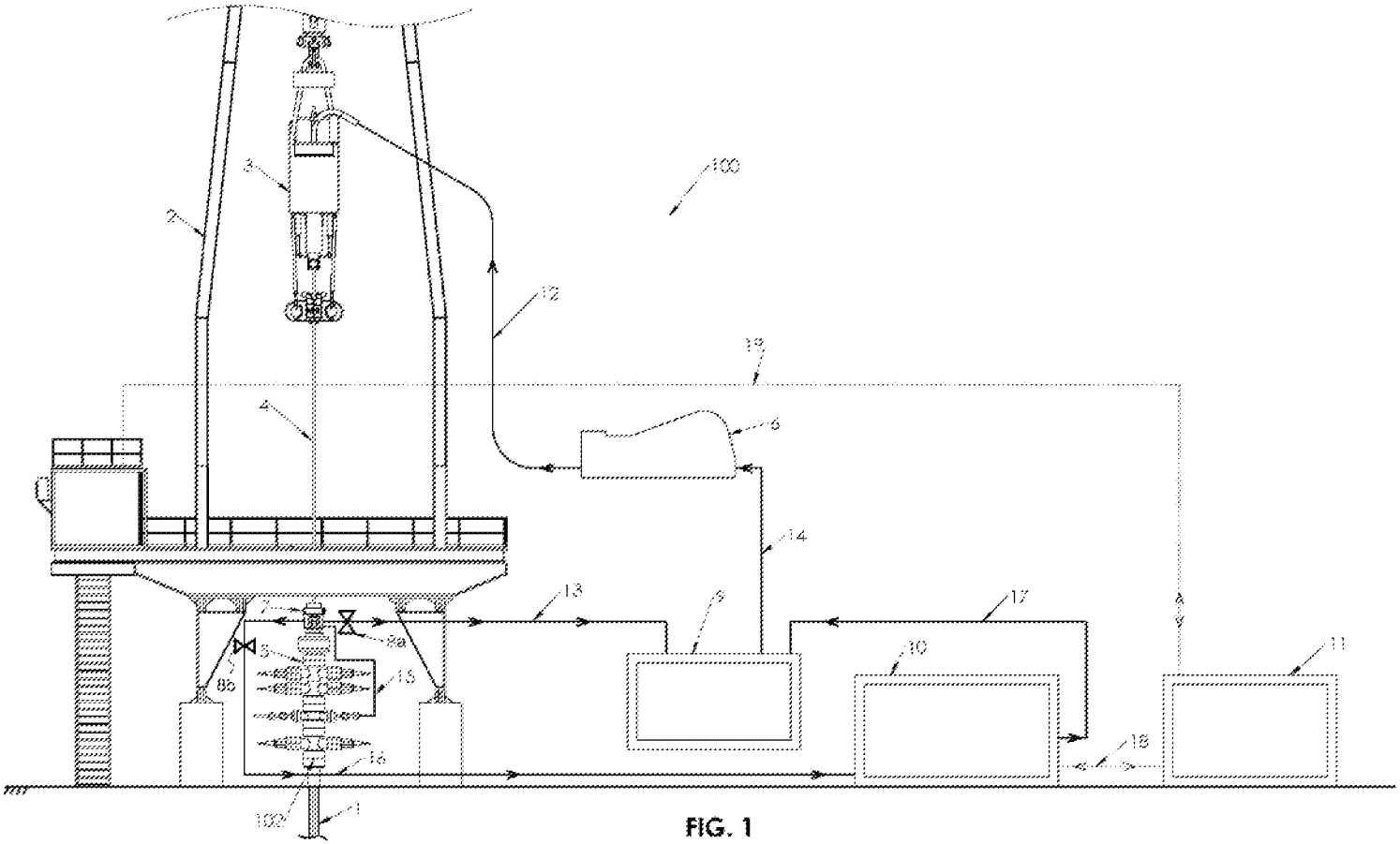
FIG. 1 PRIOR ART
FIG. 1 is a schematic view of a prior art managed pressure drilling system, illustrating the basic components thereof.
Figure 2:
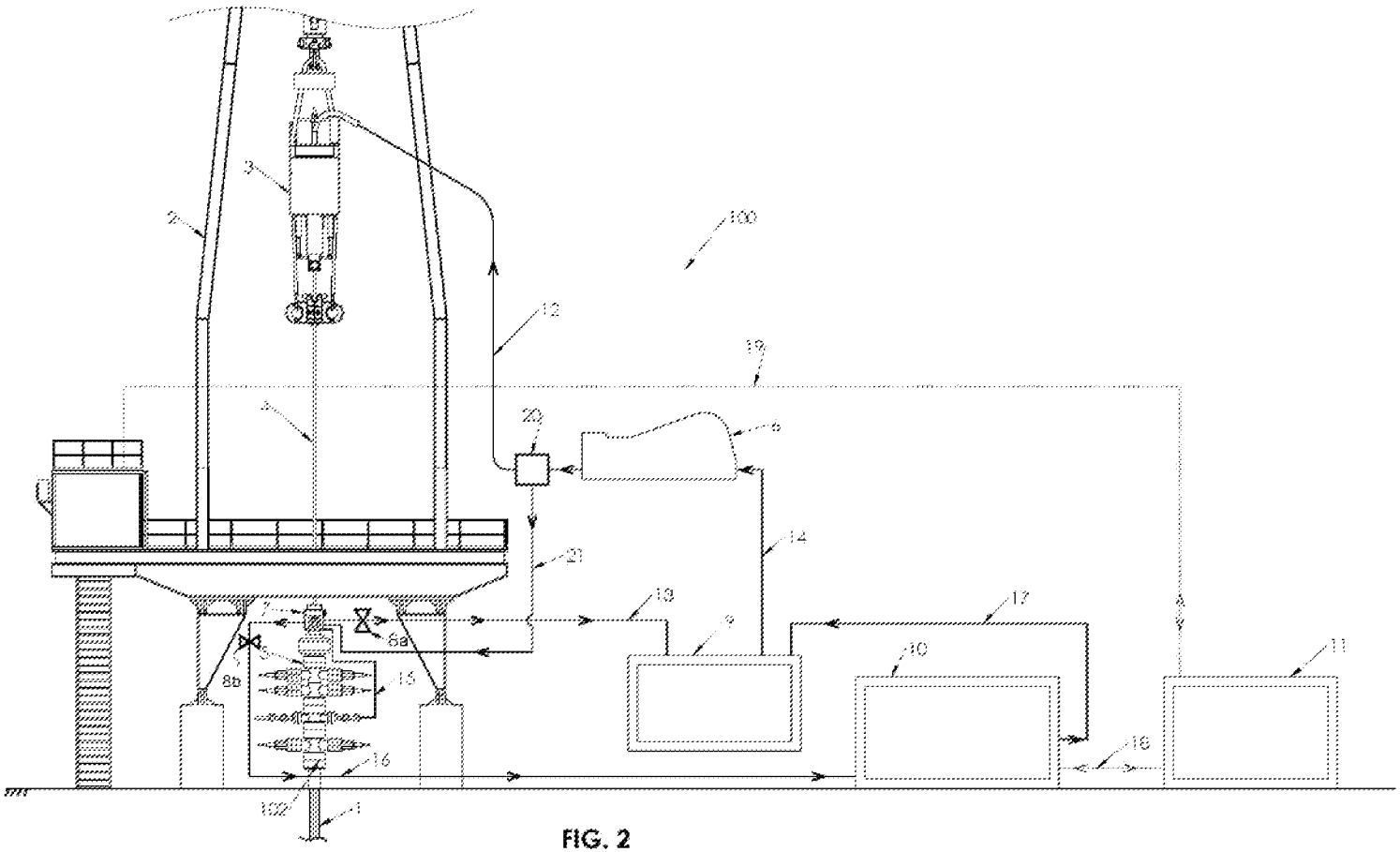
FIG. 2 PRIOR ART
FIG. 2 is a schematic view of the prior art managed pressure drilling system of FIG. 1, shown with an optional flow diverter.
Figure 3:
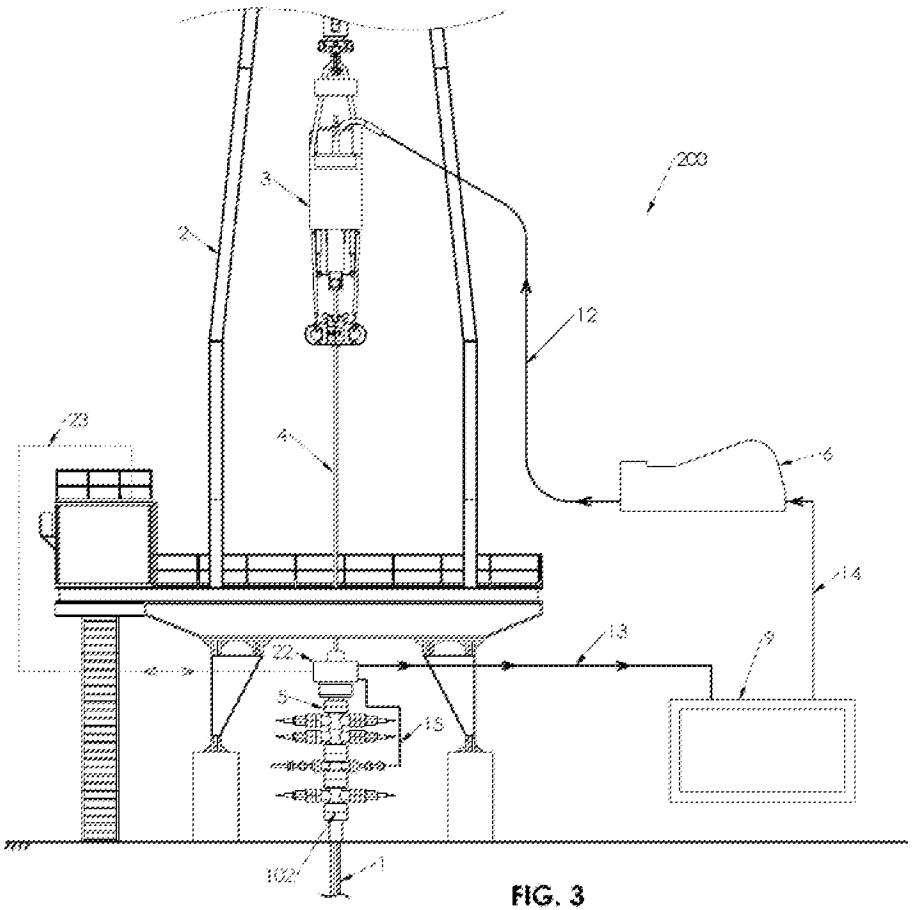
FIG. 3 is a schematic view of a managed pressure drilling system according to one embodiment of the present disclosure.

FIG. 3 illustrates a managed pressure drilling system 200 that comprises a PMD 22 according to one embodiment of the present disclosure. As can be seen in FIG. 3, drilling system 200 is configured to operate without a conventional MPD manifold 10 and MPD control shack 11, thereby eliminating the need for fluid lines and communication lines (e.g., high pressure MPD line 16, low pressure MPD line 17, and communication line 18) associated with the MPD manifold and MPD control shack. High pressure fluid lines, such as high pressure MPD line 16, on the surface can be a safety hazard. Further, with the use of PMD 22, the shutoff valves 8*a*,8*b* of system 100 (shown in FIGS. 1 and 2) can be omitted in system 200. In some embodiments, the PMD 22 of drilling system 200 replaces the MPD manifold 10 and optionally the RCD 7 of the prior art drilling system. In the illustrated embodiment, the PMD 22 is operably coupled to, and in fluid communication with, the BOP stack 5, and is positioned above the BOP stack 5. In some embodiments, the PMD 22 is directly connected to the BOP stack 5. In alternative embodiments, the PMD 22 is positioned somewhere within the BOP stack. Further, the PMD 22 is operably coupled to, and in communication with, the rig 2 via a communication line 23.

Figure 4:
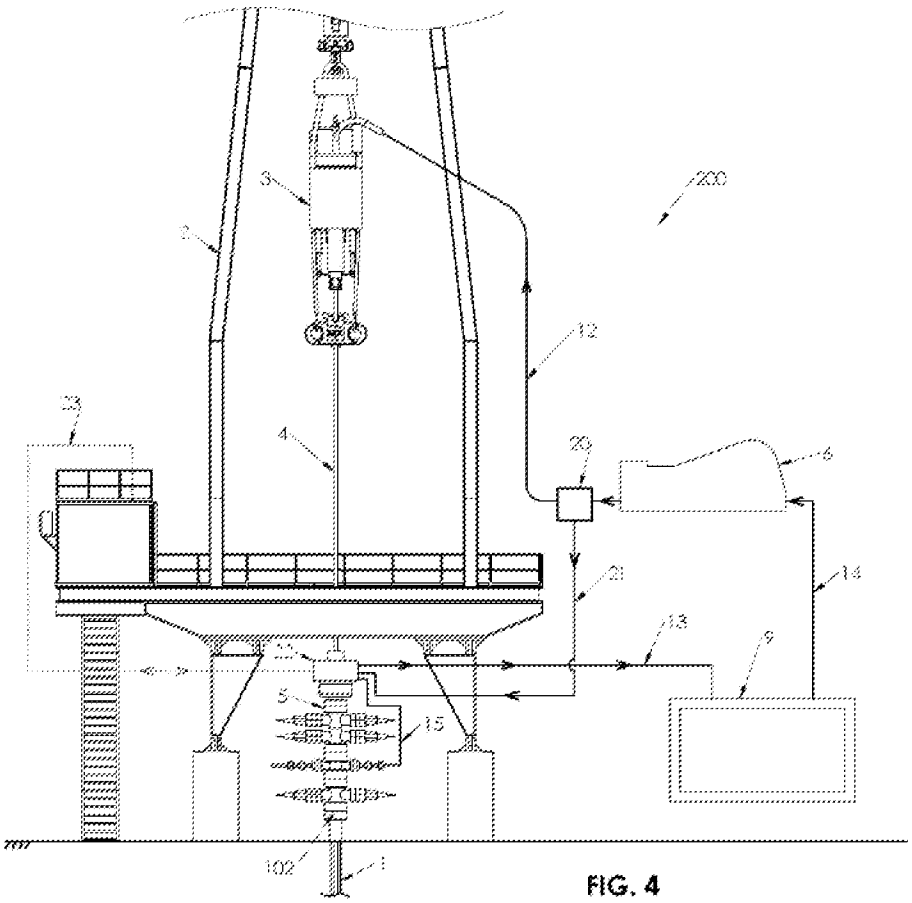
FIG. 4 is a schematic view of the managed pressure drilling system of FIG. 3, shown with an optional flow diverter.

With reference to FIG. 4, drilling system 200 may optionally include the flow diverter 20 that is operably coupled to, and in fluid communication with, the top drive 3 and the rig pump 6. The flow diverter 20 is also operably coupled to, and in fluid communication with, the PMD 22 via flow diverter line 21.

Drilling system 200 operates in a similar manner as drilling system 100, except drilling mud from the wellbore annulus flows into the PMD 22 via the wellhead 102 and the BOP stack 5, rather than to a separate MPD manifold 10 via the RCD 7 and the high pressure MPD line 16. In place of MPD manifold 10, the PMD 22 is used to maintain the desired backpressure within the wellbore 1. The PMD 22 may also seal the wellbore annulus using a wellbore sealing mechanism, such as a bearing assembly. The mud handling equipment 9 then receives the drilling mud from the PMD 22 via low pressure mud return line 13 and operates as described above with respect to drilling system 100. The resulting drilling fluid exiting the mud handling equipment 9 is recirculated by the rig pump 6 to the drilling tool, via the drill string 4.

Figure 5:
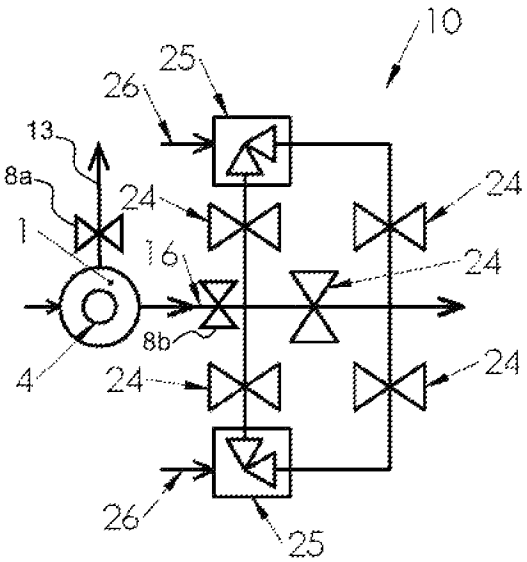
FIG. 5 PRIOR ART
FIG. 5 is a schematic drawing of a prior art MPD manifold shown in relation to a wellbore and a drill string of a managed pressure drilling system.

FIG. 5 illustrates a prior art MPD manifold 10 in relation to the wellbore 1 and the drill string 4. From the RCD situated on top of the opening of the wellbore 1, the drilling mud travels some distance in the high pressure MPD line 16 to arrive at the standalone MPD manifold 10. Depending on which valves 24 in the manifold 10 are open or closed, the drilling mud flows through one or both drilling chokes 25 of the MPD manifold 10 or bypasses both the chokes 25 via a choke gut line. Each choke 25 has a choke actuator 26 for controlling the choke 25 to allow adjustment of the surface backpressure and consequently the wellbore pressure profile.

Figure 6:
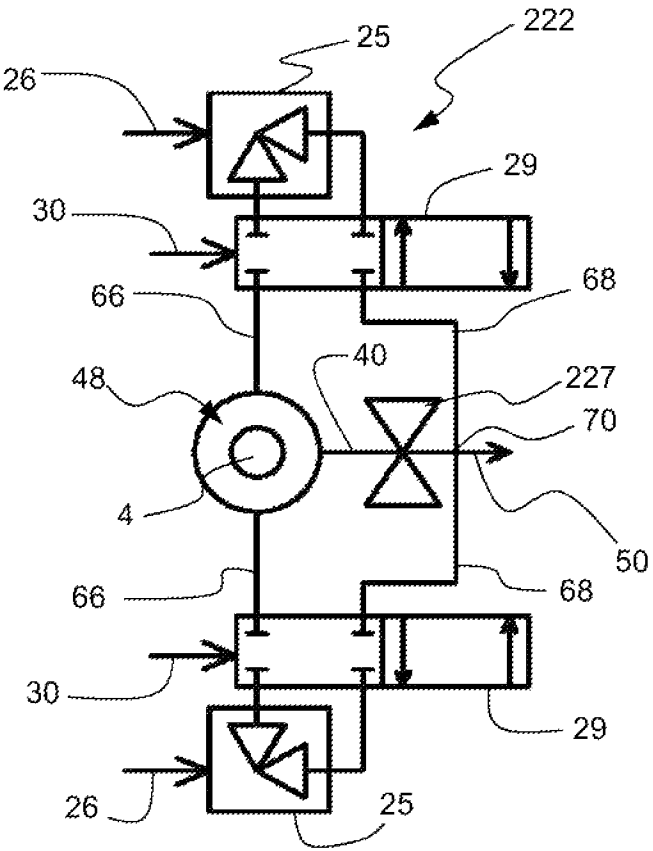
FIG. 6 is a schematic drawing of a pressure management device shown in relation to the drill string, according to one embodiment of the present disclosure.

FIG. 6 is a schematic drawing of an embodiment of a PMD of the present disclosure. In FIG. 6, a PMD 222 is positioned above the wellbore (not shown). In some embodiments, the PMD 222 is positioned immediately above a BOP (not shown) or another component of a BOP stack (not shown) of the wellbore. In other embodiments, the PMD 222 is positioned somewhere within the BOP stack. In some embodiments, the PMD 222 is configured to allow the drill string 4 to extend therethrough and freely rotate therein. In some embodiments, at least a portion of the PMD 222 is concentrically positioned about the drill string 4 above the wellbore.

The PMD 222 has an inlet 48 for fluid connection with the wellbore, for example via the BOP stack (shown in FIGS. 3 and 4), for receiving fluid from the wellbore annulus ("wellbore fluid" or "drilling mud") between the wellbore and the drill string 4. The PMD 222 has an outlet 50 for fluid connection with a flowmeter (not shown) or mud handling equipment 9 of system 200 via low pressure mud return line 13 (shown in FIGS. 3 and 4).

In some embodiments, the PMD 222 comprises a choke gut line 40 and a directional valve 227. In some embodiments, one end of the choke gut line 40 is in fluid communication with the inlet 48, while the other end of the choke gut line 40 is in fluid communication with the outlet 50. The choke gut line 40 thus fluidly connects the inlet 48 and the outlet 50 and provides a flow path therebetween. In some embodiments, the flow path provided by choke gut line 40 is a direct flow path between the inlet 48 and outlet 50. In some embodiments, the PMD 222 comprises a PMD housing (not shown) and the choke gut line 40 may be defined in the PMD housing. In some embodiments, the directional valve 227 is positioned somewhere along the choke gut line 40, between the inlet 48 and outlet 50, and is in fluid communication with both the inlet 48 and outlet 50. The directional valve 227 operates to control the flow of fluids between the inlet 48 and outlet 50 through the choke gut line 40. In some embodiments, the directional valve 227 has a bypass position and a choke position. In the choke position, the directional valve 227 restricts fluid flow through the flow path by blocking (or closing) the choke gut line 40. In the bypass position, the directional valve 227 unblocks (or opens) the choke gut line 40 to allow fluid to flow from the inlet 48 to outlet 50 via the flow path provided by choke gut line 40. The directional valve 227 may comprise a ball valve, a plug valve, a gate valve, or other valve configurations known to those skilled in the art. The directional valve 227 may be controlled by a directional valve actuator (not shown). The directional valve actuator may be a mechanical actuator, an electrical actuator, a hydraulic actuator, a pneumatic actuator, or a combination thereof.

In some embodiments, PMD 222 comprises one or more chokes 25. Each choke 25 has a choke inlet fluidly connected to the inlet 48 and a choke outlet fluidly connected to the outlet 50. In some embodiments which are not shown in FIG. 6, the choke 25 has defined therein a choke chamber and a choke orifice, and the choke 25 as a choke trim that is movable relative to the choke orifice. The choke inlet and the choke outlet can be selectively opened or closed to control fluid communication between the choke inlet and choke outlet and the choke chamber. When the choke inlet is closed, fluid communication between the choke inlet and the choke chamber is restricted. When the choke inlet is open, the choke inlet is in fluid communication between the choke chamber. When the choke outlet is closed, fluid communication between the choke outlet and the choke chamber is restricted. When the choke outlet is open, the choke outlet is in fluid communication with the choke chamber. In some embodiments, closing the choke inlet and/or the choke outlet comprises blocking the choke inlet and/or choke outlet; and opening the choke inlet and/or the choke outlet comprises unblocking the choke inlet and/or the choke outlet. To permit fluid flow through the choke 25, both the choke inlet and choke outlet are open. When both the choke inlet and choke outlet are open, the choke 25 is "open" or in an open position. To restrict fluid flow through the choke 25, one or both of the choke inlet and choke outlet are closed. In some embodiments, fluid flow through the choke 25 can be restricted by engaging the choke trim with the choke orifice, which eliminates the need to close choke inlet or the choke outlet. When the choke trim engages the choke orifice, the choke 25 can be referred to as "shut-in". When one or both of the choke inlet and choke outlet are closed, or when the choke is shut-in, the choke 25 is "closed" or in a closed position.

The operation of the choke 25 and methods for adjusting backpressure using the choke are known to those skilled in the art. In some embodiments, each choke 25 is controlled by a respective choke actuator 26. The choke actuator 26 may be a mechanical actuator, an electrical actuator, a hydraulic actuator, a pneumatic actuator, or a combination thereof. In some embodiments, one or both of the chokes 25 are manual chokes, thus enabling an operator to manually adjust a handwheel of the chokes to control the backpressure within the drilling system. In some embodiments, one or both of the chokes 25 are semi-automated chokes where the operator can adjust the choke positions via a computer (not shown) that controls actuator 26. In other embodiments, one or both of the chokes 25 are automated chokes that are monitored and controlled automatically by a computer via actuator 26. While the illustrated embodiment shows two chokes 25, fewer or more chokes may be present in other embodiments. PMD 222 may operate with only one choke 25 but additional chokes may be included for redundancy in other embodiments.

In the illustrated embodiment, an inlet passage 66 fluidly connects the choke inlet to the inlet 48 and an outlet passage 68 fluidly connects the choke outlet to the outlet 50. Inlet passage 66 is in fluid communication with the inlet 48 and outlet passage 68 is in fluid communication with the outlet 50. The outlet passage 68 intersects the choke gut line 40 at an intersection 70 and the directional valve 227 is positioned between the inlet 48 and the intersection 70.

In some embodiments, the PMD 222 may comprise one or more dual shutoff valves 29. In the illustrated embodiment, each dual shutoff valve 29 is operably coupled to, and in fluid communication with, a respective choke 25. The dual shutoff valve 29 is in fluid communication with the choke inlet and the choke outlet of its corresponding choke 25 and is configured to control the flow of fluids through its corresponding choke 25. In some embodiments, the dual shutoff valve 29 acts as a gatekeeper of the flow path between the inlet 48 and the choke inlet, and/or the flow path between the outlet 50 and the choke outlet. In some embodiments, the dual shutoff valve 29 has an open position and a closed position. When the dual shutoff valve 29 is in the open position, the choke inlet and choke outlet are open such that fluid is permitted to enter the choke 25 via the choke inlet, flow through the choke 25, and then exit the choke 25 via the choke outlet. When the dual shutoff valve 29 is in the closed position, the choke inlet and/or choke outlet are closed such that the flow paths between the inlet 48 and the choke inlet and/or between the choke outlet and the outlet 50 are blocked, thereby restricting fluid flow through the choke 25 (i.e., substantially no fluid can enter or exit the choke 25). In the closed position, the dual shutoff valve 29 closes one or both of the choke inlet and choke outlet of the corresponding choke 25.

In the illustrated embodiment, the dual shutoff valve 29 of each choke 25 is in fluid communication with the inlet passage 66 and outlet passage 68 of the corresponding choke. In the open position, the dual shutoff valve 29 allows fluid communication between the choke inlet and the inlet passage 66, and between the choke outlet and the outlet passage 68, thereby permitting fluid to flow from the inlet 48 into the choke via the inlet passage 66 and the choke inlet, flow through the choke, exit the choke at the choke outlet, and then exit the PMD 222 via outlet passage 68 and outlet 50. In the closed position, the dual shutoff valve 29 blocks fluid communication between the choke inlet and the inlet passage 66, and/or between the choke outlet and the outlet passage 68, thereby preventing fluid from entering or exiting the choke.

In some embodiments, the dual shutoff valve 29 comprises a single valve control mechanism operable to control the flow of fluids through the choke outlet and choke inlet of its corresponding choke 25 simultaneously. For example, the single valve control mechanism may comprise a slab gate, a plug valve, or other valve configurations known to those skilled in the art, that is movable (e.g., linearly and/or rotationally) to synchronously open (or close) the choke inlet and choke outlet of the choke 25. In other embodiments, the dual shutoff valve 29 may comprises more than one valve control mechanism to control the flow of fluids through the choke inlet and choke outlet. For example, in some embodiments, the dual shutoff valve 29 may comprise two separate valves, one for controlling fluid flow through the choke inlet and the other for controlling fluid flow through the choke outlet, such that the opening and/or closing of the choke inlet can be independent from the opening and/or closing of the choke outlet, and vice versa. In such a configuration, the choke inlet can be opened while the choke outlet is closed, and vice versa. The dual shutoff valve 29 may be configured to actuate the two separate valves simultaneously.

In some embodiments, each dual shutoff valve 29 is controlled by a respective dual shutoff valve actuator 30. In other embodiments, multiple dual shutoff valves 29 may be controlled by a single dual shutoff valve actuator 30. The dual shutoff valve actuator 30 is operable to transition its corresponding dual shutoff valve 29 between the open and closed positions. The dual shutoff valve actuator 30 may be a mechanical actuator, an electrical actuator, a hydraulic actuator, a pneumatic actuator, or a combination thereof. In some embodiments, actuator 30 is actuatable directly by an electric motor, by hydraulic force, or by pneumatic force (e.g., compressed gas pressure). In some embodiments, actuator 30 is driven by an electric motor that can also be controlled remotely. In further embodiments, actuator 30 may include a handwheel to allow an operator to manually control the valve 29 in case of motor failure and/or power outage.

Depending on the position of each of the directional valve 227 and each of the chokes 25, wellbore fluid (e.g., drilling mud) from the wellbore annulus can be directed to different flow paths of the PMD 222. In some embodiments, the PMD 222 has a bypass position, a single-choke position, and a double-choke position. When the PMD 222 is in the bypass position, the directional valve 227 is in the bypass position and the chokes 25 are closed, whereby fluid is permitted to flow from the inlet 48 to the outlet 50 via the choke gut line 40, while fluid flow through the chokes 25 is restricted. Choke gut line 40 thus provides a flow path between the inlet 48 and outlet 50 that bypasses the chokes 25. When the PMD 222 is in the single-choke position, the directional valve 227 is in the choke position and one of the chokes 25 is open, while the remaining chokes are closed. In the single-choke position, fluid is permitted to flow from the inlet 48 to the outlet 50 via the open choke 25, while fluid flow through the closed chokes and the choke gut line 40 is restricted. When the PMD 222 is in the double-choke position, the directional valve 227 is in the choke position and two chokes 25 are open, whereby fluid is permitted to flow from the inlet 48 to the outlet 50 via the two open chokes 25 simultaneously, while fluid flow through the choke gut line 40 is restricted. In some embodiments, the PMD 222 may have a trap wellbore pressure position such that fluid communication between the inlet 48 and the outlet 50 is restricted. In the trap wellbore pressure position, the directional valve 227 is in the choke position and the chokes 25 are closed, such that fluid is not permitted to flow from the inlet 48 to the outlet 50.

In embodiments where the PMD 222 comprises one or more dual shutoff valves 29, when the PMD 222 is in the bypass position, the dual shutoff valves 29 are in the closed position, thereby closing one or both of the choke inlet and choke outlet of the chokes 25. When the PMD 222 is in the single-choke position, one of the dual shutoff valves 29 is in the open position, thereby opening the choke inlet and choke outlet of the corresponding choke 25, while the other dual shutoff valves 29 are closed. When the PMD 222 is in the double-choke position, two dual shutoff valves 29 are in the open position, while the remaining dual shutoff valves 29 are closed. When the PMD 222 is in the trap wellbore pressure position, the dual shutoff valves 29 are closed.

In some embodiments, the PMD 222 comprises an RCD (not shown), or a bearing assembly (not shown), or other wellbore sealing mechanisms configured to allow the drill string 4 to axially extend through the PMD 222 and allow the drill string 4 to rotate while maintaining a fluid seal of the wellbore. In other embodiments, the PMD 222 does not have any wellbore sealing mechanisms but is rather configured to operate with a conventional RCD or to be incorporated into an existing RCD 7 of the drilling system (shown, for example, in FIGS. 1 and 2).

In some embodiments, when the PMD 222 is installed, for example, on top of a BOP or any component of the BOP stack or anywhere within the BOP stack, the inlet 48 is positioned about the drill string 4 above wellbore and is in fluid communication with the wellbore annulus. In some embodiments, the inlet 48 is substantially co-axial with the drill string 4 and/or concentric with the drill string 4. In some embodiments, at least a portion of the PMD 222 is positioned immediately above the BOP or any component of the BOP stack. In this context, the term "above" may refer to the relative physical orientation and/or mean "downstream" relative to the flow direction of the wellbore fluid. In some embodiments, the inlet 48 is directly connected to the BOP stack such that the inlet 48 is immediately downstream from the BOP stack, whereby wellbore fluid in the BOP stack enters the PMD 222 without passing through other components, such as flow lines, piping, tubing, etc. In the present disclosure, "directly" connected or attached to the BOP stack can mean directly connected to a BOP or any component of the BOP stack or positioned somewhere within the BOP stack. In embodiments where the PMD 222 does not comprise any wellbore sealing mechanisms, at least portion of the PMD 222 may be positioned between the BOP stack and the RCD of a drilling system. In this manner, the PMD 222 replaces the prior art MPD manifold with little or no footprint on the rig floor and/or the wellsite.

In some embodiments, a pressure sensor (not shown) may be situated close to the inlet 48 to measure the pressure of the incoming fluid from the wellbore annulus as it passes through the pressure sensor. In some embodiments, other properties such as temperature, density, etc. of the incoming fluid can also be measured at or near the inlet 48. During the operation of PMD 222, one or both of the chokes 25 can be adjusted to account for changes in the flow rate of the fluid flowing therethrough so that the desired backpressure within the wellbore is maintained. The backpressure applied by the one or more chokes 25 may be adjusted based on data collected by the pressure sensor. In some embodiments, only one of the chokes 25 is in operation at any given time to maintain the desired backpressure within the wellbore. In other embodiments, by allowing fluid to flow through two or more chokes 25 simultaneously, the two or more chokes can operate together to maintain the desired backpressure within the wellbore. It may be desirable to have at least two chokes 25 in PMD 222 since one of the chokes may be bypassed in case of failure or blockage of same and/or to allow the choke to be inspected, serviced, repaired, or replaced during drilling operations while at least one other choke remains in service.

In embodiments where the PMD 222 has two or more chokes 25, the closing of the dual shutoff valve 29 of one choke may be synchronized with the opening of the dual shutoff valve 29 of one or more of the other chokes 25, to allow a smooth transition when switching fluid flow from one flow path to another. In further embodiments, the opening and closing of two or more dual shutoff valves 29 may be coordinated such that when directional valve 227 is in the choke position, fluid can flow through one or more chokes 25 at any given time, which may be beneficial in preventing sudden spikes or drops in fluid pressure in the wellbore when switching chokes. In some embodiments, when transitioning to and from the bypass position of the PMD 222, the corresponding actuation of the directional valve 227 and one or more of the dual shutoff valves 29 may be performed by the same actuator or otherwise synchronized such that the choke gut line 40 and at least one of the chokes 25 are not fully blocked during the transition. Synchronizing the actuation of the directional valve 227 and one or more of the dual shutoff valves 29 may provide a smoother transition between the PMD positions, which may be beneficial in preventing sudden spikes or drops in fluid pressure in the wellbore as the directional valve 227 redirects fluid flow in the PMD 222. In some embodiments, the synchronization of any two of the dual shutoff valves 29 and the directional valve 227 may be performed mechanically, hydraulically, electronically, pneumatically, or a combination thereof, or by any technique known to those skilled in the art. In some embodiments, the PMD 222 may comprise one or more position sensors (not shown) to allow determination of the position of one or more valves 29,227 in real-time. The position sensors may be positioned on the actuators of the valves 29,227 and/or on the valves 29,227.

In some embodiments, the PMD 222 is in communication with a control unit (not shown). The control unit is configured to monitor pressure data collected by the pressure sensor in real-time and to control the one or more choke actuators 26 and dual shutoff valve actuators 30, and the directional valve actuator. Based on the pressure data from the pressure sensor, the control unit can predict pressures in the near future in order to anticipate any increases above the safety threshold of the chokes 25. By predicting future pressures, the control unit may provide early detection of potential choke failure and/or flowmeter failure and can thus have sufficient time to actuate and change the position of one or both of the dual shutoff valves 29 to redirect fluid flow within the PMD 222. In some embodiments, if the control unit detects any washed-out choke components and/or potential clogging of a choke, the control unit may provide an alert to an operator to indicate that inspection and/or maintenance of the particular choke is required. The alert may be, for example, an electronic message to the operator via a display and/or an audio alarm or visual indicator (not shown) in the PMD 222.

In this manner, the PMD 222, together with the control unit, may be used to predict and prevent well kicks during drilling operations by analyzing the fluid flow characteristics measured upstream and downstream of the well. The PMD 222 (including any of the actuators therein) may be fully automated and/or may be controlled remotely by the control unit. As such, the PMD 222 may provide fast and precise execution of fluid rerouting sequences with minimal human intervention. The PMD 222 may be useful for unmanned wells and/or offshore rigs where prompt operator access to the PMD may be unavailable or restricted.

In some embodiments, the PMD 222 may operate with the control unit and the control unit has a processor and a non-transitory computer readable medium operably coupled thereto; a plurality of instructions, such as control logic software, may be stored on the non-transitory computer readable medium, and the instructions are accessible to, and executable by, the processor. In some embodiments, the control unit is in communication with one or more of: choke actuators 26, dual shutoff valve actuators 30, directional valve actuator, pressure sensor, position sensors, and any other component of the PMD. In some embodiments, the control unit may communicate control signals to the choke actuators 26, based on data received from the pressure sensor. In some embodiments, with reference to FIGS. 3 and 4, the control unit may also be in communication with one or more other sensors associated with the drilling system such as, for example, one or more sensors associated with the drilling tool (not shown), the wellhead 102, the BOP stack 5, the RCD 7, the mud handling equipment 9, etc. The control unit may accordingly communicate control signals to the choke actuators 26 based on data received from the one or more other sensors.

In some embodiments, the control unit operates according to a valve schedule. A sample valve schedule of PMD 222 is shown below:

| PMD Position | Valve 227 Position | Dual shutoff valve 29 Position ($1^{st}$ choke) | Dual shutoff valve 29 Position ($2^{nd}$ choke) |
|---|---|---|---|
| Bypass | Bypass | Closed | Closed |
| Single-choke ($1^{st}$ choke) | Choke | Open | Closed |
| Single-choke ($2^{nd}$ choke) | Choke | Closed | Open |
| Double-choke | Choke | Open | Open |
| Trap wellbore pressure | Choke | Closed | Closed |

Figure 7:
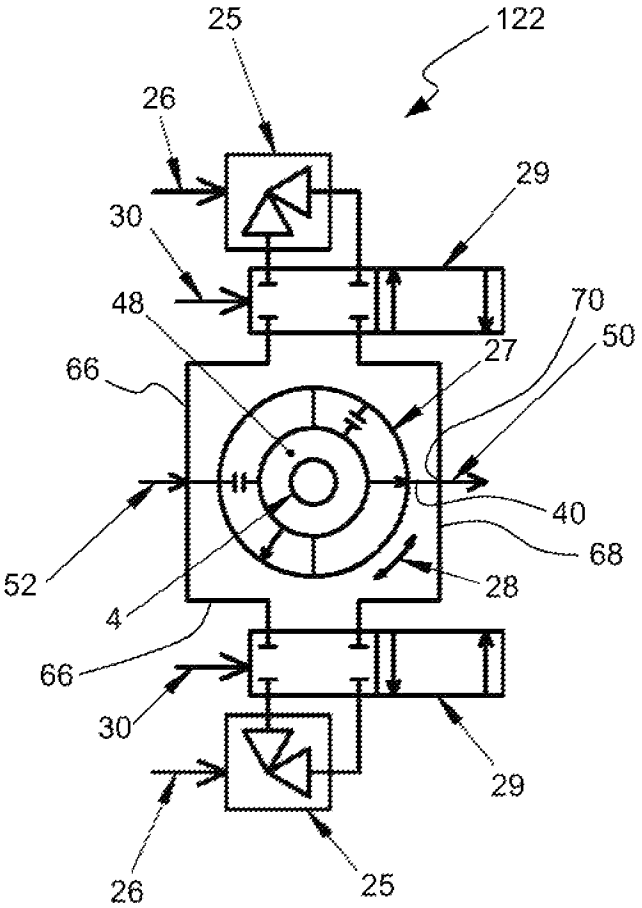
FIG. 7 is a schematic drawing of a pressure management device shown in relation to the drill string, according to another embodiment of the present disclosure.

FIG. 7 is a schematic drawing of another embodiment of a PMD of the present disclosure. PMD 122 in FIG. 7 is similar to PMD 222 of FIG. 6, except PMD 122 has a directional valve 27 instead of directional valve 227. The other components of PMD 122 are the same or similar to the like-numbered components of PMD 222 as described above with respect to FIG. 6 so they are not described again. In some embodiments, directional valve 27 is controlled by a directional valve actuator 28. The PMD 122 may optionally have a diverted pump flow inlet 52 for receiving fluid from the flow diverter 20 (shown in FIG. 4). In some embodiments, the diverted pump flow inlet 52 is in fluid communication with the inlet passages 66 and the directional valve 27.

Directional valve 27 of PMD 122 is configured to direct the wellbore fluid from the wellbore annulus to different flow paths depending on the position of the directional valve 27. In PMD 122, one of the flow paths is a choke gut line 40 between the inlet 48 and the outlet 50, and the directional valve 27 is positioned somewhere along the choke gut line 40, between the inlet and the outlet. In some embodiments, the directional valve 27 is positioned between the inlet and an intersection 70 of the choke gut line 40 and the outlet passage 68 fluidly connected to the choke outlet of choke 25. The directional valve 27 operates to control fluid communication between the inlet 48 and outlet 50 via the choke gut line 40. In some embodiments, the directional valve 27 has a choke position and a bypass position. In the bypass position, valve 27 operates to divert the fluid directly to outlet 50 via the choke gut line 40, bypassing the inlet passages 66 (and the chokes 25). In the choke position, valve 27 operates to block choke gut line 40 and divert fluid entering the inlet 48 to one or both of inlet passages 66.

Like the above-described PMD 222, the PMD 122 has a bypass position, a single-choke position, and a double-choke position. When the PMD 122 is in the bypass position, wherein the directional valve 27 is in the bypass position and both dual shutoff valves 29 are closed, fluid is permitted to flow from the inlet 48 directly to the outlet 50 via choke gut line 40, while fluid flow through the chokes 25 is restricted. When the PMD 122 is in the single-choke position, wherein the directional valve 27 is in the choke position and one of the dual shutoff valves 29 is open and the other dual shutoff valve 29 is closed, fluid is only permitted to flow from the inlet 48 to the outlet 50 via the respective choke 25 of the open dual shutoff valve 29. When the PMD 122 is in the double-choke position, wherein the directional valve 27 is in the choke position and both dual shutoff valves 29 are open, fluid is permitted to flow from the inlet 48 to the outlet 50 via both chokes 25. The PMD 122 has a pump diverter flow position, where the directional valve 27 is in the choke position and one or both dual shutoff valves 29 are open such that fluid entering the PMD 122 from the diverted pump flow inlet 52 flows through one or both chokes 25 before exiting the PMD at outlet 50. In some embodiments, the PMD 122 may have a trap wellbore pressure position such that fluid communication between the inlet 48 and the outlet 50 is restricted. In the trap wellbore pressure position, the directional valve 27 is in the choke position and both dual shutoff valves 29 are closed so that fluid is not permitted to flow from the inlet 48 to the outlet 50.

In some embodiments, when the PMD 122 is installed, for example, on top of a BOP or any component of the BOP stack or anywhere within the BOP stack, the directional valve 27 is positioned about the drill string 4 above the wellbore and the directional valve 27 is in fluid communication with the wellbore annulus via the inlet 48. In some embodiments, the directional valve 27 is substantially coaxial with the drill string 4 and/or concentric with the drill string 4. In some embodiments, at least a portion of the PMD 122 and/or the directional valve 27 is positioned immediately above a BOP or any component of the BOP stack. In embodiments where the PMD 122 does not comprise any wellbore sealing mechanisms, at least portion of the PMD 122 and/or the directional valve 27 may be positioned between the BOP stack and the RCD.

A sample valve schedule of PMD 122 is shown below:

| PMD Position | Valve 27 Position | Dual shutoff valve 29 Position ($1^{st}$ choke) | Dual shutoff valve 29 Position ($2^{nd}$ choke) |
|---|---|---|---|
| Bypass | Bypass | Closed | Closed |
| Single-choke ($1^{st}$ choke) | Choke | Open | Closed |
| Single-choke ($2^{nd}$ choke) | Choke | Closed | Open |
| Double-choke | Choke | Open | Open |
| Pump diverter flow | Choke | Open/Closed | Open/Closed |
| Trap wellbore pressure | Choke | Closed | Closed |

FIGS. 8 to 13 show a sample configuration of PMD 222 of FIG. 6 according to one embodiment of the present disclosure. In the illustrated embodiment shown in FIGS. 8 to 13, a PMD 322 generally comprises a PMD housing 331, a first choke assembly 336*a*, a second choke assembly 336*b*, and a directional valve assembly 347. In some embodiments, PMD housing 331 is configured to be operably coupled to, and in fluid communication with, a BOP stack 5, the choke assemblies 336*a*,336*b*, and the directional valve assembly 347. In some embodiments, the PMD housing 331 includes the directional valve assembly 347 and/or the directional valve assembly is integrated with the PMD housing 331. In some embodiments, the PMD housing 331 is configured to allow the drill string 4 to extend therethrough and to rotate therein. In further embodiments, PMD housing 331 may be configured to receive a sealing mechanism, such as a bearing assembly 334, therein for rotatably and sealingly engaging the drill string 4. In some embodiments, PMD housing 331 provides a number of flow paths therethrough for diverting wellbore fluids from a wellbore annulus (not shown). In some embodiments, PMD housing 331 has a generally tubular body having an inner surface defining an axial inner bore 361 extending between a first end 354 and a second end 356 of the PMD housing 331. In some embodiments, inner bore 361 is configured to receive a segment of the drill string 4 therethrough. For example, the inner bore 361 may be sized to accommodate a portion of the drill string 4 extending axially therethrough, such that the drill string 4 can rotate freely without interference with the inner surface of the PMD housing 331. In some embodiments, the PMD housing 331 is configured to receive the bearing assembly 334 via the first end 354 such that the bearing assembly 334 may be removably attached to the PMD housing. The second end 356 is configured for direct connection to the blowout preventor stack 5 via, for example a flange connection, or other techniques known to those skilled in the art.

In some embodiments, PMD housing 331 has a plurality of bores extending laterally through the body of PMD housing 331, the plurality of bores defining a valve inlet passage 362, a first choke inlet passage 366*a*, and a second choke inlet passage 366*b*. The valve inlet passage 362 and the first and second choke inlet passages 366*a*,366*b* intersect the inner bore 361 and are in fluid communication with the inner bore 361. In the sample embodiment shown in FIGS. 8 to 13, the valve inlet passage 362 is substantially orthogonal to the inlet passages 366*a*,366*b* and the inlet passages 366*a*,366*b* are substantially coaxial arranged relative to one another. In the illustrated embodiment the valve inlet passage 362 and the first and second choke inlet passages 366*a*,366*b* are positioned at about the same axial location in the body of the PMD housing 331. Other configurations of the PMD housing 331, for example other configurations of the inner bore 362 and the plurality of bores in the PMD housing 331, are possible. In some embodiments, PMD housing 331 may be a single flow block. In other embodiments, PMD housing 331 may comprise a plurality of flow blocks and/or piping (e.g., spools) operably coupled together to provide one or more flow paths therein.

The PMD housing 331 is configured to permit secure attachment to the direction valve assembly 347 at the valve inlet passage 362; to the first choke assembly 336*a* at the first choke inlet passage 366*a*; and to the second choke assembly 336*b* at the second choke inlet passage 366*b*. The directional valve assembly 347 and the first and second choke assemblies 336*a*,336*b* may be securely and releasably attached to the PMD housing 331 by, for example fasteners, or other techniques known to those skilled in the art. When the directional valve assembly 347 and the first and second choke assemblies 336*a*,336*b* are connected to the PMD housing 331, the valve inlet passage 362 allows fluid communication between the inner bore 361 and the directional valve assembly 347; and the first and second choke inlet passages 366*a*,366*b* each allow fluid communication between the inner bore 361 and the first and second choke assemblies 336*a*,336*b*, respectively.

The opening of the inner bore 361 at the second end 356 defines an inlet 348 of the PMD 322. With further reference to FIGS. 3 and 4, when the second end 356 of PMD housing 331 is connected to the BOP stack 5, fluid from the wellbore annulus of wellbore 1 can flow into the inner bore 361 of the PMD housing 331 via the wellhead 102, the BOP stack 5, and the inlet 348, consecutively. Fluid entering the inner bore 361 of the PMD housing 331 is diverted through at least one of various possible flow paths in the PMD 322, depending on the position of each of the directional valve assembly 347, and the first and second choke assemblies 336*a*,336*b*. The operation of the PMD 322 will be described in more detail below.

While PMD 322 shown in FIGS. 8 to 13 has two choke assemblies 336*a*,336*b*, it can be appreciated that the PMD may comprise fewer or more choke assemblies in other embodiments. In the illustrated embodiment, choke assemblies 336*a*,336*b* are identical and are mirror images of one another so only choke assembly 336*a* will be described in detail. In some embodiments, choke assembly 336*a* comprises a choke cartridge 326, a choke housing 325, and a dual shutoff valve 329 disposed in the choke housing 325.

Figure 15B:
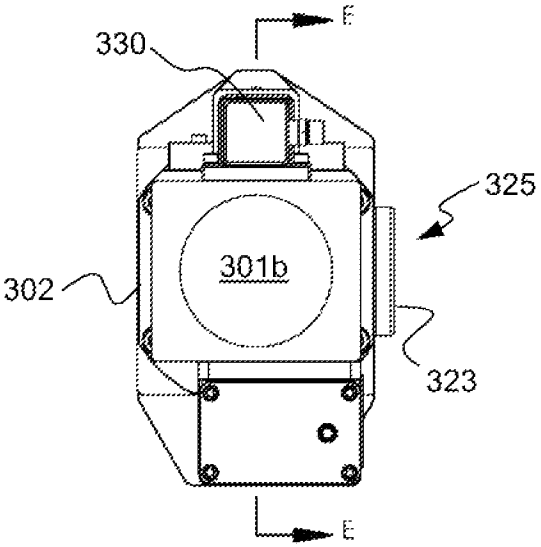
FIGS. 15A, 15B, and 15C are a perspective view, an end plan view, and a bottom plan view, respectively, of a choke housing of the pressure management device, according to one embodiment of the present disclosure.
Figure 15C:
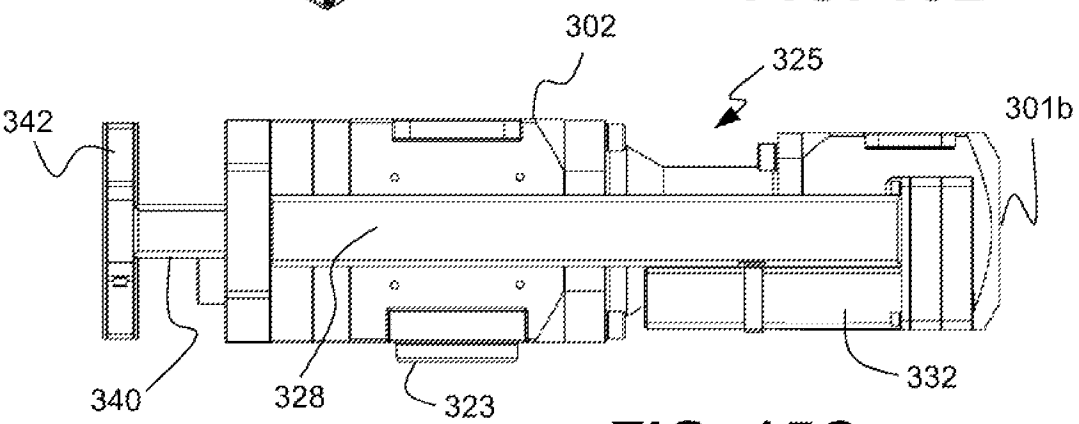
Figure 15A:
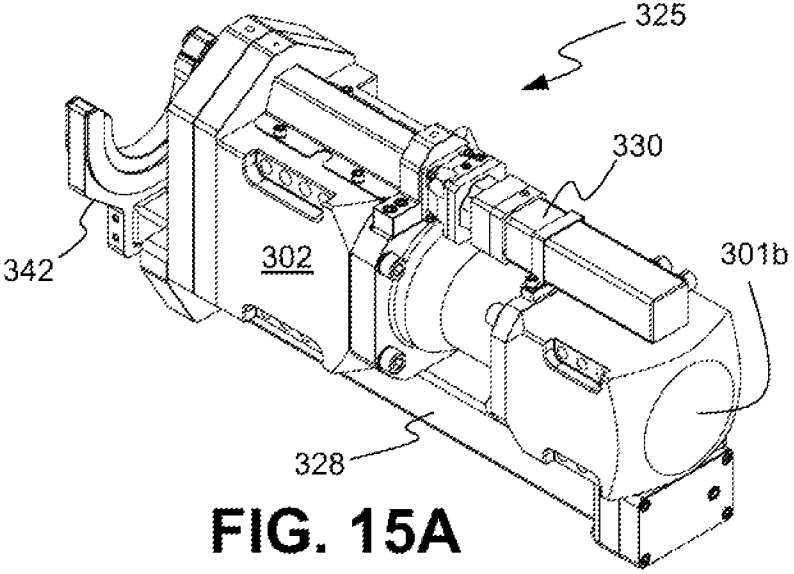
Figure 16A:
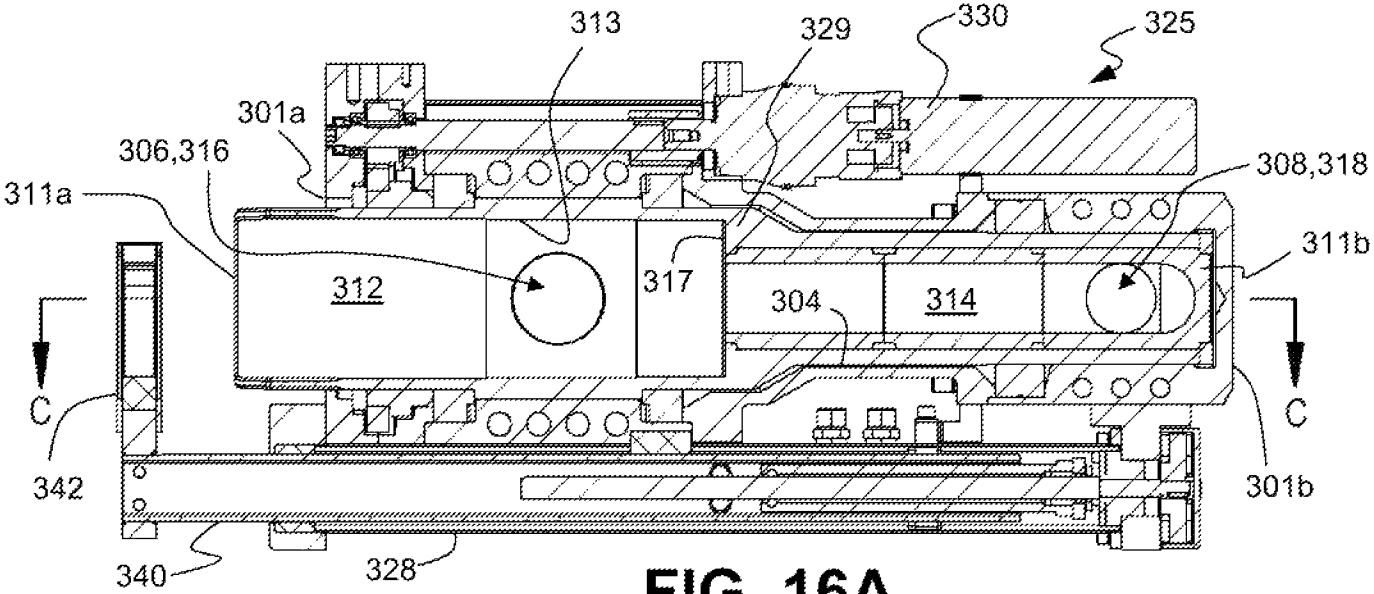
FIG. 16A is a cross-sectional view of the choke housing of FIG. 15B, taken along line E-E.
Figure 16B:
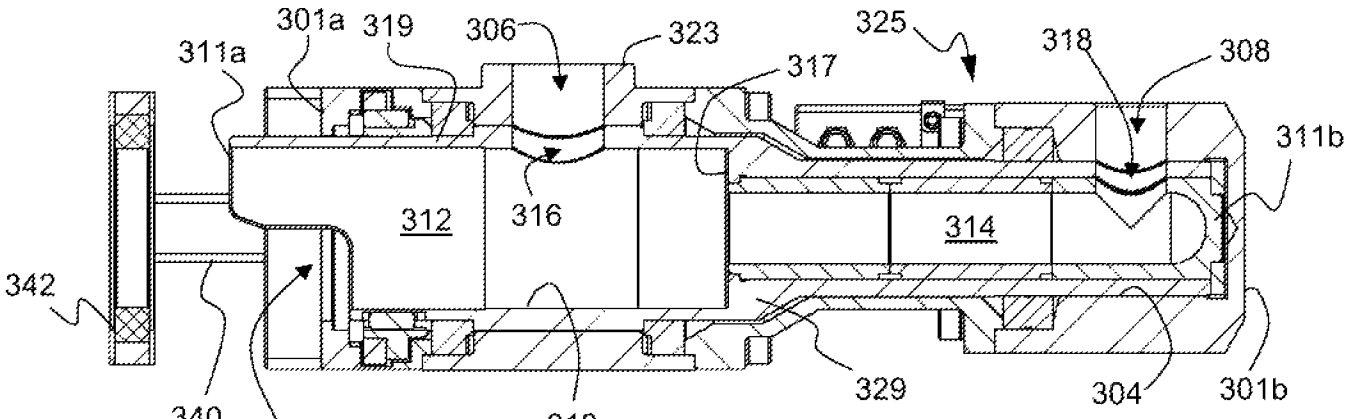
FIG. 16B is a cross-sectional view of the choke housing of FIG. 16A, taken along line C-C.

FIGS. 15 and 16 show one embodiment of the choke housing 325 with (at least a portion of) the dual shutoff valve 329 installed therein. The choke housing 325 has a first end 301*a*, a second end 301*b*, an outer surface 302, an inner surface 304, a choke inlet 306, and a choke outlet 308. The choke inlet and outlet 306,308 extend through the inner and outer surfaces 304,302 to permit fluid flow into and out of the choke housing 325. In the illustrated embodiment, the inlet 306 and outlet 308 are spaced apart axially between the first and second ends 301*a*,301*b* and are positioned at about the same azimuthal location at the outer surface 302. Other orientations of the inlet 306 and outlet 308 are possible. In some embodiments, the first end 301*a* is open and the second end 301*b* is closed and the inner surface 304 defines an inner chamber for receiving at least a portion of the dual shutoff valve 329.

In some embodiments, with specific reference to FIG. 16, the dual shutoff valve 329 is a generally tubular member having a first end 311*a*, a second end 311*b*, a wall 319, an inlet port 316 and an outlet port 318 extending through the wall 319, and an inner surface 313 defining a large chamber 312 and a small chamber 314 adjoining the large chamber 312. In some embodiments, the large chamber 312 is closer to the first end 311*a* than the small chamber 314; and the small chamber 314 is closer to the second end 311*b* than the large chamber 312. In the illustrated embodiment, the chambers 312,314 are connected to each other at a respective open end and extend axially along a substantial length of the dual shutoff valve 329. In some embodiments, the chambers 312,314 are in a coaxial arrangement. The chambers 312 and 314 are in fluid communication with one another via their connected open ends. The other end of the small chamber 314, adjacent second end 311*b*, is closed. The first end 311*a* of the valve 329 is open to provide open access to the large chamber 312 and the small chamber 314. In some embodiments, the dual shutoff valve 329 has an alignment profile at the first end 311*a*. For example, the alignment profile of the valve 329 may comprise a recess 315 formed at the first end 311*a*. In other embodiments, instead of dual shutoff valve 329, the choke housing 325 has the alignment profile. In some embodiments, a shoulder 317 is defined on the inner surface 313 between the large chamber 312 and the small chamber 314. The inlet port 316 and outlet port 318 permit fluid to flow in and out of the valve 329, respectively. In the illustrated embodiment, the inlet port 316 and outlet port 318 are spaced apart axially between the first and second ends 311*a*,311*b* and are positioned at about the same azimuthal location on the inner surface 313. In some embodiments, the inlet port 316 and outlet port 318 are positioned on the inner surface 313 to coincide with the large chamber 312 and the small chamber 314, respectively, such that fluid can enter chamber 312 through inlet port 316, flow to chamber 314, and then exit through outlet port 318. Other configurations of the dual shutoff valve are possible.

In some embodiments, at least a portion of the dual shutoff valve 329 is supported and rotatably mounted in the inner chamber defined by inner surface 304 such that the dual shutoff valve 329 is rotatable relative to the choke housing 325. In the illustrated embodiment, the dual shutoff valve 329 is mounted in the inner chamber of the choke housing 325 such that the first and second ends 311*a*,311*b* are adjacent to first and second ends 301*a*,301*b*, respectively, and the axial positions of inlet port 316 and outlet port 318 coincide with those of inlet 306 and outlet 308, respectively. The dual shutoff valve 329 may be rotatably mounted to the choke housing 325 by bearings (not shown), or other mechanisms known to those skilled in the art. In some embodiments, the dual shutoff valve 329 is substantially concentrically positioned inside the choke housing 325 and is rotatable about its central longitudinal axis relative to the choke housing 325. The interface between the valve 329 and the housing 325 may be fluidly sealed by seals, such as o-rings (not shown).

In some embodiments, a dual shutoff valve actuator 330 is operably coupled to, and in communication with, the dual shutoff valve 329 for actuating the valve 329 to effect movement (i.e., to drive the rotation) of the valve 329 relative to the housing 325. In the illustrated embodiment, the dual shutoff valve actuator 330 is supported on the outer surface 302 of the choke housing 325 and engages the dual shutoff valve 329 near the first end 311*a* thereof. The dual shutoff valve actuator 330 may actuate the dual shutoff valve 329 mechanically, for example, by (planetary) gears, a belt, a chain drive, etc., or electrically, hydraulically, or a combination thereof, or by other techniques known to those skilled in the art. In some embodiments, the dual shutoff valve actuator 330 may comprise a motor that may be operated remotely and may be configured to allow automation of the actuation of the valve 329. Other configurations of valve 329 and actuator 330, and other ways of moving and/or rotating valve 329 than those described herein are possible.

In some embodiments, the actuator 330 operates to transition the valve 329 between an open position and a closed position, and vice versa. In the open position, as shown in FIG. 16, the inlet port 316 and outlet port 318 of the valve 329 are aligned with the inlet 306 and outlet 308 of the choke housing 325, respectively, thereby allowing communication between inlet 306 and large chamber 312 (via inlet port 316), and between small chamber 314 and outlet 308 (via outlet port 318). The term "aligned" herein includes substantially aligned (i.e. substantially co-axial or concentric) and partially aligned. Further, the expression "not aligned" and the term "misaligned" mean blocked. In the closed position, the inlet port 316 and outlet port 318 are misaligned with the inlet 306 and outlet 308, respectively, such that the wall of the valve 329 blocks the inlet 306 and outlet 308, thereby restricting communication between the inlet 306 and large chamber 312, and between small chamber 314 and outlet 308.

Referring to FIGS. 15 and 16, in some embodiments, the choke housing 325 comprises an installation mechanism 328 for facilitating the installation of a choke cartridge 326 (shown, for example, in FIG. 17) into the choke housing. The choke cartridge 326 will be described in detail below. The installation mechanism 328 may help ensure that the choke cartridge 326 is properly positioned relative to the choke housing 325, e.g., the choke cartridge is aligned with the opening of large chamber 312 at the first end 311*a* of the dual shutoff valve 329 and that the choke cartridge 326 is positioned concentrically with the large chamber 312 and/or the small chamber 314. In some embodiments, the installation mechanism 328 is secured to the outer surface 302. In the illustrated embodiment, the installation mechanism 328 comprises a telescoping arm 340 that is selectively extendable and retractable relative to the choke housing 325 in a direction parallel to the longitudinal axis of the choke housing 325.

In some embodiments, the installation mechanism 328 comprises a support bracket 342 at or near the free end of the telescoping arm 340. The bracket 342 is configured to engage an outer surface of the choke cartridge 326. In some embodiments, the bracket 342 has a U-shaped frame, at least a portion of which is configured to matingly receive an axial segment of the choke cartridge 326 therein, to help minimize lateral movement of the cartridge 326. In some embodiments, the U-shaped frame is oriented such that the opening of the frame faces upwards to allow the choke cartridge 326 to be placed on to the frame from above. In some embodiments, when the choke cartridge 326 is supported on the support bracket 342, the installation mechanism 328 can be selectively actuated to help guide and move the cartridge 326 into the choke housing 325.

In some embodiments, an installation mechanism actuator 332 is operably coupled to the installation mechanism 328 for actuating the mechanism 328 to effect movement thereof (e.g., to drive the telescoping arm 340 axially to extend and retract same) relative to the choke housing 325. The installation mechanism actuator 332 may be supported on the outer surface 302 of the choke housing 325. The installation mechanism actuator 332 may actuate the installation mechanism 328 mechanically, for example, by engagement of a screw with a threaded interface, or electrically, hydraulically, or a combination thereof, or by other techniques known to those skilled in the art. In some embodiments, the installation mechanism actuator 332 may comprise a motor that may be operated remotely and may be configured to allow automation of (at least a part of) the installation process of the choke cartridge 326.

Figure 17B:
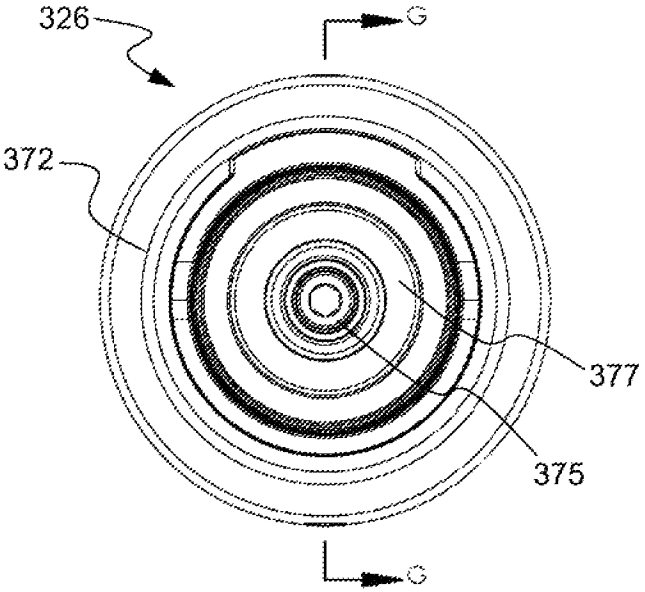
FIGS. 17A and 17B are a perspective view and an end plan view, respectively, of a choke cartridge installable in a choke housing of the pressure management device, according to one embodiment of the present disclosure.
Figure 17A:
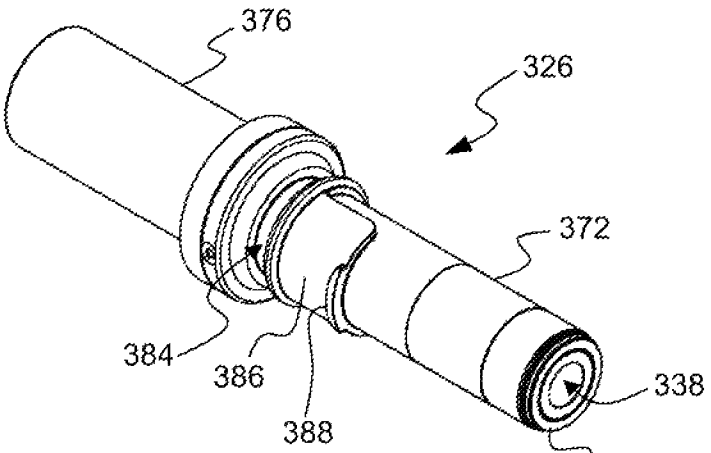
Figure 17C:
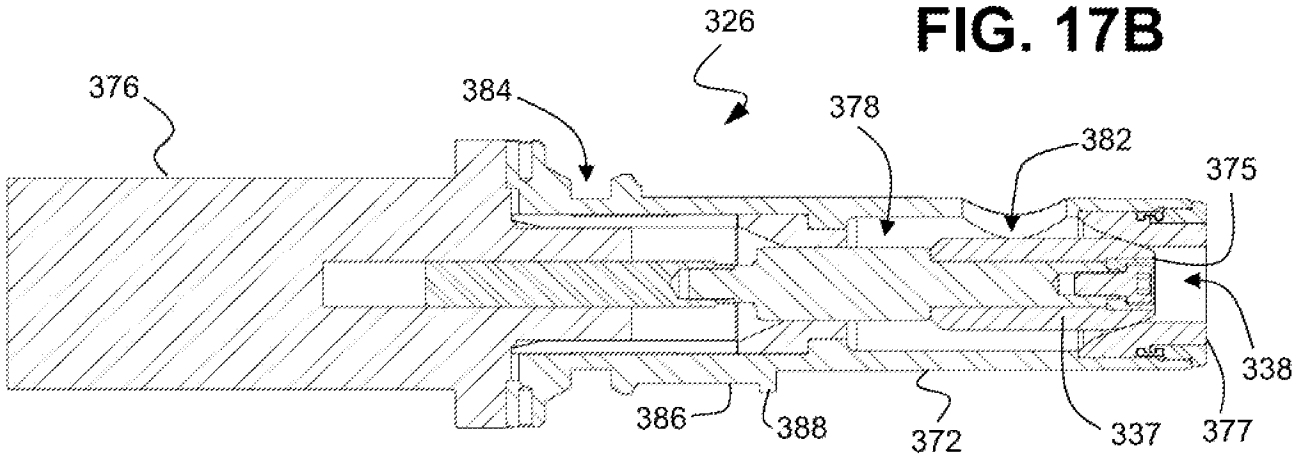
FIG. 17C is a cross-sectional view of the choke cartridge of FIG. 17B, taken along line G-G.
Figure 18A:
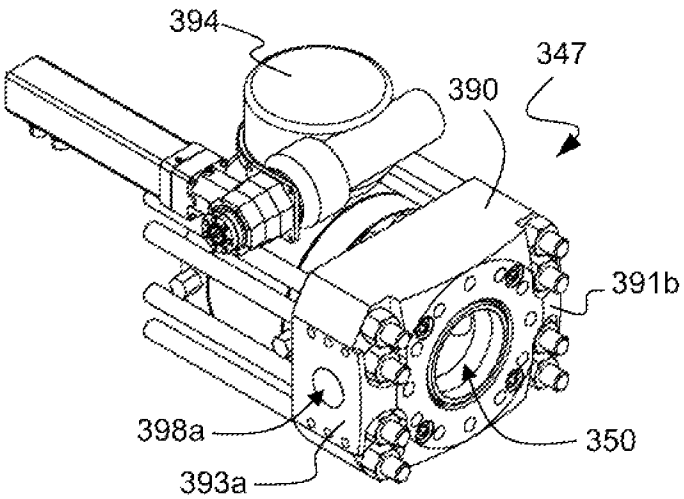
FIGS. 18A and 18B are a perspective view and an end view, respectively, of a directional valve assembly of the pressure management device, according to one embodiment of the present disclosure.
Figure 18B:
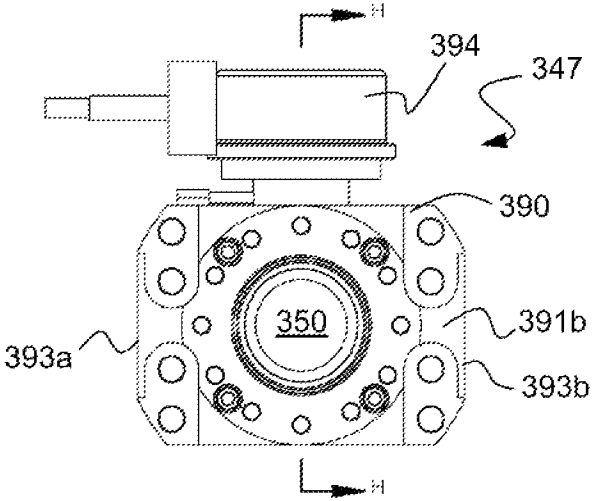
Figure 18C:
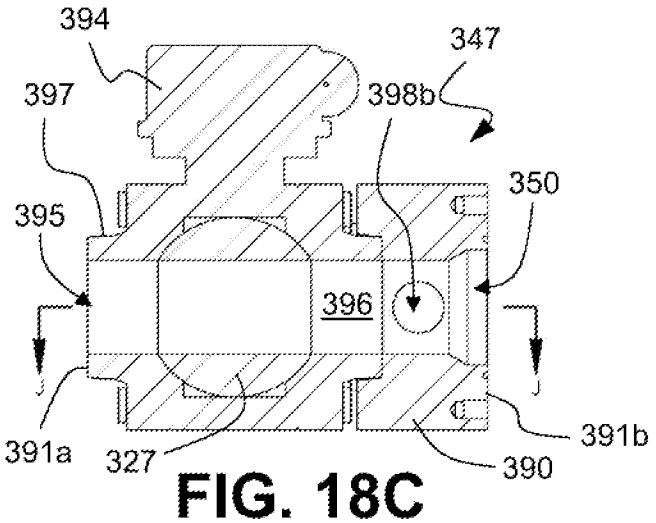
FIG. 18C is a cross-sectional view of the directional valve assembly of FIG. 18B, taken along line H-H.
Figure 18D:
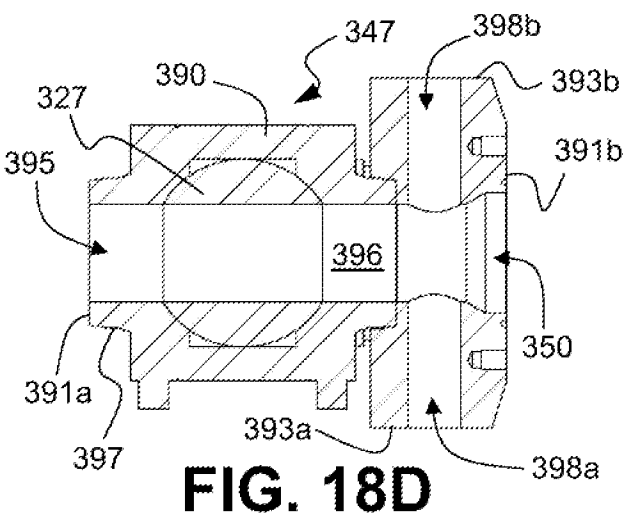
FIG. 18D is a cross-sectional view of the directional valve assembly of FIG. 18C, taken along line J-J.

FIG. 17 shows a sample embodiment of a choke cartridge 326 that is installable in the choke housing 325. In the illustrated embodiment, the choke cartridge 326 comprises a cartridge housing 372, a choke trim 337 positioned in the cartridge housing 372, a choke actuator 376 operably coupled to the choke trim 337 for driving axial movement of the choke trim 337 relative to the cartridge housing 372. The cartridge housing 372 is configured to be received in the large chamber 312 of the dual shutoff valve (shown in FIG. 16). In some embodiments, the cartridge housing 372 has an inner bore 378 extending axially therein and opens at a first end 377 to define a choke orifice 338. The cartridge housing 372 has a cartridge inlet 382 extending through the wall of the cartridge housing 372. The cartridge inlet 382 is positioned in the cartridge housing 372 such that the cartridge inlet 382 is in communication with the inner bore 378. The cartridge inlet 382 is positioned at an axial location in the cartridge housing 372 such that when the cartridge housing 372 is received in the large chamber 312 of the dual shutoff valve 329, the cartridge inlet 382 can be aligned with the inlet port 316 of valve 329 (shown in FIG. 16).

The actuator 376 is secured to the cartridge housing 372, closing off a second end of the inner bore 378. The choke trim 337 is an elongated member having a free first end 375 and a second end operably coupled to the actuator 376. In a sample embodiment, the first end 375 may be frustoconically-shaped and, in further sample embodiments, the inner surface of the first end 377 may be matingly frustoconically-shaped in relation to the first end 375. The choke trim 337 extends axially and is positioned substantially concentrically in the inner bore 378. By selectively adjusting the position of the choke trim 337 relative to the cartridge housing 372, and more specifically, the position of the first end 375 relative to the choke orifice 338, the size of the flow path between the cartridge inlet 382 and the choke orifice 338 can be modified to, for example, apply a desired backpressure at the inlet 382. In some embodiments, the choke trim 337 can be selectively positioned to engage the choke orifice 338 to thereby restrict fluid flow through inner bore 378. The choke actuator 376 operates to actuate the choke trim 337 to effect movement thereof (i.e., to move the choke trim 337 axially) relative to the cartridge housing 372. The choke actuator 376 may actuate the choke trim 337 mechanically, for example, by engagement of a screw with a threaded interface, or electrically, hydraulically, or a combination thereof, or by other techniques known to those skilled in the art. In some embodiments, the choke actuator 376 may comprise a motor that may be operated remotely and may be configured to allow automation of (at least a part of) the actuation of the choke trim 337.

In some embodiments, the outer surface of the cartridge housing 372 has an annular groove 384 defined thereon. The annular groove 384 may be configured to matingly receive and engage the bracket 342 of the choke housing 325 (best shown in FIG. 15A) such that axial movement of the choke cartridge 326 is restricted when the choke cartridge 326 is removably supported on the bracket 342. In some embodiments, the annular groove 384 is positioned axially at or near a mid-length location of the choke cartridge 326. In some embodiments, the choke cartridge 326 has an alignment profile to facilitate alignment of the choke cartridge 326 with the choke housing 325 and/or the dual shutoff valve 329, which will be described in detail below. In further embodiments, the alignment profile of the choke cartridge 326 engages the corresponding alignment profile of the dual shutoff valve 329 to allow the choke cartridge 326 to move with the dual shutoff valve 329 when the alignment profiles are engaged with each other. In other embodiments, the alignment profile of the choke cartridge 326 is configured to engage the corresponding alignment profile of the choke housing 325. In the illustrated embodiment, the alignment profile of the choke cartridge 326 comprises a raised tab 386 on the outer surface of the cartridge housing 372 that extends along an axial and a circumferential portion of the cartridge housing 372. In some embodiments, one end of the tab 386 is adjacent to the groove 384 axially. In some embodiments, the other end of the tab 386 has a radially outwardly extending lip 388. Tab 386 is configured to be matingly receivable in the recess 315 of the dual shutoff valve 329 (shown in FIG. 16). In some embodiments, when the cartridge housing 372 is received in the large chamber 312 (shown in FIG. 16) with the alignment profiles engaged, the cartridge inlet 382 is aligned with the inlet port 316 of the dual shutoff valve 329. In other embodiments, the alignment profiles may comprise interlocking splines, keyway, pin, mating flats, etc. The above describes one configuration of the choke cartridge and, as a skilled person in the art can appreciate, other configurations of the choke cartridge are possible.

With reference to FIGS. 14 to 17, to install the choke cartridge 326 into the choke housing 325, telescoping arm 340 of the installation mechanism 328 is fully extended and then the choke cartridge 326 is placed on to the bracket 342 with the choke orifice 338 facing the opening of the dual shutoff valve 329 at the first end 311*a* and at least a portion of the bracket 342 being received in a bottom portion of the annular groove 384. When the cartridge 326 is supported on the bracket 342 in this manner, the cartridge 326 is substantially parallel to and coaxial with the dual shutoff valve 329. In some embodiments, if not already aligned, the choke cartridge 326 is rotated about its central longitudinal axis to azimuthally align the alignment profiles of the cartridge housing 372 and the dual shutoff valve 329 (or the choke housing 325). In the illustrated embodiment, the choke cartridge 326 is rotated until the tab 386 and the recess 315 are circumferentially aligned.

Once the alignment profiles are aligned, the installation mechanism actuator 332 is operated to actuate the installation mechanism 328 to retract the arm 340, thereby moving the choke cartridge 326 axially relative to the choke housing 325 towards the small chamber 314 to insert the cartridge housing 372 into the large chamber 312. In some embodiments, the cartridge housing 372 is inserted into the large chamber 312 until the first end 377 abuts against shoulder 317 inside the dual shutoff valve 329. The installation mechanism actuator 332 may include a sensor (e.g., a torque sensor) so that the actuator 332 can detect when the first end 377 of the cartridge housing 372 is abutting against the shoulder 317 of the valve 329 to accordingly cease actuation of the installation mechanism 328.

In some embodiments, when cartridge housing 372 is fully received in the large chamber 312 (i.e., when the first end 377 abuts against shoulder 317), tab 386 is matingly received in the recess 315 and the cartridge inlet 382 is aligned with the inlet port 316. In further embodiments, when the cartridge housing 372 is fully received in the large chamber, the choke orifice 338 is in direct fluid communication with the small chamber 314 (as shown for example in FIG. 11). In further embodiments, where the tab 386 has the lip 388 at one end, the lip 388 is received in a corresponding grove (not shown) defined on the inner surface of chamber 312 when the cartridge housing 372 is fully received in the valve 329, to help further securing the cartridge housing 372 to the valve 329. In some embodiments, the outer surface of the cartridge housing 372 is configured such that when the cartridge housing 372 is fully received in the large chamber 312, the cartridge housing 372 sealingly engages the inner surface of the chamber 312.

In some embodiments, the engagement of the alignment profiles of the cartridge housing 372 and the dual shutoff valve 329 (i.e., tab 386 and recess 315, respectively) rotationally locks the choke cartridge 326 with the dual shutoff valve 329 such that cartridge 326 remains substantially stationary relative to the valve 329 so that inlet port 316 and cartridge inlet 382 are always aligned. For example, when the dual shutoff valve 329 is rotated about its longitudinal axis by the actuator 330 relative to the choke housing 325, the choke cartridge 326 correspondingly rotates with the valve 329 and experiences substantially the same amount of rotation as the valve 329 relative to the choke housing 325. In further embodiments, the engagement of the bracket 342 with the groove 384 allows the choke cartridge 326 to rotate freely while restricting the axial and lateral movement of the cartridge 326. In other embodiments where the alignment profile of the cartridge housing 372 engages the alignment profile of the choke housing 325, rather than the dual shutoff valve, the choke cartridge 326 is rotationally locked to the choke housing 325 so that cartridge 326 remains substantially stationary relative to the choke housing 325, whereby the choke inlet 306 is always at about the same axial and azimuthal position as the cartridge inlet 382, regardless of the position of the dual shutoff valve 329.

When the choke cartridge 326 is installed in the choke housing 325 as described above, the dual shutoff valve 329 is situated between the choke cartridge 326 and the choke housing 325 and such a configuration may help minimize the overall size of the choke assembly 336*a*. Once the choke cartridge 326 is installed, the dual shutoff valve 329 can be actuated to control communication between the choke inlet 306 and inner bore 378 of the cartridge housing 372 and between the small chamber 314 and the choke outlet 308. The choke trim 337, the inner bore 378, the choke orifice 338, the small chamber 314 may be collectively referred to as a choke. When the dual shutoff valve 329 is in the open position, as shown for example in FIG. 11, the inlet port 316 and the cartridge inlet 382 are aligned with the choke inlet 306, and the outlet port 318 is aligned with choke outlet 308, thereby allowing communication between inlet 306 and outlet 308 via the inner bore 378, choke orifice 338, and small chamber 314, consecutively. When the dual shutoff valve 329 is in the closed position, the inlet port 316 and the cartridge inlet 382 are misaligned with the choke inlet 306, and the outlet port 318 is also misaligned with choke outlet 308, such that the wall of the valve 329 blocks the inlet 306 and outlet 308, thereby restricting communication between the inlet 306 and outlet 308. In the illustrated embodiment, when valve 329 is in the open position, the inlets 306,382, outlet 308, and outlet port 318 are "open"; when valve 329 is in the closed position, inlets 306,382, outlet 308, and outlet port 318 are "closed". Accordingly, dual shutoff valve 329 may be configured to simultaneously open the inlets 306,382, outlet 308, and outlet port 318, and simultaneously close the inlets 306,382, outlet 308, and outlet port 318.

In some embodiments, actuator 330 may actuate valve 329 by rotating the valve, clockwise or counterclockwise, about the valve's central longitudinal axis relative to the choke housing 325 by a predetermined angle to transition the valve 329 from one position to another, which may depend on the position and diameter of one or more of inlet 306, inlet port 316, cartridge inlet 382, outlet port 318, and outlet 308. In some embodiments, to place the valve 329 in the open position, actuator 330 rotates the valve 329 until inlet port 316 and cartridge inlet 382 are aligned with the choke inlet 306, and outlet port 318 is aligned with choke outlet 308. To place the valve 329 in the closed position, actuator 330 rotates the valve 329 until inlet 306 and outlet 308 are both blocked by the wall of the valve 329. In further embodiments, sensors (such as pressure sensors or actuator encoders) may be included in the PMD 322 to determine when the inlet 306 (or outlet 308) is closed (or open) in order to assist actuator 330 in transitioning the valve 329. Accordingly, actuator 330 is configured to move the valve 329 while the valve 329 is in between the open and closed positions and to stop moving the valve 329 once it is determined that the valve 329 is in the desired position.

In other embodiments, the dual shutoff valve 329 may be omitted from the PMD 322 and fluid flow through the choke cartridge 326 may be controlled by adjusting the position of the choke trim 337 relative to the choke orifice 338. For example, fluid flow through the choke cartridge 326 can be restricted by engaging the choke trim 337 with the choke orifice 338, to block the choke orifice; and fluid flow through the choke cartridge 326 is permitted by moving the choke trim 337 away from the choke orifice 338. As a skilled person can appreciate, other ways of controlling fluid flow through the choke cartridge or opening and closing the choke inlet 306 and choke outlet 308 are possible without using dual shutoff valve 329.

To uninstall the choke cartridge 326 from the choke housing 325, the installation mechanism actuator 332 is operated to actuate the installation mechanism 328 to extend the arm 340, thereby moving the choke cartridge 326 axially relative to the choke housing 325 away from the small chamber 314 to remove the cartridge housing 372 from the large chamber 312. The arm 340 is extended at least until there is sufficient clearance to fully remove the choke cartridge 326 from the large chamber 312 and the bracket 342. In some embodiments, the dual shutoff valve 329 is placed in the closed position prior to actuating the installation mechanism 328 to uninstall the choke cartridge 326. In the closed position, the dual shutoff valve 329 operates to fluidly isolate the choke cartridge 326 from the other components of the PMD 322. The installation mechanism actuator 332 may include a sensor or other mechanisms known in the art to detect when the arm 340 is sufficiently extended to accordingly cease actuation of the installation mechanism 328. Once the arm 340 is sufficiently extended, the choke cartridge 326 can be lifted out of the bracket 342. A replacement choke cartridge (not shown) may then be installed in the choke housing, as described above. In contrast with the replacement of a choke in the conventional MPD manifold, which requires unbolting of the choke and lifting of the choke by a crane, the choke housing 325 and the choke cartridge 326 configured as described above allows the choke cartridge 326 to be easily removed and replaced, for example when choke cartridge 326 requires repair or maintenance.

FIG. 18 shows a sample embodiment of the directional valve assembly 347 of the PMD 322. In the illustrated embodiment, the directional valve assembly 347 has a directional valve housing 390, a directional valve 327 operably positioned in the housing 390, and a directional valve actuator 394 operably coupled to the valve 327. The directional valve housing 390 may comprise one or more flow blocks and has defined therein a number of flow paths. For example, as shown in FIG. 18, the directional valve housing 390 has a first end 391*a*, a second end 391*b*, an inner bore 396 that extends from a directional valve inlet 395 at the first end 391*a* and to an outlet 350 at the second end 391*b*, a first choke outlet passage 398*a*, and a second choke outlet passage 398*b*. Both the first and second choke outlet passages 398*a*,398*b* intersect the inner bore 396 and are both in communication with the outlet 350 via the inner bore 396. In the illustrated embodiment, the first and second choke outlet passages 398*a*,398*b* extend laterally from the inner bore 396 and open to a first side 393*a* and a second side 393*b*, respectively, of the housing 390. In some embodiments, PMD 322 is configured such that the directional valve housing 390 is integrated with or is part of the PMD housing 331.

The directional valve 327 is configured to control fluid flow through the inner bore 396. In the illustrated embodiment, the directional valve 327 is positioned in the housing 390, in between the directional valve inlet 395 and the intersection of the first and second choke outlet passages 398*a*,398*b* and the inner bore 396. The directional valve 327 is in communication with the inner bore 396 and is actuable between a bypass position and a choke position. In the bypass position, as shown for example in FIGS. 18C and 18D, the directional valve 327 permits fluid communication between the directional valve inlet 395 and the outlet 350 via the inner bore 396. In the choke position, as shown for example in FIGS. 11 and 13, the directional valve 327 restricts fluid communication between the directional valve inlet 395 and the outlet 350, for example, by blocking an axial section of the inner bore 396. When the directional valve 327 is in the bypass position, the directional valve 327 and the inner bore 396 are "open". When the directional valve 327 is in the choke position, the directional valve 327 and the inner bore 396 are "closed". The directional valve 327 may be a ball valve, a plug valve, a gate valve, or a combination thereof, or any other valve known to those skilled in the art.

The directional valve actuator 394 operates to actuate the directional valve 327 to effect movement thereof (e.g. rotation) relative to the housing 390 to transition the directional valve 327 between the bypass position and the choke position. The directional valve actuator 394 may actuate the directional valve 327 mechanically, for example, by gears, or electrically, hydraulically, or a combination thereof, or by other techniques known to those skilled in the art. In some embodiments, the directional valve actuator 394 may comprise a motor that may be operated remotely and may be configured to allow automation of (at least a part of) the actuation of the directional valve 327.

Referring back to FIGS. 8 to 13, each of the PMD housing 331, the first choke assembly 336*a*, the second choke assembly 336*b*, and the directional valve assembly 347 is a module of the PMD 322, and the modules of the PMD 322 can be transported separately to a wellsite. The modular configuration of the PMD 322 allows the PMD 322 to be assembled and connected to the BOP stack at the wellsite, where space is usually scarce. To assemble the PMD 322, each module is releasably connected to at least one other module by, for example, fasteners or other techniques known to those skilled in the art. In the illustrated embodiment, the first and second choke assemblies 336*a*,336*b* are connected to the PMD housing 331, at opposite sides, at the first and second choke inlet passages 366*a*,366*b*, respectively. In some embodiments, each of the first and second choke assemblies 336*a*,336*b* may have a respective annular extension 323 on its outer surface 302 positioned at the choke inlet 306 (shown for example in FIGS. 9 and 15C) for insertion into the corresponding first and second choke inlet passages 366*a*,366*b* to facilitate alignment of the inlet 306 with the inlet passages 366*a*,366*b*. The annular extension 323 may be configured to sealingly engage the inlet passages 366*a*,366*b* when the choke assemblies 336*a*,336*b* are securely attached to the PMD housing 331. The choke cartridges 326 may be installed in the respective choke housings 325 of the choke assemblies 336*a*,336*b* either before or after the choke assemblies 336*a*,336*b* are attached to the PMD housing 331.

In the illustrated embodiment, the directional valve assembly 347 is connected to the PMD housing 331 at the valve inlet passage 362. In some embodiments, the directional valve assembly 347 has an annular extension 397 at its first end 391*a* coinciding with directional valve inlet 395 (shown for example in FIGS. 18C and 18D) for insertion into the valve inlet passage 362 to facilitate alignment of the directional valve inlet 395 with the valve inlet passage 362. The annular extension 397 may be configured to sealingly engage the valve inlet passage 362 when the directional valve assembly 347 is securely attached to the PMD housing 331. In the illustrated embodiment, as best shown in FIGS. 8 and 11, the first and second choke assemblies 336*a*,336*b* are connected to the directional valve assembly 347 at the first and second sides 393*a*,393*b*, respectively, such that the choke outlets 308 of the choke assemblies 336*a*,336*b* are aligned with the first and second choke outlet passages 398*a*,398*b*, respectively.

Figure 11:
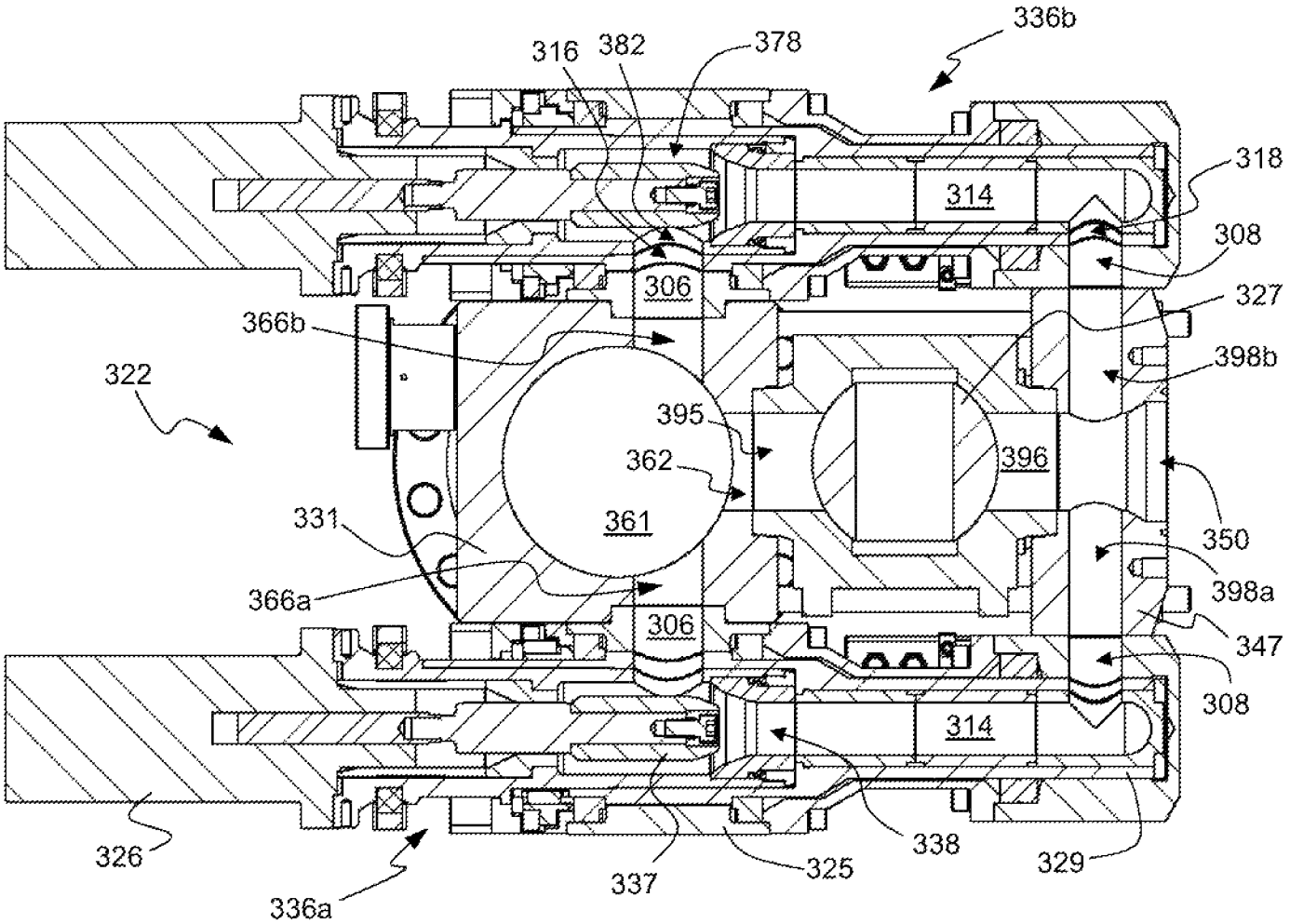
FIG. 11 is a cross-sectional view of the pressure management device of FIG. 10, taken along line A-A.
Figure 12:
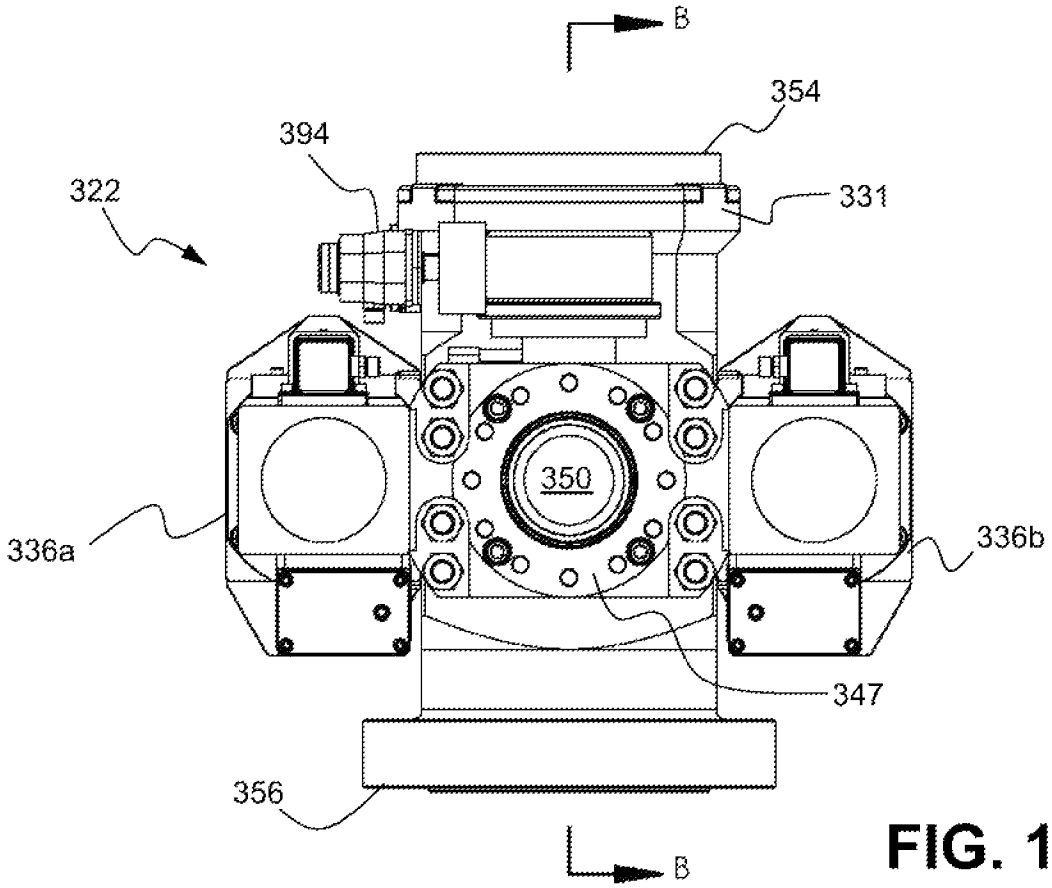
FIG. 12 is a second side plan view of the pressure management device of FIG. 10.
Figure 13:
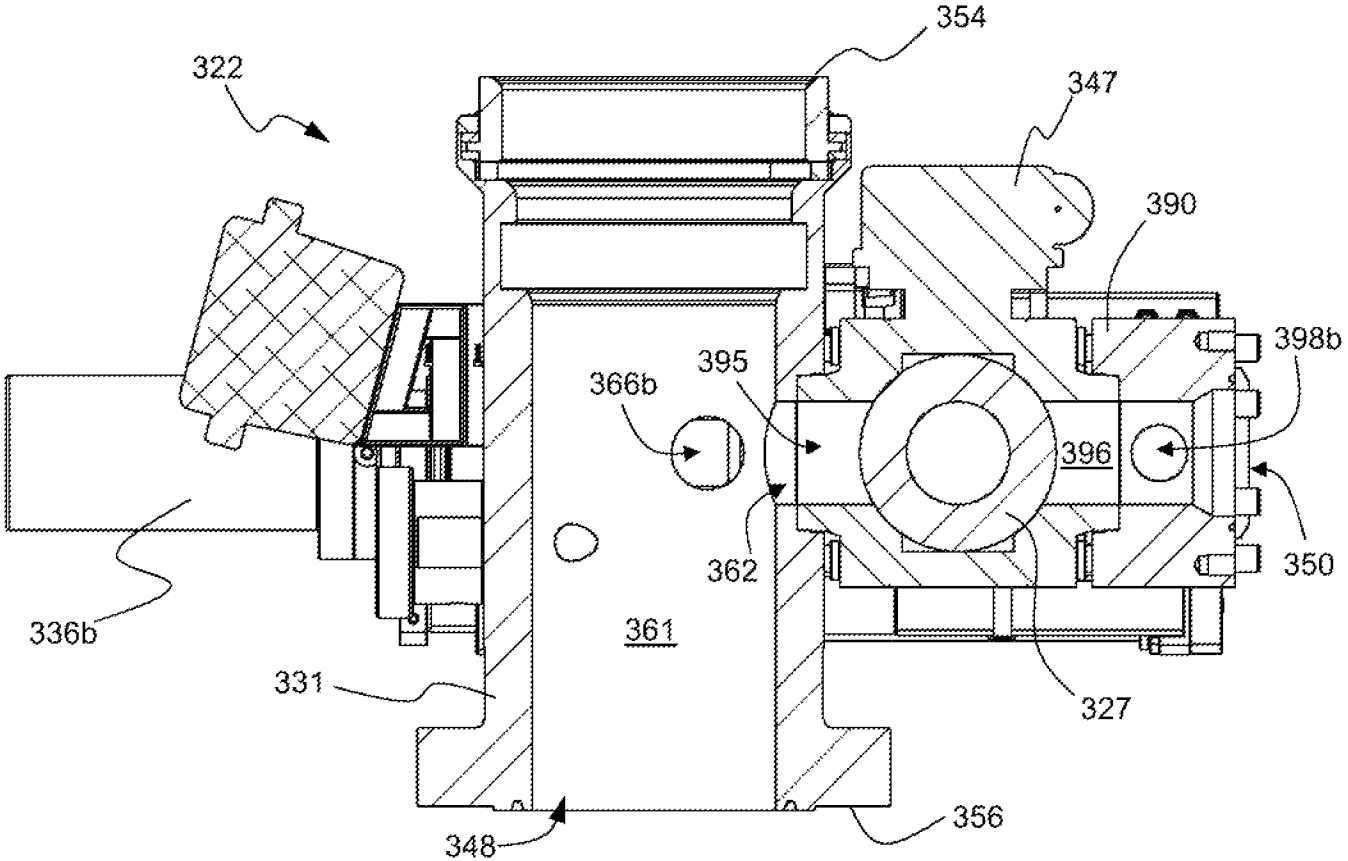
FIG. 13 is a cross-sectional view of the pressure management device of FIG. 12, taken along line-B-B
Figure 14A:
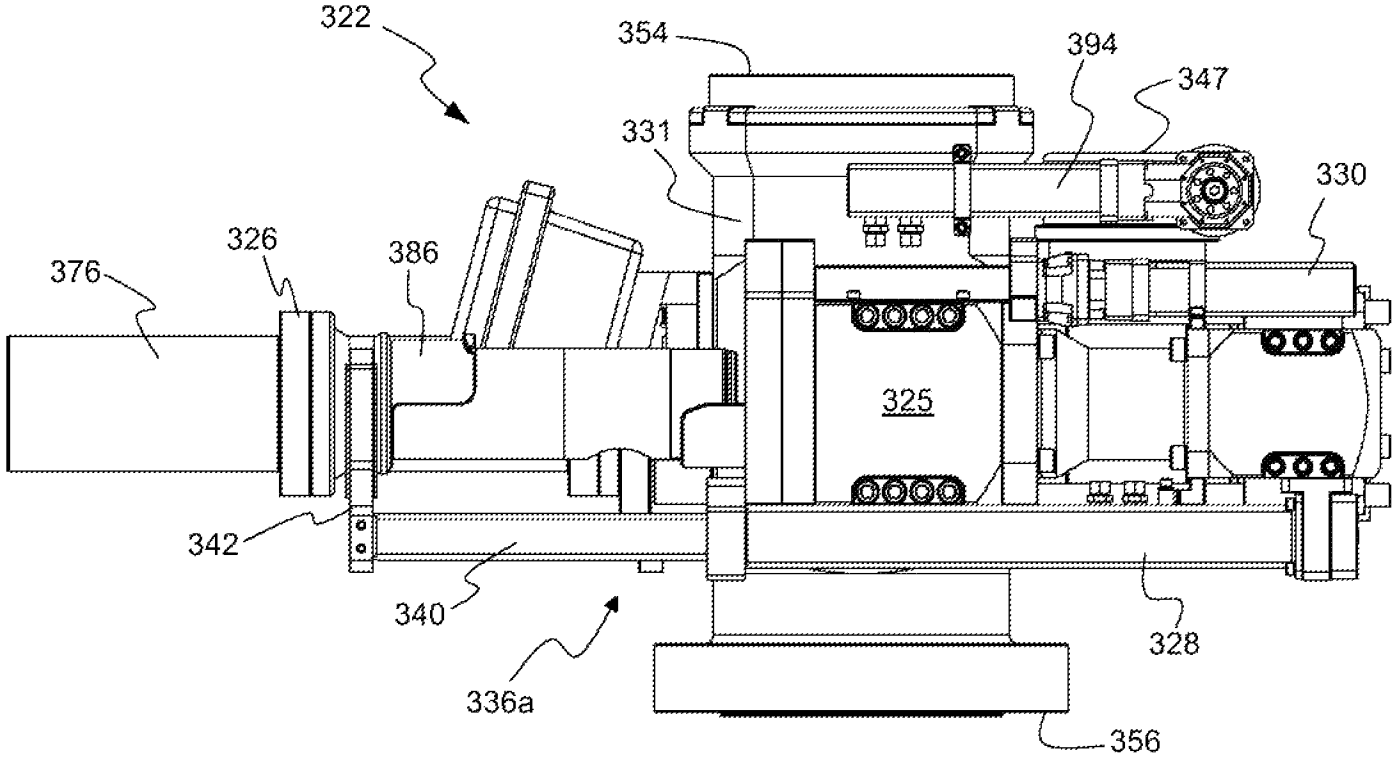
FIG. 14A is an alternate first side plan view of the pressure management device of FIG. 10, shown with one choke cartridge uninstalled from its corresponding choke housing.
Figure 14B:
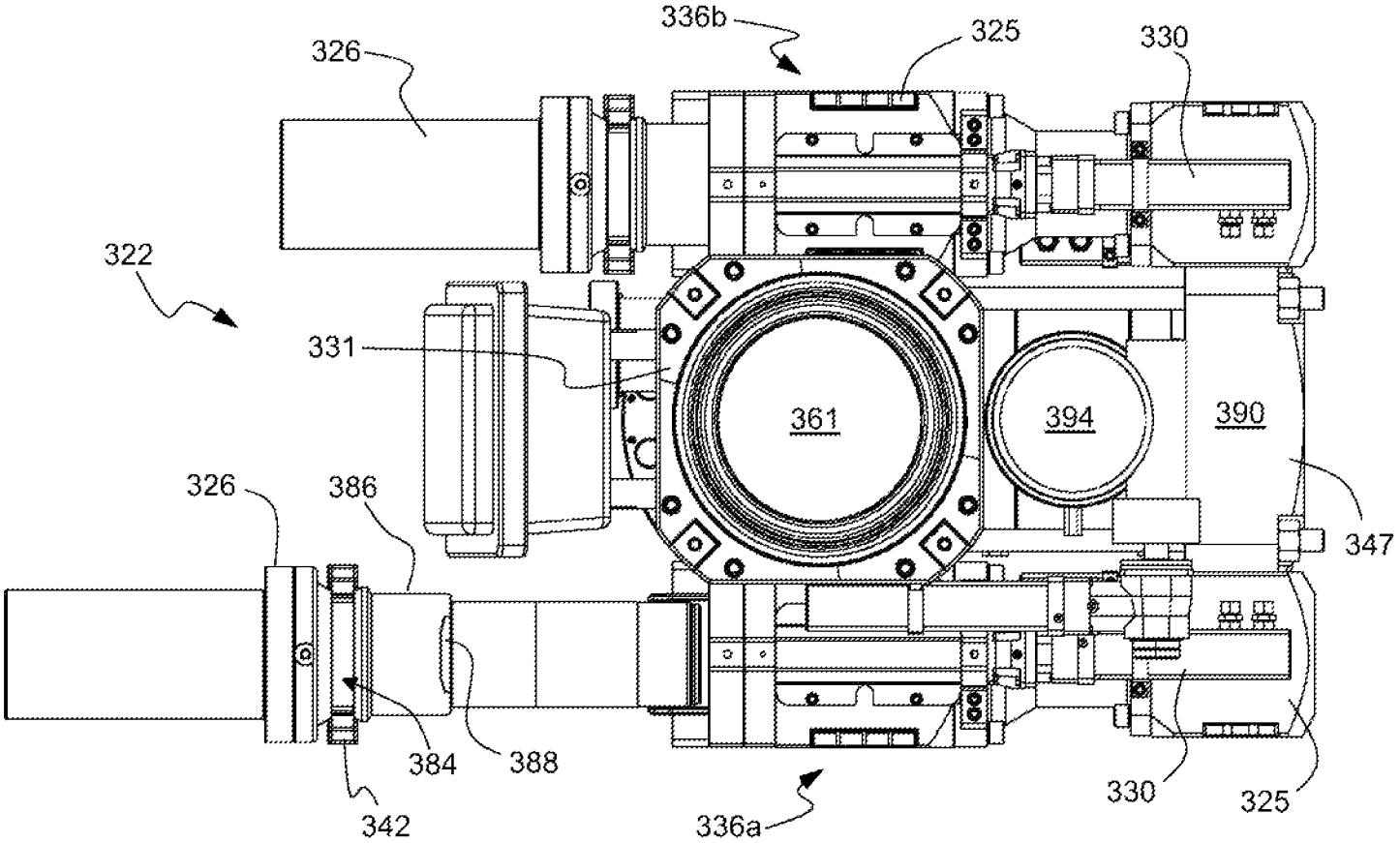
FIG. 14B is a top plan view of the pressure management device of FIG. 14A.

In the assembled PMD 322, as best shown in FIG. 11, the inner bore 361 of PMD housing 331 is in fluid communication with the choke inlet 306 of the first and second choke assemblies 336*a*,336*b* via choke inlet passages 366*a*,366*b*, respectively. The inner bore 361 is also in fluid communication with the directional valve inlet 395 of the directional valve assembly 347 via the valve inlet passage 362. The first choke outlet passage 398*a* of the directional valve assembly 347 is in fluid communication with the choke outlet 308 of the first choke assembly 336*a*. The second choke outlet passage 398*b* of the directional valve assembly 347 is in fluid communication with the choke outlet 308 of the second choke assembly 336*b*. The outlet 350 of the directional valve assembly 347 serves as the outlet of the PMD 322. With reference to FIGS. 11 and 13, the inner bore 361, the valve inlet passage 362, the inner bore 396, together, provide a choke gut line between inlet 348 and outlet 350. When the directional valve 327 is in the choke position, the choke get line between inlet 348 and outlet 350 is blocked by the directional valve 327 and may be referred to as "closed". When the directional valve 327 is in the bypass position, the choke get line between inlet 348 and outlet 350 is unblocked and may be referred to as "open".

As can be appreciated, configurations of PMD 322 other than the one shown in the figures are possible. For example, the PMD can be modified to include additional chokes. While the choke assemblies 336*a*,336*b* are shown to be positioned in substantially the same horizontal plane, on opposing sides of the PMD housing 331 (i.e., about 180° apart), choke assemblies 336*a*,336*b* may be spaced apart axially relative to one another and/or spaced apart azimuthally with an angle of about 0° to about 180° relative to one another in other embodiments and the directional valve assembly 347 may be otherwise configured to fluidly connect with the choke outlets 308 of the choke assemblies 336*a*,336*b*.

Figure 8:
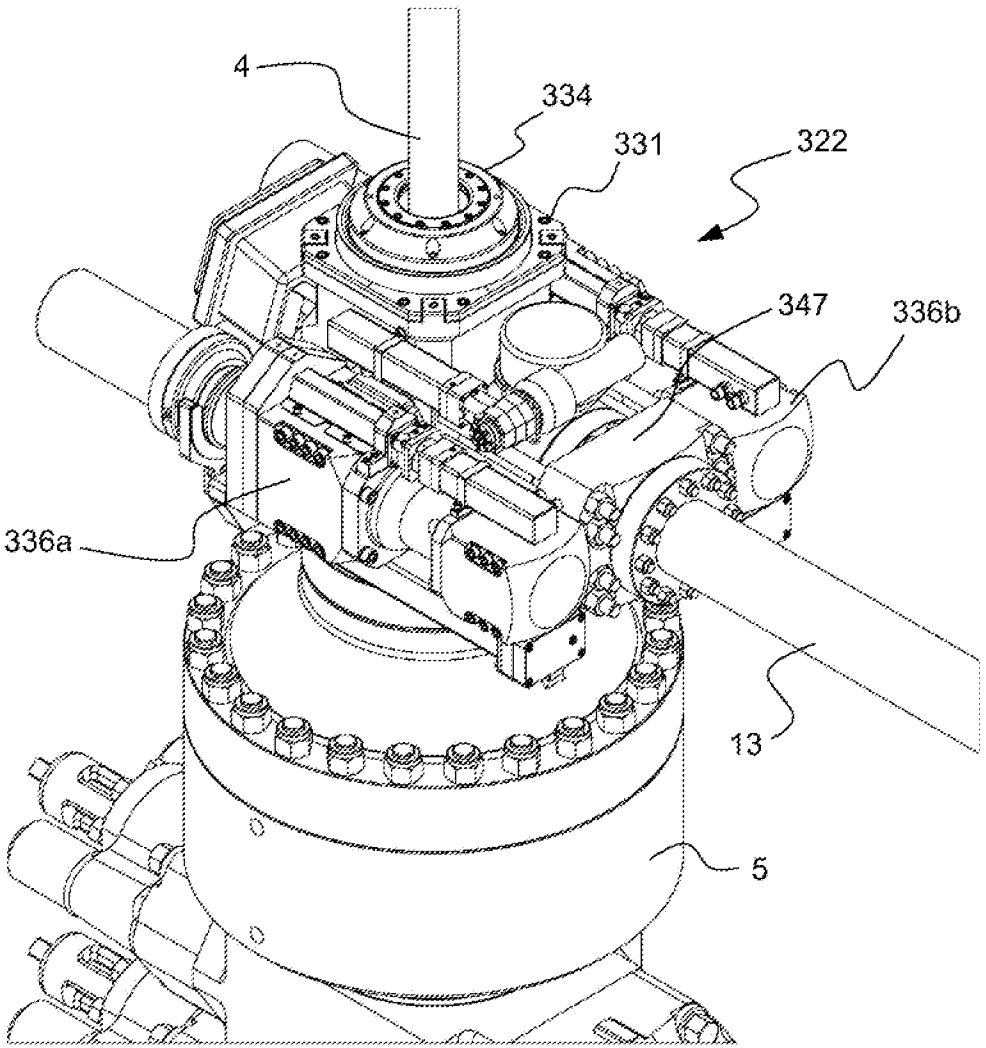
FIG. 8 is a perspective view of a sample embodiment of the pressure management device of FIG. 6, according to one embodiment of the present disclosure.
Figure 9:
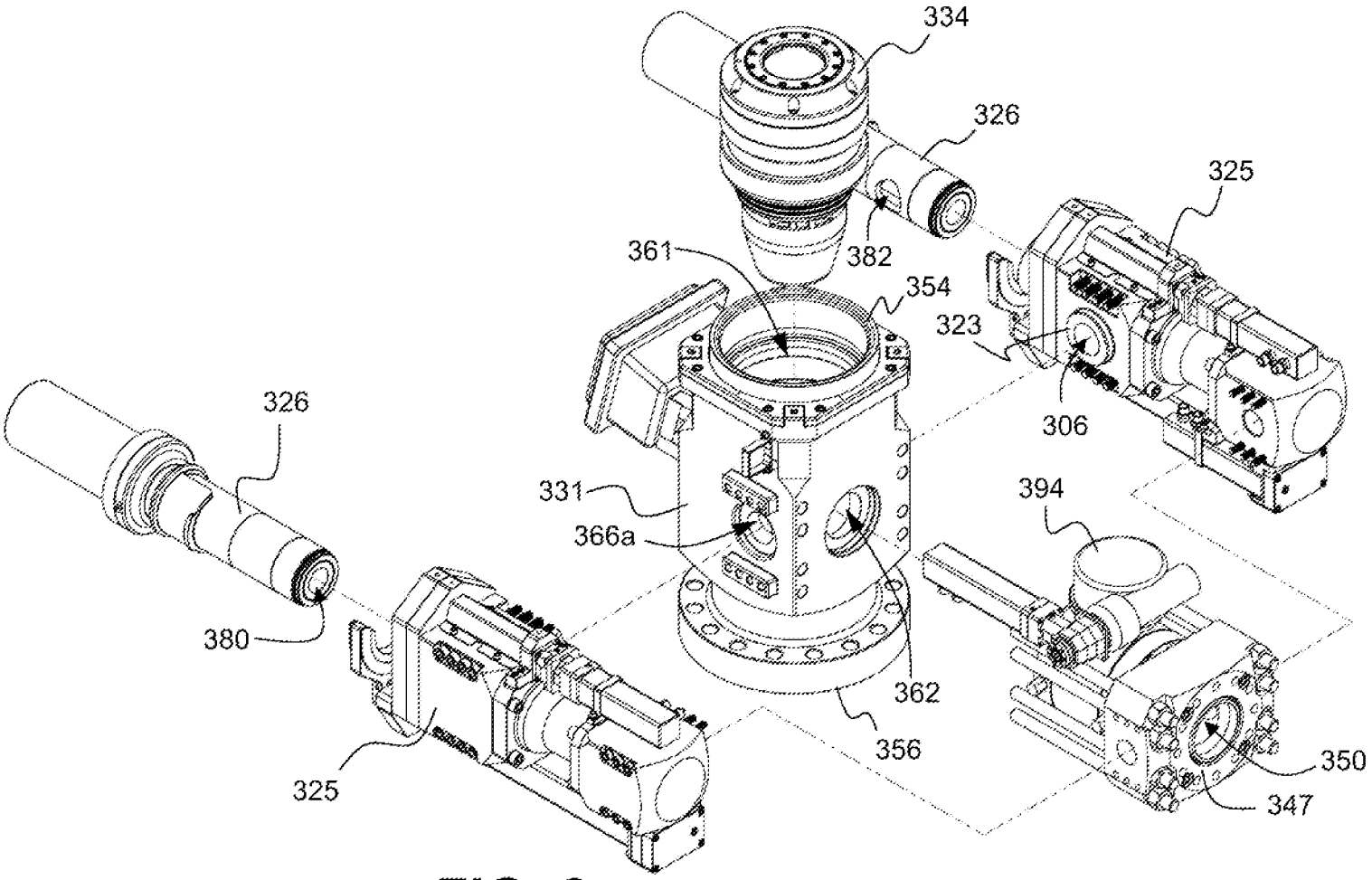
FIG. 9 is an exploded perspective view of the pressure management device of FIG. 8, shown in isolation from other components of the drilling system.
Figure 10:
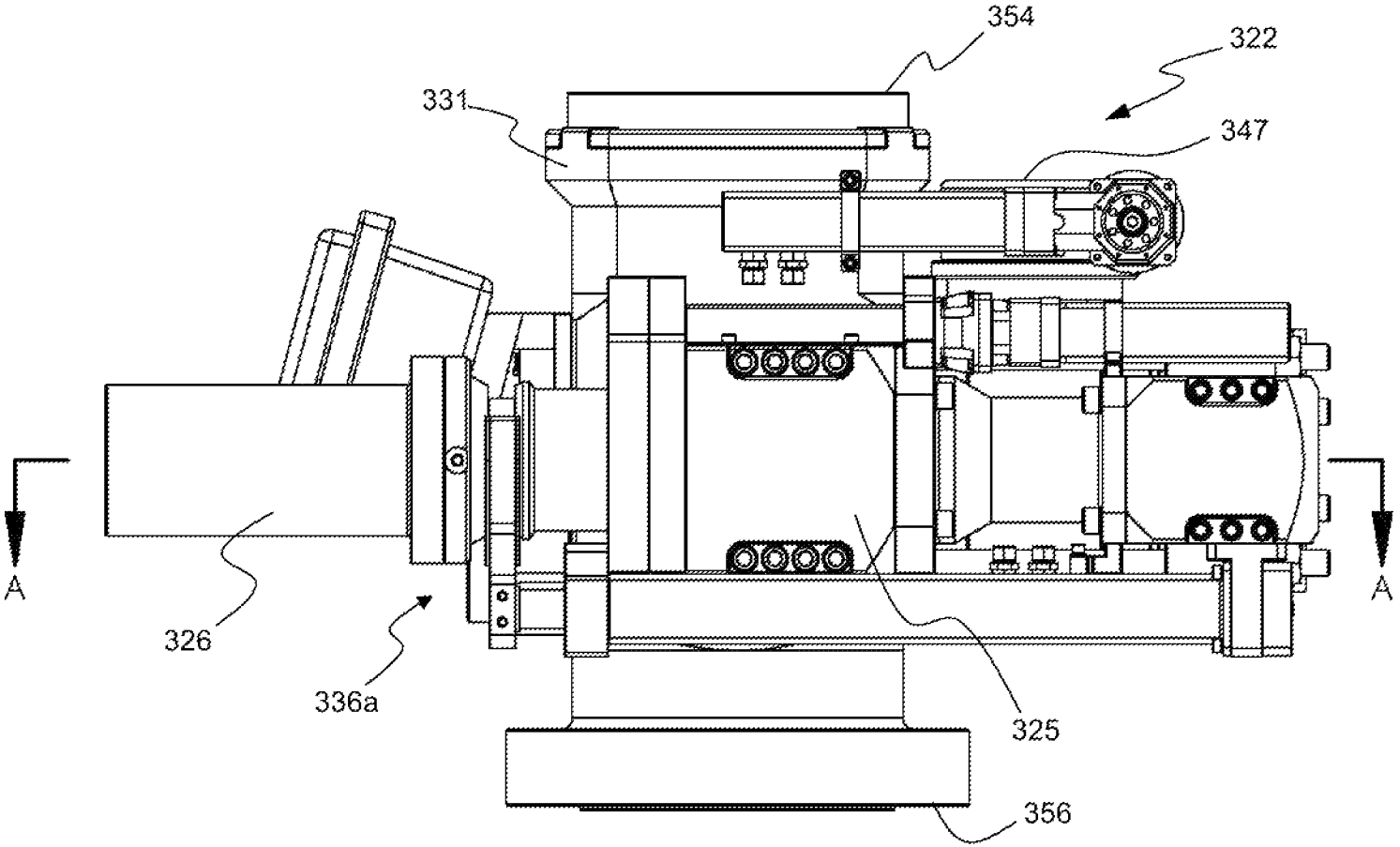
FIG. 10 is a first side plan view of the pressure management device of FIG. 8, shown without a bearing assembly and in isolation from other components of the drilling system.

In some embodiments, with reference to FIGS. 3, 4, and 8, to connect PMD 322 to the drilling system 200, the PMD housing 331 is connected, at its second end 356, directly to the BOP stack 5 such that the inlet 348 of the PMD housing (shown in FIG. 13) is in fluid communication with the wellbore 1 via the BOP stack 5. A segment of the drill string 4 extends axially through the inner bore 361 of the PMD housing 331. In some embodiments, the PMD 322 comprises a bearing assembly 334 that is received, at least in part, in the inner bore 361 of the PMD housing 331 and releasably secured to the PMD housing 331 by any technique known in the art, for sealingly engaging the drill string 4. The outlet 350 of the directional valve assembly 347 is fluidly connected to the mud return line 13 of the drilling system 200 such that the outlet 350 is in fluid communication with the mud handling equipment 9.

With reference to FIGS. 11, 13, and 19, when the PMD 322 is connected to the drilling system, the PMD 322 operates to divert fluid returning from the wellbore through different flow paths in the PMD depending on the position of the directional valve 327 of the directional valve assembly 347 and the dual shutoff valves 329 of the first and second choke assemblies 336*a*,336*b*. In some embodiments, the PMD 322 has three positions: a bypass position, a single-choke position, and a double-choke position. In operation, wellbore fluid (e.g., drilling mud) flows up the wellbore annulus, through the wellhead 102 and BOP stack 5 (FIGS. 3, 4, and 8), and enters the PMD 322 via inlet 348. From the inlet 348, the fluid enters the inner bore 361 of the PMD housing 331 and continues on to at least one of several possible flow paths depending on the position of PMD 322. The fluid then exits the PMD 322 at outlet 350 and may flow downstream to mud handling equipment 9 via mud return line 13 (shown in FIGS. 3 and 4).

Figure 19A:
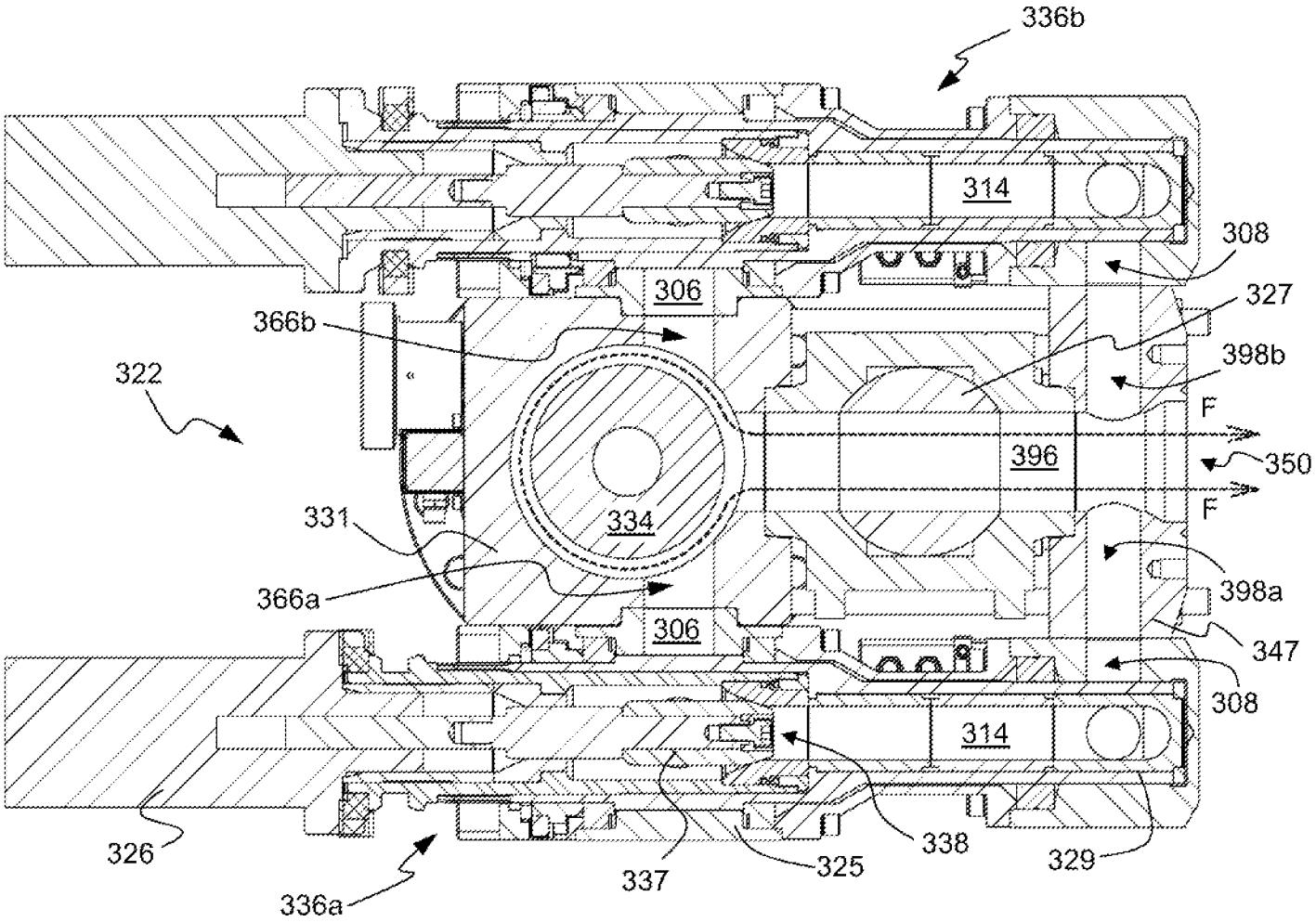
FIG. 19A is a cross-sectional view of the pressure management device of FIG. 11, shown in a bypass position.

FIG. 19A shows the PMD 322 in the bypass position, where the dual shutoff valves 329 in the both the first and second choke assemblies 336*a*,336*b* are in the closed position and where the directional valve 327 is in the bypass position such that the choke inlets and outlets 306,308 are closed and the inner bore 396 is open. When the inner bore 396 is open, the inlet 348 of the PMD 322 is in fluid communication with outlet 350, via inner bore 361, valve inlet passage 362, directional valve inlet 395 and the inner bore 396 of the directional valve assembly 347, consecutively. Accordingly, when the PMD 322 is in the bypass position, fluid entering the PMD 322 is directed to flow from the inner bore 361 to the outlet 350 via the open inner bore 396, without passing through either of the choke assemblies 336*a*,336*b*. In the figures, the flow direction of the wellbore fluid is indicated by arrows "F". The fluid exits the PMD 322 at outlet 350.

Figure 19B:
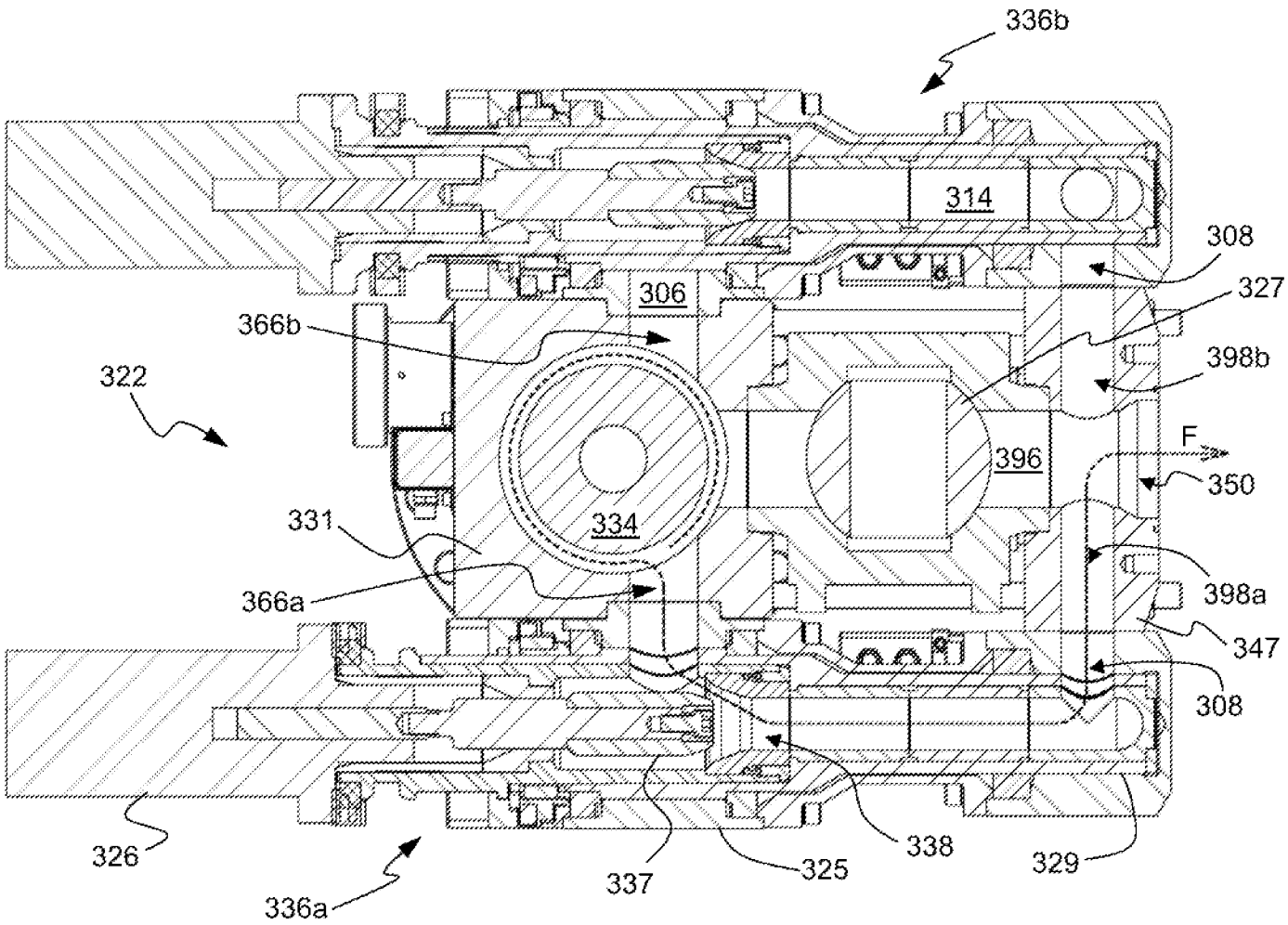
FIG. 19B is a cross-sectional view of the pressure management device of FIG. 11, shown in a single-choke position.

FIG. 19B shows the PMD 322 in the single-choke position, where the directional valve 327 is in the choke position such that the inner bore 396 is closed. In the illustrated embodiment, the dual shutoff valve 329 in the second choke assembly 336*b* is closed and the dual shutoff valve 329 in the first choke assembly 336*a* is open so that the inlet 306 and outlet 308 of the second choke assembly 336*b* are closed, while the inlet 306 and outlet 308 of the first choke assembly 336*a* are open. In this embodiment, the inlet 348 is in fluid communication with the outlet 350 of the PMD 322, via inner bore 361, first choke inlet passage 366*a*, and through the first choke assembly 336*a* via choke inlet 306, inlet port 316, cartridge inlet 382, inner bore 378, choke orifice 338, small chamber 314, outlet port 318, and choke outlet 308, consecutively, and then via first choke outlet passage 398*a*. Accordingly, when the PMD 322 is in the single-choke position as shown in FIG. 19B, fluid entering the PMD 322 is directed to flow from the inner bore 361 through the first choke assembly 336*a* and then to the outlet 350. The fluid exits the PMD 322 at outlet 350.

Although not shown, one can appreciate that the PMD 322 can be in an alternate single-choke position, where fluid is directed to flow from the inner bore 361 through the second choke assembly 336*b* and then to the outlet 350. In this alternate single-choke position, the directional valve 327 is in the choke position such that the inner bore 396 is closed; the dual shutoff valve 329 in the first choke assembly 336*a* is closed so that the inlet 306 and outlet 308 of the first choke assembly 336*b* are closed; and the dual shutoff valve 329 in the second choke assembly 336*b* is open so that the inlet 306 and outlet 308 of the second choke assembly 336*a* are open, thereby allowing fluid to flow from the inner bore 361 to the outlet 350 through the second choke assembly 336*b*.

Figure 19C:
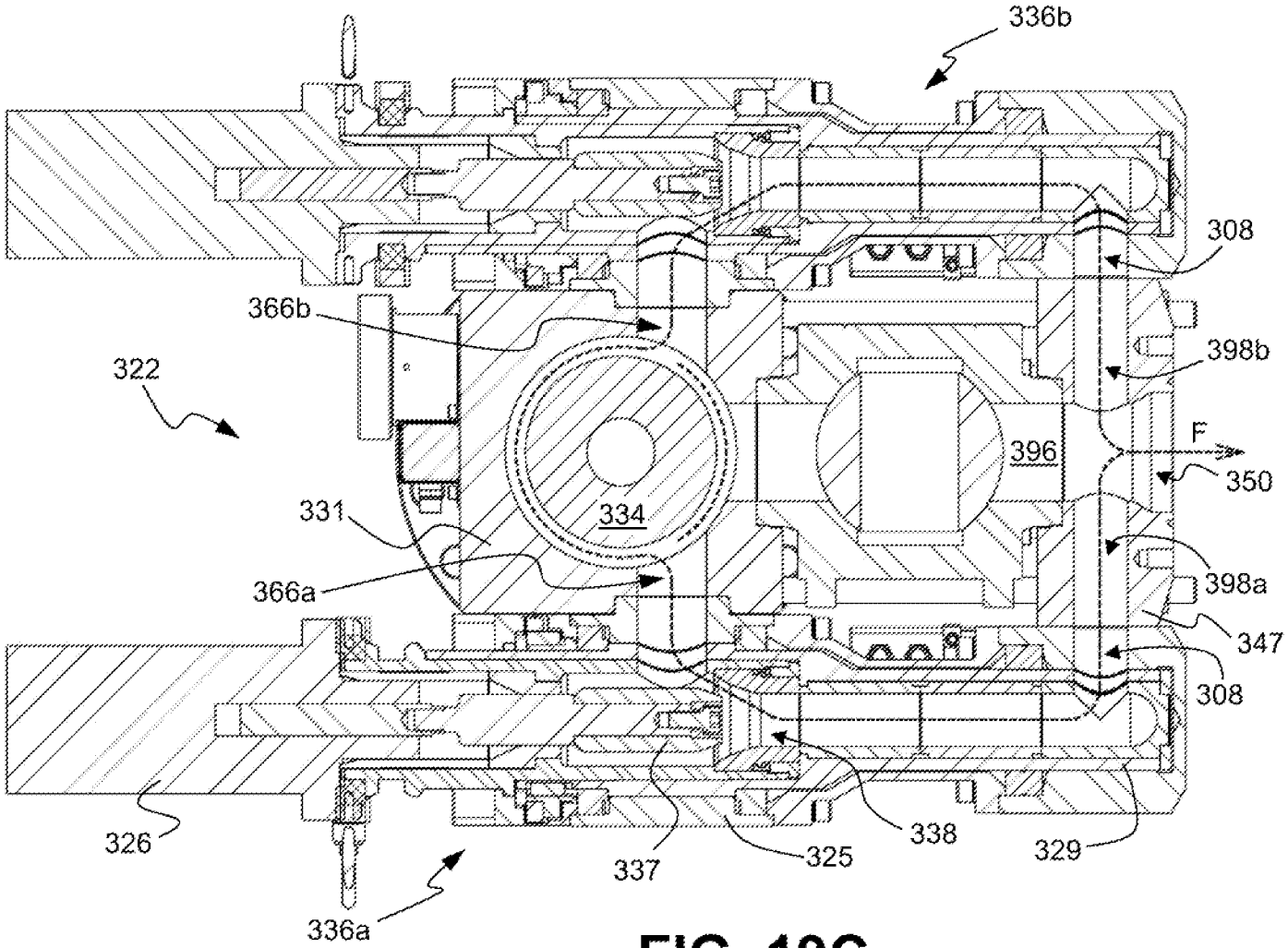
FIG. 19C is a cross-sectional view of the pressure management device of FIG. 11, shown in a double-choke position.
Figure 20:
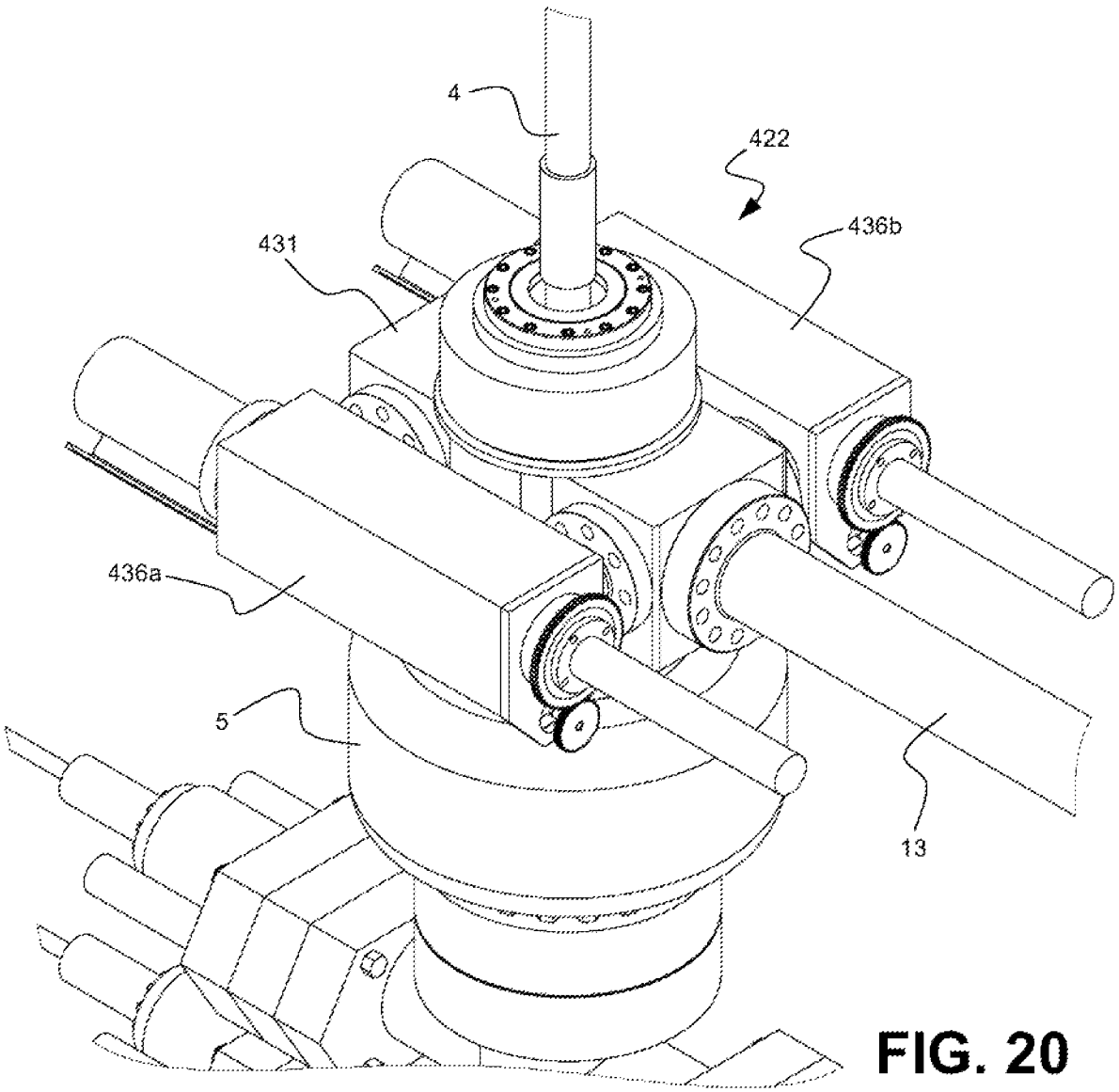
FIG. 20 is a perspective view of a sample embodiment of the pressure management device of FIG. 7, according to one embodiment of the present disclosure.

FIG. 19C shows the PMD in the double-choke position, where the directional valve 327 is in the choke position such that the inner bore 396 is closed. In the illustrated embodiment, the dual shutoff valves 329 in both the first and second choke assemblies 336*a*,336*b* are open so that the inlets 306 and outlets 308 of the first and second choke assemblies 336*a*,336*b* are open. In this embodiment, the inlet 348 is in fluid communication with the outlet 350 of the PMD 322, via inner bore 361, first and second choke inlet passages 366*a*,366*b*, and through both the first and second choke assemblies 336*a*,336*b* via choke inlet 306, inlet port 316, cartridge inlet 382, inner bore 378, choke orifice 338, small chamber 314, outlet port 318, and choke outlet 308, consecutively, and then via both the first and second choke outlet passages 398*a*,398*b*. The fluid exits the PMD 322 at outlet 350. Accordingly, when the PMD 322 is in the double-choke position as shown in FIG. 19C, fluid entering the PMD 322 is directed to flow from the inner bore 361 through both the first and second choke assemblies 336*a*, 336*b* and then to the outlet 350, thereby allowing both choke assemblies to operate simultaneously.

In some embodiments, when switching to and from the bypass position of the PMD 322, the corresponding opening and closing of the directional valve 327 and one or more of the dual shutoff valves 329 may be performed by the same actuator or otherwise synchronized such that the valve inlet passage 362 and at least one of the choke inlet passages 366*a*,366*b* are not fully blocked during the transition between the single-choke or double-choke position and the bypass position. Synchronizing the opening and closing of the directional valve 327 and one or more of the dual shutoff valves 329 may provide a smoother transition between the valve positions, which may be beneficial in preventing sudden spikes or drops in fluid pressure in the wellbore as the directional valve 327 redirects fluid flow in the PMD 322.

FIGS. 20 to 23 show a sample configuration of PMD 122 of FIG. 7 according to one embodiment of the present disclosure. In the illustrated embodiment shown in FIGS. 20 to 23, a PMD 422 comprises a PMD housing 431 operably coupled to one or more choke assemblies 436*a*,436*b*, each having a respective choke housing 425, and a respective dual shutoff valve 429 and a respective choke cartridge 426 supported in the respective choke housing 425. While the illustrated embodiment shows two choke assemblies 436*a*, 436*b*, it can be appreciated that the PMD 422 may comprise fewer or more choke assemblies. While PMD 422 may operate with only one choke cartridge 426, additional choke cartridges may be included for redundancy.

Figure 22:
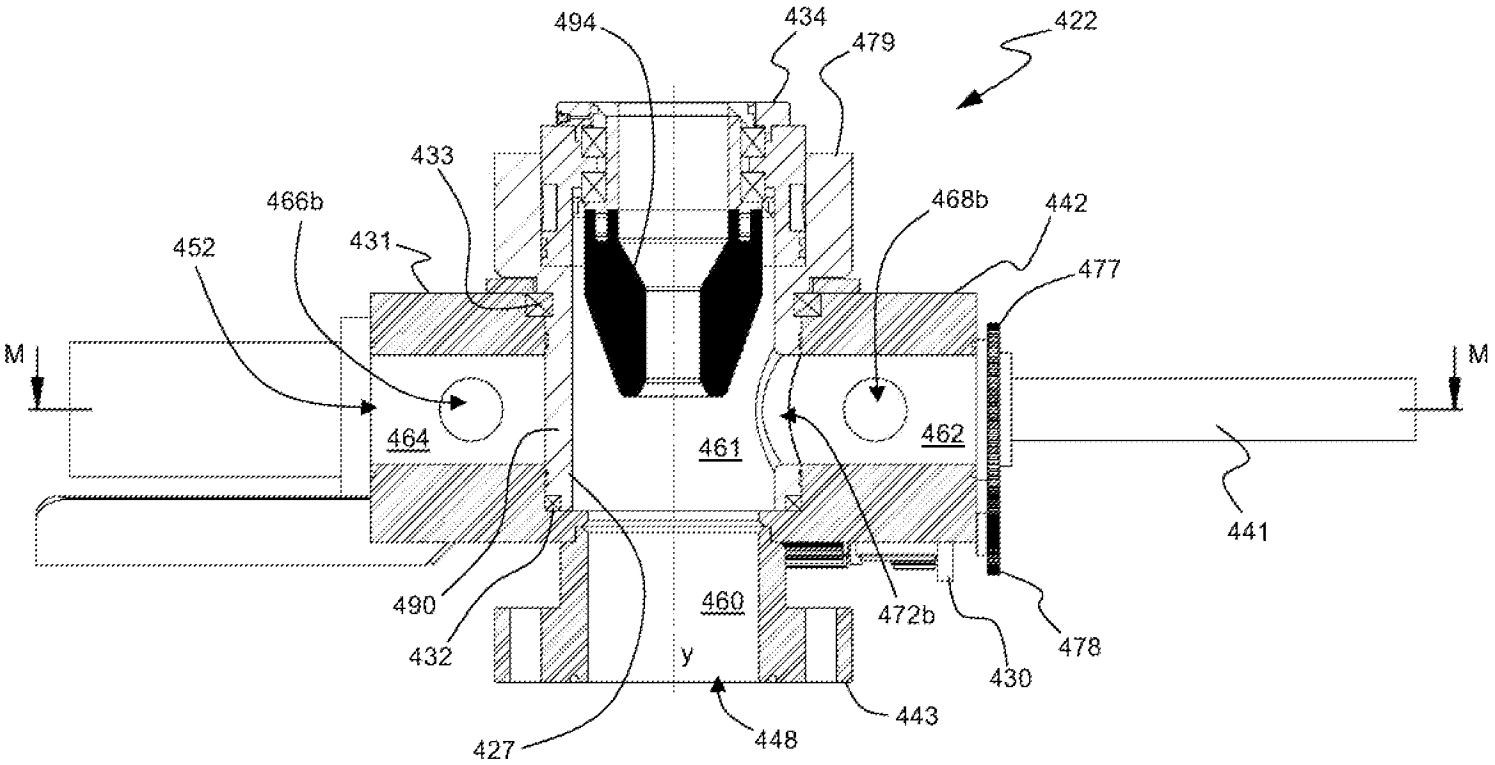
FIG. 22 is a cross-sectional view of the pressure management device of FIG. 21, taken along line K-K.
Figure 23:
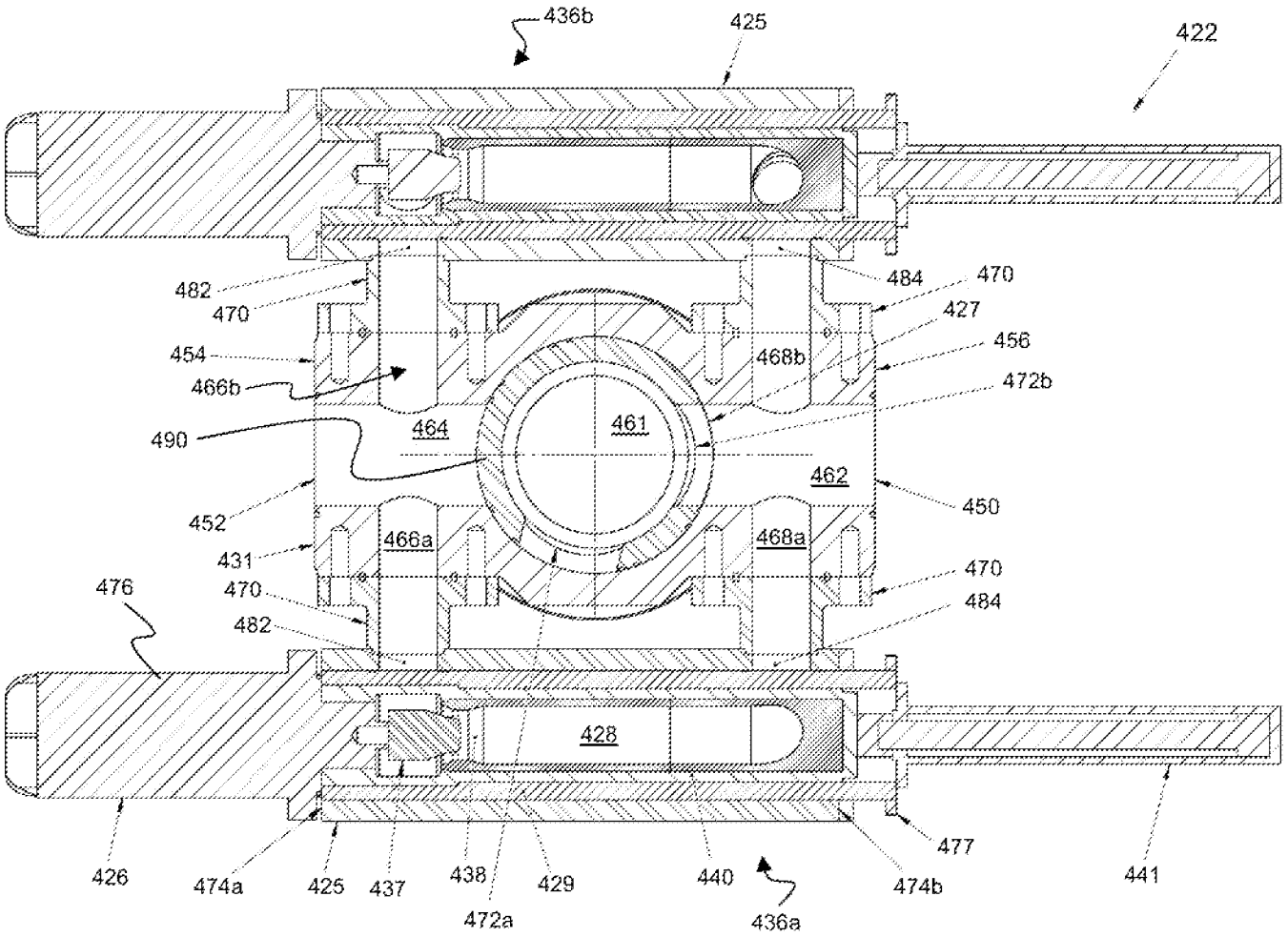
FIG. 23 is a cross-sectional view of the pressure management device of FIG. 22, taken along line M-M.

FIGS. 22 and 23 illustrate a sample PMD housing 431 in which at least a portion of a directional valve 427 is supported. PMD housing 431 is configured to provide a number of flow paths therethrough. PMD housing 431 has a first end 442, a second end 443, a first side 454, and a second side 456. In the illustrated embodiment, outlet 450 is an opening at the second side 456 of the PMD housing 431. In some embodiments, PMD housing 431 may optionally have an opening at the first side 454 to provide the diverted pump flow inlet 452. In other embodiments, the first side 454 of PMD housing 431 is closed. PMD housing 431 has defined therein an inner bore 460 extending between the first and second ends 442,443 and the opening of the inner bore 460 at the second end 443 defines an inlet 448. The inner bore 460 is configured to receive fluid from the wellbore annulus via the wellhead 102 (shown in FIGS. 3 and 4), the BOP stack 5 (shown in FIG. 20), and inlet 448, consecutively. In some embodiments, the PMD housing 431 is configured to allow a drill string 4 (shown in FIG. 20) to extend therethrough and to rotate therein. For example, the diameter of inlet 448 and/or inner bore 460 may be sized to accommodate a portion of the drill string extending axially therethrough, such that the drill string can rotate without interference with the inner surface of the PMD housing 431.

In some embodiments, the PMD housing 431 has defined therein an outlet flow passage 462 for fluid communication with the outlet 450; and a choke flow passage 64 for selective fluid communication with the first and second choke assemblies 436*a*,436*b*, and optional fluid communication with diverted pump flow inlet 452. In the illustrated embodiment, the outlet flow passage 462 extends laterally from the inner bore 460 to the second side 456 and opens to the outlet 450. In some embodiments, the outlet flow passage 462 is substantially orthogonal to the inner bore 460. Inner bore 460 and outlet flow passage 462, together, provide a choke gut line between the inlet 448 and the outlet 450. In the illustrated embodiment, the choke flow passage 464 extends laterally from the inner bore 460 to the first side 454 and, and in optional embodiments, opens to the diverted pump flow inlet 452. In some embodiments, the choke flow passage 464 is substantially orthogonal to the inner bore 460. In further embodiments, the first side 454 may be selectively opened or closed such that diverted pump flow inlet 452 can be opened for fluid connection to a flow diverter 20 (FIG. 4) when desired.

In the illustrated embodiments, PMD housing 431 has defined therein a first choke inlet passage 466*a*, a second choke inlet passage 466*b*, a first choke outlet passage 468*a*, and a second choke outlet passage 468*b*. The first and second choke inlet passages 466*a*,466*b* intersect the choke flow passage 464 and are in fluid communication with the choke flow passage 464. In some embodiments, the first and second choke inlet passages 466*a*,466*b* extend laterally from the choke flow passage 464 and are spaced laterally apart from the inner bore 460. In some embodiments, the first and second choke inlet passages 466*a*,466*b* are substantially orthogonal to both the choke flow passage 464 and the inner bore 460. The first and second choke outlet passages 468*a*, 468*b* intersect the outlet flow passage 462 and are in fluid communication with the outlet flow passage 462. In some embodiments, the first and second choke outlet passages 468*a*,468*b* extend laterally from the outlet flow passage 462 and are spaced laterally apart from the inner bore 460. In some embodiments, the first and second choke outlet passages 468*a*,468*b* are substantially orthogonal to both the outlet flow passage 462 and the inner bore 460.

In the illustrated embodiment, at least a portion of directional valve 427 is positioned in PMD housing 431, between the inlet 448 and the intersection of the first and second choke outlet passages 468*a*,468*b* and the outlet flow passage 462. The directional valve 427 is configured to control fluid communication between the inner bore 460 and the choke flow passage 464 and the outlet flow passage 462. In some embodiments, the directional valve 427 is actuable to transition between at least two positions. In some embodiments, at least a portion of the directional valve 427 is moved linearly and/or rotationally to transition the valve 427 from one position to another. In some embodiments, the directional valve 427 operates to divert fluid in inner bore 460 to either the outlet flow passage 462 or the choke flow passage 464. In some embodiments, the directional valve 427 has a bypass position and a choke position. In the bypass position, the directional valve 427 is configured to permit fluid flow into outlet flow passage 462 while restricting fluid flow into choke flow passage 464, such that substantially all fluid in inner bore 460 is diverted to outlet flow passage 462. In the choke position, the directional valve 427 is configured to permit fluid flow into choke flow passage 464 while restricting fluid flow into outlet flow passage 462, such that substantially all fluid in inner bore 460 is diverted to choke flow passage 464.

In the sample embodiment shown in FIGS. 20 to 23, directional valve 427 is a tubular member having a generally cylindrical wall 490 with an inner surface defining an axially extending inner bore 461. The directional valve 427 is mounted in the PMD housing 431 such that at least a portion of wall 490 extends into the inner bore 460 via the first end 442 to coincide axially with the outlet flow passage 462 and the choke flow passage 464. The inner bore 461 of the directional valve 427 is in fluid communication with inner bore 460. In some embodiments, the inner bore 461 may be concentric with inner bore 460. Inner bore 461 is sized to accommodate a portion of the drill string 4 (shown in FIG. 20) extending axially therethrough, such that the drill string can rotate without interference with the inner surface of the directional valve 427. In some embodiments, directional valve 427 is rotatably supported in the PMD housing 431 by, for example, bearings 432,433, and is configured to rotate, clockwise or counterclockwise, about a longitudinal axis y such that valve 427 can transition between the bypass position and the choke position. Axis y may be a (central) longitudinal axis of the wellbore 1 (FIGS. 3 and 4), the BOP stack 5 (FIGS. 3 and 4), the drill string 4 (FIG. 20), the inner bore 461, or the inner bore 460 of PMD housing 431. In some embodiments, the interface between the valve 427 and the PMD housing 431 may be fluidly sealed by one or more seals (not shown).

In some embodiments, the wall 490 of the directional valve 427 has at least one opening extending therethrough and the at least one opening is in fluid communication with inner bore 461. In the illustrated embodiment, the wall 490 has a first opening 472*a* and a second opening 472*b* defined therein and extending therethrough, and the first and second openings 472*a*,472*b* are in fluid communication the inner bore 461. A skilled person in the art can appreciate that the directional valve 427 may operate with fewer or more openings in the wall 490.

In some embodiments, first and second openings 472, 472*b* are circumferentially and/or axially spaced apart from one another. The circumferential and/or axial spacing between the first and second openings 472*a*,472*b* in the wall 490 is selected such that when the first opening 472*a* is aligned with the choke flow passage 464, the outlet flow passage 462 is blocked by the wall 490; and when the second opening 472*b* is aligned with the outlet flow passage 462, the choke flow passage 464 is blocked by the wall 490. While openings 472*a*,472*b* are shown in the illustrated embodiment to be positioned at about the same axial location in the wall 490 of valve 427 and spaced apart circumferentially by about 105°, it can be appreciated that the axial and/or circumferential positions of openings 472*a*,472*b* may vary depending on the configuration of the valve 427 and/or PMD housing 431, for example the orientation of the flow passages 462,464 in PMD housing 431. In some embodiments, the angle between openings 472*a*,472*b* relative to the central longitudinal axis of the inner bore 461 may range from about 60° to about 120°.

Figure 24A:
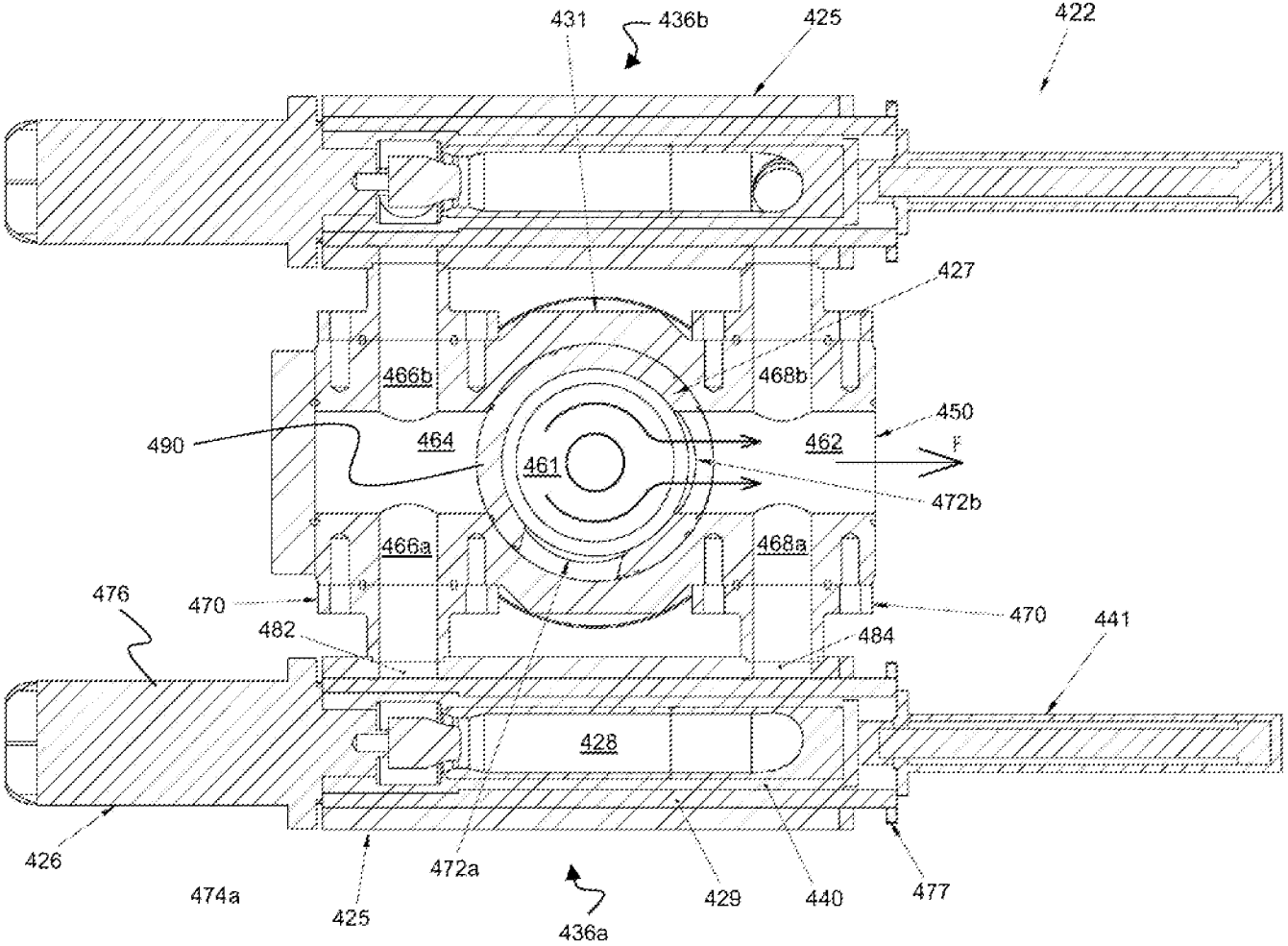
FIG. 24A is a cross-sectional view of the pressure management device of FIG. 23, shown in a bypass position.

In some embodiments, as shown for example in FIGS. 23 and 24A, when the directional valve 427 is in the bypass position, the second opening 472*b* is aligned the outlet flow passage 462 to permit fluid communication between inner bore 461 and flow passage 462. In the bypass position, the first opening 472*a* is misaligned with choke flow passage 464 such that wall 490 of the directional valve 427 blocks flow passage 464 to restrict fluid communication thereto. When the directional valve 427 is in the bypass position, the second opening 472*b* and the outlet flow passage 462 are "open," while the first opening 472*a* and the choke flow passage 464 are "closed". In some embodiments, as shown for example in FIGS. 24B to 24D, when the directional valve 427 is in the choke position, the first opening 472*a* is aligned with the choke flow passage 464 to permit fluid communication between inner bore 461 and choke flow passage 464. In the choke position, the second opening 472*b* is misaligned with outlet flow passage 462 such that wall 490 blocks flow passage 462 to restrict fluid communication thereto. When the directional valve 427 is in the choke position, the second opening 472*b* and the outlet flow passage 462 are "closed," while the first opening 472*a* and the choke flow passage 464 are "open".

In some embodiments, a directional valve actuator, which is not shown in FIGS. 20 to 24, for the sake of simplicity, is operably coupled to the directional valve 427 and operates to actuate the directional valve 427 to transition the valve 427 from the bypass position to the choke position, and vice versa. The directional valve actuator coupled to valve 427 may be a mechanical actuator, an electrical actuator, a hydraulic actuator, a pneumatic actuator, or a combination thereof, that is configured to actuate valve 427 by moving the valve 427 by a predetermined direction and distance and/or angle to transition the valve 427 from one position to another. The predetermined direction and distance and/or angle may depend on the circumferential and/or axial spacing between the first and second openings 472*a*,472*b*. In the illustrated embodiment, for example, to place the valve 427 in the choke position, the directional valve actuator rotates the valve 427 about the y axis until the first opening 472*a* is aligned with choke flow passage 464. To place the valve 427 in the bypass position, the directional valve actuator rotates the valve 427 about the y axis until the second opening 472*b* is aligned with outlet flow passage 462. In some embodiments, sensors (such as pressure sensors) may be included in the PMD 422 to determine when the outlet flow passage 462 (or the choke flow passage 464) is closed (or open) to assist the directional valve actuator in controlling the valve 427. Accordingly, the directional valve actuator is configured to actuate valve 427 while the valve 427 is in between positions and to stop actuating the valve 427 once it is determined that the valve 427 is in the desired position.

While it can be appreciated that valve 427 may operate with only one opening in the wall 490, having at least two openings in the wall 490 may allow a smoother transition between the bypass and choke positions. In some embodiments, when the directional valve 427 is between the choke position and the bypass position, openings 472*a*,472*b* may be partially aligned with flow passages 464,462, respectively, such that fluid can flow through both flow passages 464,462 while the valve 127 is in transition. The first and second openings 472*a*,472*b* may be positioned in the wall 490 to allow at least some fluid to flow through one or both of flow passages 464,462 via one or both of the openings 472*a*,472*b* at any given time. The PMD housing 431 and/or directional valve 427 may thus be configured so that flow passages 462,464 are never both fully blocked during the transition between the choke position and the bypass position, thereby allowing a smoother transition between the positions, which may be beneficial in preventing sudden spikes or drops in fluid pressure in the wellbore as the directional valve 427 redirects fluid flow in the PMD 422.

With reference to FIG. 23, choke assemblies 436*a*,436*b* are fluidly connected to the PMD housing 431 such that the choke inlet passage 466*a* and choke outlet passage 468*a* are operably coupled to, and in fluid communication with, the first choke assembly 436*a*; and the choke inlet passage 466*b* and choke outlet passage 468*b* are operably coupled to, and in fluid communication with, the second choke assembly 436*b*. In the illustrated embodiment, the first and second choke assemblies 436*a*,436*b* are mirror images of one another so only the first choke assembly 436*a* will be described in detail. In some embodiments, the first choke assembly 436*a* comprises an elongated choke housing 425 having a first end 474*a*, second end 474*b*, an inner bore extending between the first and second ends 474*a*,474*b* and opens at the first end 474*a*, and a wall having defined therein and extending therethrough a choke inlet 482 and a choke outlet 484. In the illustrated embodiment, the choke inlet 482 and outlet 484 are axially spaced apart such that the inlet 482 is near the first end 474*a* and the outlet 484 is near the second end 474*b*. The choke inlet 482 and outlet 484 are in communication with the inner bore of the choke housing 425.

Figure 24B:
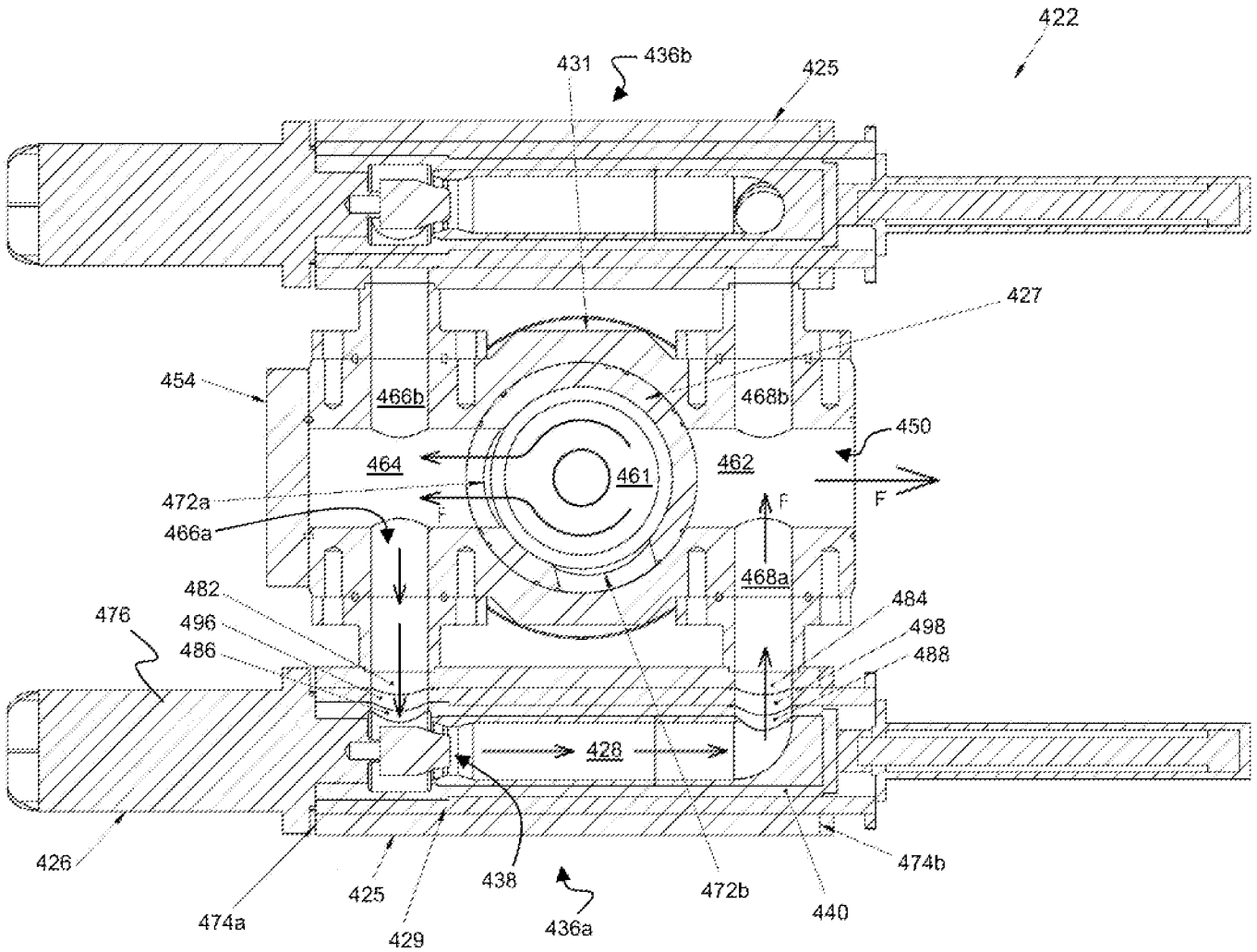
FIG. 24B is a cross-sectional view of the pressure management device of FIG. 23, shown in a single-choke position.

The choke assembly 436*a* comprises a choke cartridge 426. In the illustrated embodiment shown in FIG. 23, the choke cartridge 426 comprises a choke trim 437, a choke actuator 476, an installation cylinder 441, and a cartridge housing 440 having a wall with an inner surface defining an inner chamber 428 and a choke orifice 438. The chamber 428 has a closed end and an open end. With reference to FIG. 24B, the choke cartridge 426 has a cartridge inlet 486 and a cartridge outlet 488, both extending through the wall of the cartridge housing 440 and in fluid communication with the inner chamber 428. In some embodiments, the cartridge inlet 486 and choke orifice 438 are positioned near the open end of the chamber 428, while the cartridge outlet 488 is positioned near the closed end of chamber 428. The choke trim 437 extends into the chamber 428 near the open end thereof, adjacent to orifice 438. The choke actuator 476 is operably coupled to the choke trim 437 for actuating same. The choke actuator 476 is secured to the cartridge housing 440, sealing off the open end of the inner chamber 428. Fluid enters the chamber 428 of the cartridge housing 440 via cartridge inlet 486 and exists the chamber 428 via cartridge outlet 488. The choke orifice 438, the choke trim 437, the choke actuator 476, and the operation thereof to apply backpressure are similar or the same as the choke orifice 338, the choke trim 337, and the choke actuator 376 described above with respect to PMD 322 and FIG. 17. The choke trim 437, the inner chamber 428, and the choke orifice 438 may be collectively referred to as a choke, with the cartridge inlet 486 being the inlet of the choke and the cartridge outlet 488 being the outlet of the choke. In some embodiments, fluid flow through the inner chamber 428 can be restricted by engaging the choke trim 437 with the choke orifice 438, thereby shutting-in or closing the choke.

With reference to FIGS. 21 to 24, the first choke assembly 436*a* comprises a dual shutoff valve 429 and a dual shutoff valve actuator 430 operably coupled to the dual shutoff valve 429. At least a portion of the dual shutoff valve 429 is supported in the choke housing 425. Dual shutoff valve 429 may be the same or similar to the dual shutoff valve 329 described above with respect to PMD 322 and FIG. 16. In the illustrated embodiment, the dual shutoff valve 429 is a tubular member having a generally cylindrical wall with an inner surface defining an axially extending inner bore for removably receiving at least a portion of the choke cartridge 426. In some embodiments, when the choke cartridge 426 is installed in the dual shutoff valve 429, at least a portion of the wall of the valve 429 is disposed between the inner surface of choke housing 425 and the outer surface of cartridge housing 440. Placing the dual shutoff valve 429 inside the choke housing may help minimize the size of the choke assembly 436*b*. In some embodiments, as shown in FIG. 23, a portion of valve 429 may extend beyond the second end 474*b* of choke housing 425.

When the choke cartridge 426 is installed therein, the dual shutoff valve 429 is configured to control fluid flow between choke inlet 482 and cartridge inlet 486, and between choke outlet 484 and cartridge outlet 488. In some embodiments, the dual shutoff valve 429 has an open position (as shown for example in FIG. 24B) and a closed position (as shown for example in FIG. 24A). In the open position, the dual shutoff valve 429 is configured to permit fluid communication between the choke inlet 482 and the cartridge inlet 486, and between the choke outlet 484 and the cartridge outlet 488, such that fluid can enter and flow through inner chamber 428 in the cartridge housing 440. In the closed position, the dual shutoff valve 429 is configured to restrict fluid communication between the choke inlet 482 and the cartridge inlet 486, and optionally between the choke outlet 484 and the cartridge outlet 488, such that substantially no fluid flows through the inner chamber 428.

In the illustrated embodiment, the wall of dual shutoff valve 429 has an inlet port 496 and an outlet port 498 extending therethrough. The inlet port 496 and the outlet port 498 are radially and/or axially spaced apart from one another. In some embodiments, the inlet port 496 and outlet port 498 are positioned such that when the valve 429 is in the open position, the inlet port 496 is aligned with both the choke inlet 482 and the cartridge inlet 486; and the outlet port 498 is aligned with both the choke outlet 484 and the cartridge outlet 488. When the valve 429 is in the closed position, the inlet port 496 is misaligned with one or both of the choke inlet 482 and the cartridge inlet 486, such that one or both of the inlets 482,486 are blocked by the wall of valve 429; and the outlet port 498 is misaligned with one or both of the choke outlet 484 and the cartridge outlet 488, such that one or both of the outlets 484,488 are blocked by the wall of valve 429. When valve 429 is in the open position, the choke inlet 482, the cartridge inlet 486, the choke outlet 484, and the cartridge outlet 488 are "open". When valve 429 is in the closed position, the choke inlet 482, the cartridge inlet 486, the choke outlet 484, and the cartridge outlet 488 are "closed". Accordingly, dual shutoff valve 429 may be configured to simultaneously open the choke inlet 482, the cartridge inlet 486, the choke outlet 484, and the cartridge outlet 488, and simultaneously close the choke inlet 482, the cartridge inlet 486, the choke outlet 484, and the cartridge outlet 488. While the illustrated embodiment shows the valve 429 as having two ports 496,498, it can be appreciated that the dual shutoff valve 429 may be configured to have more ports in its wall.

Figure 21:
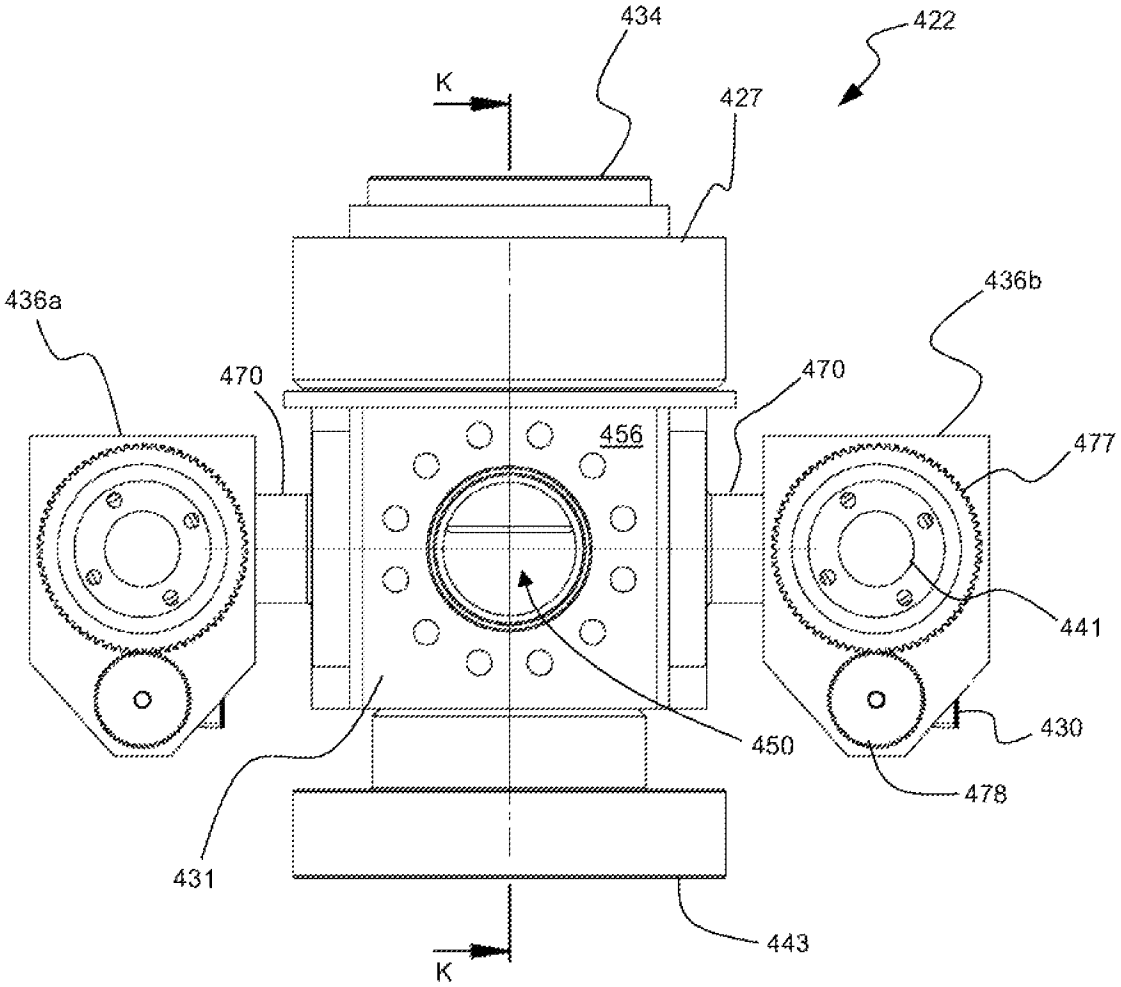
FIG. 21 is a side plan view of the pressure management device of FIG. 20, shown in isolation from other components of the drilling system.

In the sample embodiment shown in FIGS. 21 to 23, the dual shutoff valve 429 is rotatably supported in the choke housing 425 by, for example, one or more bearings (not shown), and is configured to rotate about the central longitudinal axis of the valve 429 relative to the housing 425. The interface between the valve 429 and the housing 425 may be fluidly sealed by one or more seals (not shown). In some embodiments, dual shutoff valve actuator 430 operates to rotate dual shutoff valve 429 relative to the housing 425 to transition the valve 429 between the open position and the closed position. In the illustrated embodiment, the valve 429 comprises a gear 477 and actuator 430 comprises a gear 478, and gears 477,478 are configured to interlockingly engage one another such that rotation of gear 478 rotates gear 477 to thereby rotate the valve 429. In the illustrate embodiment, gears 477,478 are positioned near and external to the second end 474*b* of the choke housing 425. In some embodiments, to place the valve 429 in the open position, actuator 429 rotates the valve 429 until inlet port 496 is aligned with the choke inlet 482 and the cartridge inlet 486, and outlet port 498 is aligned with the choke outlet 484 and the cartridge outlet 488. To place the valve 429 in the closed position, actuator 430 rotates the valve 429 until one or both of the choke inlet 482 and the cartridge inlet 486, and one or both of the choke outlet 484 and the cartridge outlet 488, are blocked by the wall of valve 429. As can be appreciated, other configurations of valve 429 and actuator 430, and other ways of actuating valve 429 are possible.

In other embodiments, the dual shutoff valve 429 may be omitted from the PMD 422 and fluid flow through the choke cartridge 426 may be controlled by adjusting the position of the choke trim 437 relative to the choke orifice 438. For example, fluid flow through the choke cartridge 426 can be restricted by engaging the choke trim 437 with the choke orifice 438, to block the choke orifice; and fluid flow through the choke cartridge 426 is permitted by moving the choke trim 437 away from the choke orifice 438. As a skilled person can appreciate, other ways of controlling fluid flow through the choke cartridge 426 or opening and closing the choke inlet 482 and choke outlet 484 are possible without using dual shutoff valve 429.

In some embodiments, with reference to FIG. 23, the choke cartridge 426 is configured such that the cartridge 426 (or at least a part thereof) can be removably installed in the choke housing 425, so that the cartridge 426 can be replaced with another cartridge, for example when the cartridge 426 requires repair or maintenance. In some embodiments, the choke cartridge 426 comprises an installation mechanism, for example, the cartridge installation arm 441. In the illustrated embodiment, the closed end of the cartridge housing 440 is coupled to the cartridge installation arm 441. In some embodiments, the arm 441 is configured to facilitate the installation and/or removal of the cartridge housing 440 in and out of the choke housing 425 and the dual shutoff valve 429. For example, the dual shutoff valve 429 and/or the choke housing 425 may have an opening near the second end 474*b* for receiving the arm 441 therethrough such that when the choke cartridge 426 is inserted into the first end 474*a*, arm 441 may be used to pull housing 440 into the choke housing 425 (i.e., the inner bore of the valve 429). Arm 441 may also be used to push the housing 440 to eject the choke cartridge 426 from the choke housing 425 so that the choke cartridge 426 can be removed from the first end 474*a*. When the choke cartridge 426 is installed in the choke housing 425, arm 441 extends beyond the second end 474*b* of the housing 425.

In some embodiments, when the choke cartridge 426 is installed in the choke housing 425, at least a portion of the cartridge housing 440 may be rigidly coupled to dual shutoff valve 429 such that the cartridge inlet 486 and cartridge outlet 488 are always aligned with inlet port 496 and outlet port 498 of the valve 429, respectively. In some embodiments, when the choke cartridge 426 is installed in the choke housing 425, the choke cartridge 426 (or at least the cartridge housing 440) is linearly and/or rotationally locked to dual shutoff valve 429 such that cartridge housing 440 remains stationary relative to the valve 429. In other embodiments, when the choke cartridge 426 is installed in the choke housing 425, cartridge housing 440 may be rigidly coupled to the choke housing 425, instead of valve 429, such that the cartridge inlet 486 and cartridge outlet 488 are always aligned with choke inlet 482 and choke outlet 484, respectively. In some embodiments, when the choke cartridge 426 is installed in the choke housing 425, the choke cartridge 426 (or at least the cartridge housing 440) is rigidly coupled to the housing 425 such that cartridge housing 440 remains stationary relative to the housing 425 (i.e. valve 429 is movable relative to cartridge housing 440 and choke housing 425). In some embodiments, the cartridge housing 440 may be rigidly coupled to valve 429 or the choke housing 425 by, for example, interlocking splines, keyway, pin, mating flats, etc.

With reference to FIGS. 20 to 24, PMD housing 431 is operably coupled to the first and second choke assemblies 436*a*,436*b* such that the first and second choke inlet passages 466*a*,466*b* are fluidly connected to the choke inlet 482 of the first and second choke assemblies, respectively; and the first and second choke outlet passages 468*a*,468*b* are fluidly connected to the choke outlet 484 of the first and second choke assemblies, respectively. In the illustrated embodiment, a plurality of spools 470 operably connect the PMD housing 431 to the first and second choke assemblies 436*a*,436*b*, but other ways of coupling the PMD housing 431 to the choke assemblies are possible. Each spool 470 has an inner bore to fluidly connect passages 466*a*,468*a* to the inlet 482 and outlet 484 of the first choke assembly 436*a*, respectively, and passages 466*b*,468*b* to the inlet 482 and outlet 484 of the second choke assembly 436*b*, respectively. The PMD housing 431 and/or the choke assemblies 436*a*, 436*b* may be otherwise configured such that spools 470 may be omitted.

With reference to FIGS. 20 to 24, each of the PMD housing 431, the directional valve 427, the first choke assembly 436*a*, and the second choke assembly 436*b* is a module of the PMD 422, and the modules of the PMD 422 can be transported separately, and subsequently assembled to form PMD 422 at the wellsite. When assembled, the PMD 422 can be installed directly above the BOP stack 5. In the illustrated embodiment, PMD housing 431 has a flanged connector at the second end 443 for direct connection to (the uppermost BOP of) the BOP stack 5. A skilled person in the art can appreciate that other ways to directly connect the PMD 422 to the BOP stack 5 or to the wellbore are possible.

In some embodiments, the PMD 422 comprises a bearing assembly 434 for maintaining the fluid seal of the wellbore while allowing the drill string 4 to rotate inside and axially extend through the PMD 422. With reference to FIG. 22, the bearing assembly 434 comprises a seal 494. The seal 494 is configured to sealingly engage the outer surface of the drill string 4. The PMD 422 further comprises a clamp mechanism (not shown) for removably coupling the bearing assembly 434 to the PMD housing 431. In some embodiments, the seal 494 is rotatably mounted in the bearing assembly 434, for example about axis y, to allow the seal 494 to rotate with the drill string 4 without transferring torque to the clamp mechanism. The seal 494 can therefore rotate independently of the clamp mechanism. For example, the bearing assembly 434 may comprise bearings (not shown) for rotatably mounting the seal 494 therein. In some embodiments, a first end 479 of the directional valve 427 extends beyond the first end 442 of the PMD housing 431 and the clamp mechanism is operably coupled to the directional valve 427 at or near the first end 479. In other embodiments, the bearing assembly 434 may be directly coupled to the PMD housing 431. In the illustrated embodiment, the clamp mechanism is attached to the directional valve 427 and is configured to rotate with the directional valve 427 such that the clamp mechanism is stationary relative to the valve 427. In some embodiments, the bearing assembly 434 is positioned at or near a top portion of the PMD 422 (e.g., adjacent the first end 442 of the PMD housing 431) and/or is positioned at one end of the inner 460 of the PMD housing 431 opposite the inlet 448. In some embodiments, when the PMD 122 is directly connected to the BOP stack 5, drill string 4 extends through the inner bore 461 of the directional valve 427, and through the inner bore 460 and inlet 448 of the PMD housing 431. As can be appreciated, configurations of PMD 422 other than the one shown in the figures are possible.

With reference to FIGS. 3, 4, and 20 to 24, in operation, the PMD 422 is connected to the BOP stack 5, and fluid (e.g., drilling mud) flows up the wellbore annulus, through the wellhead 102 and BOP stack 5, and enters the PMD 422 via inlet 448. From the inlet 448, the fluid enters the inner bore 460 of the PMD housing 431 and then into the inner bore 461 of the directional valve 427. The PMD 422 may be in one of several positions: a bypass position, a single-choke position, and a double-choke position. When PMD 422 is in the bypass position, as shown for example in FIG. 24A, valve 427 is in the bypass position, wherein the outlet flow passage 462 is open (i.e., the second opening 472*b* is aligned therewith) and the choke flow passage 464 is closed, so that the valve 427 directs the fluid in the inner bore 461 to flow into outlet flow passage 462 via the opening 472*b*. The fluid then exits the PMD 422 at outlet 450 and may flow downstream to mud handling equipment 9 via mud return line 13.

When PMD 422 is in the single-choke position, as shown for example in FIG. 24B, valve 427 is in the choke position, wherein the outlet flow passage 462 is closed and the choke flow passage 464 is open (i.e., the first opening 472*a* is aligned therewith), so that the valve 427 directs the fluid in the inner bore 461 to flow into choke flow passage 464 via opening 472*a*. In this embodiment, the first side 454 of PMD housing 431 is closed. In the illustrated embodiment, the dual shutoff valve 429 of the first choke assembly 436*a* is open while the dual shutoff valve of the second choke assembly 436*b* is closed. As a result, from choke flow passage 464, the fluid flows into the first choke inlet passage 466*a*, through spool 470, and into the inner chamber 428 of the choke cartridge 426 via the choke inlet 482, inlet port 496 of the dual shutoff valve 429, and cartridge inlet 486. The fluid enters the chamber 428, passes through the choke orifice 438, and exits the chamber 428 at the cartridge outlet 488. The fluid then flows through outlet port 498 of the valve 429, the choke outlet 484, spool 470, and then into the first choke outlet passage 468*a*. From the first choke outlet passage 468*a*, the fluid flows into outlet flow passage 462 and exits the PMD 422 at outlet 450.

In another embodiment, which is not shown in the figures, the directional valve 427 is in the choke position and the dual shutoff valve 429 of second choke assembly 436*b* is open while the dual shutoff valve of the first choke assembly 436*a* is closed. As a result, from choke flow passage 464, the fluid flows into second choke inlet passage 466*b*, through spool 470, and into the inner chamber 428 of the choke cartridge 426 via the choke inlet 482, inlet port 496 of the dual shutoff valve 429, and cartridge inlet 486. The fluid enters the chamber 428, passes through the choke orifice 438, and exits the chamber 428 at the cartridge outlet 488. The fluid then flows through outlet port 498 of the valve 429, the choke outlet 484, spool 470, and then into the second choke outlet passage 468*b*. From the second choke outlet passage 468*b*, the fluid flows into outlet flow passage 462 and exits the PMD 422 at outlet 450.

Figure 24C:
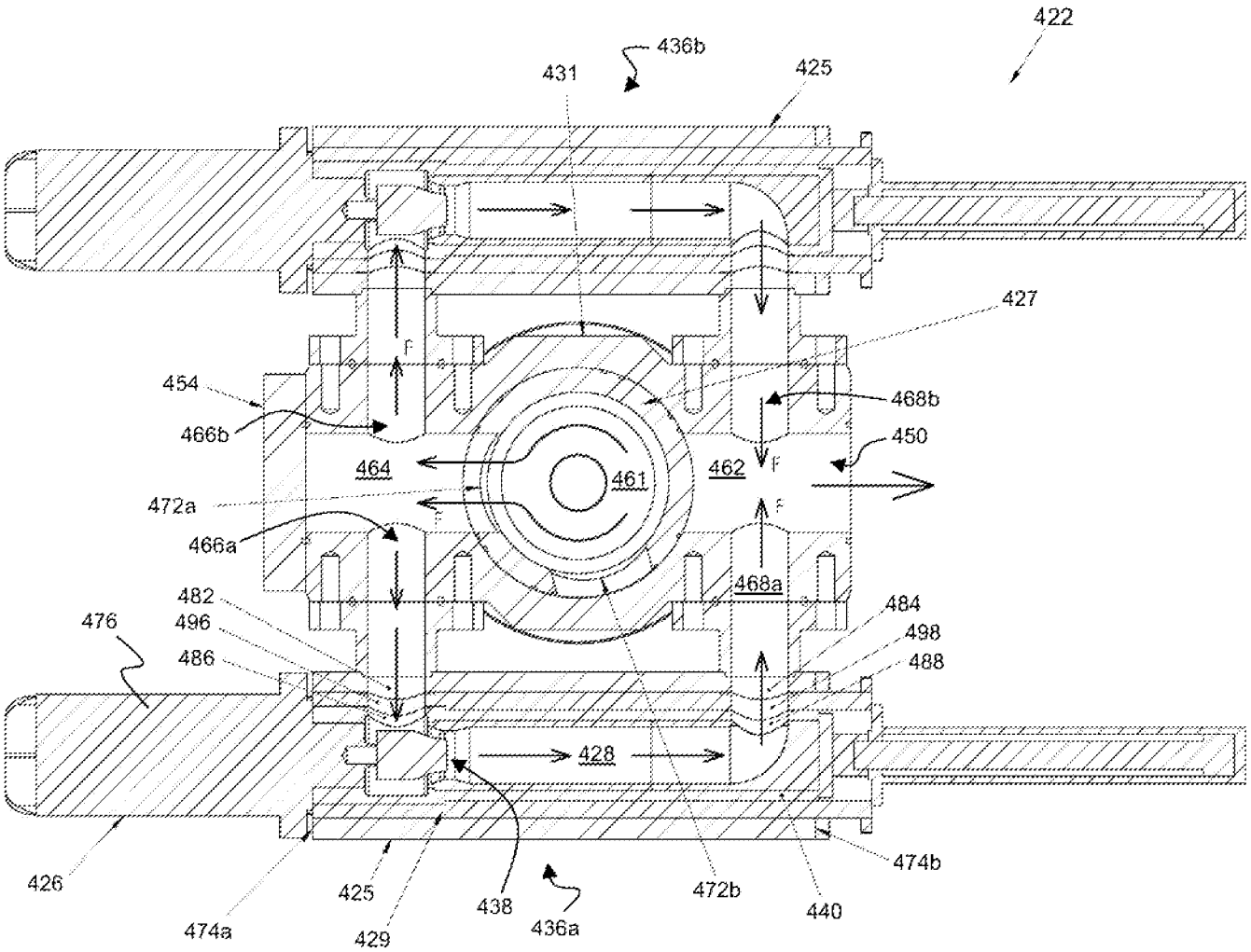
FIG. 24C is a cross-sectional view of the pressure management device of FIG. 23, shown in a double-choke position.

When PMD 422 is in the double-choke position, as shown for example in FIG. 24C, valve 427 is in the choke position so that the valve 427 directs the fluid in the inner bore 461 to flow into choke flow passage 464 via opening 472*a*. In this embodiment, the first side 454 of PMD housing 431 is closed. In the illustrated embodiment, the dual shutoff valves 429 of the first and second choke assemblies 436*a*,436*b* are open. As a result, from the choke flow passage 464, the fluid flows into both the first and second choke inlet passages 466*a*,466*b*, through the respective inner chambers 428, as described above, and flows into the first and second choke outlet passage 468*a*,468*b* after exiting the respective chambers 428. From the choke outlet passages 468*a*,468*b*, the fluid flows into the outlet flow passage 462 and exits the PMD 422 at outlet 450. By having the directional valve 427 in the choke position and the dual shutoff valves 429 in both the first and second choke assemblies 436*a*,436*b* in the open position at the same time, two chokes can operate simultaneously.

Figure 24D:
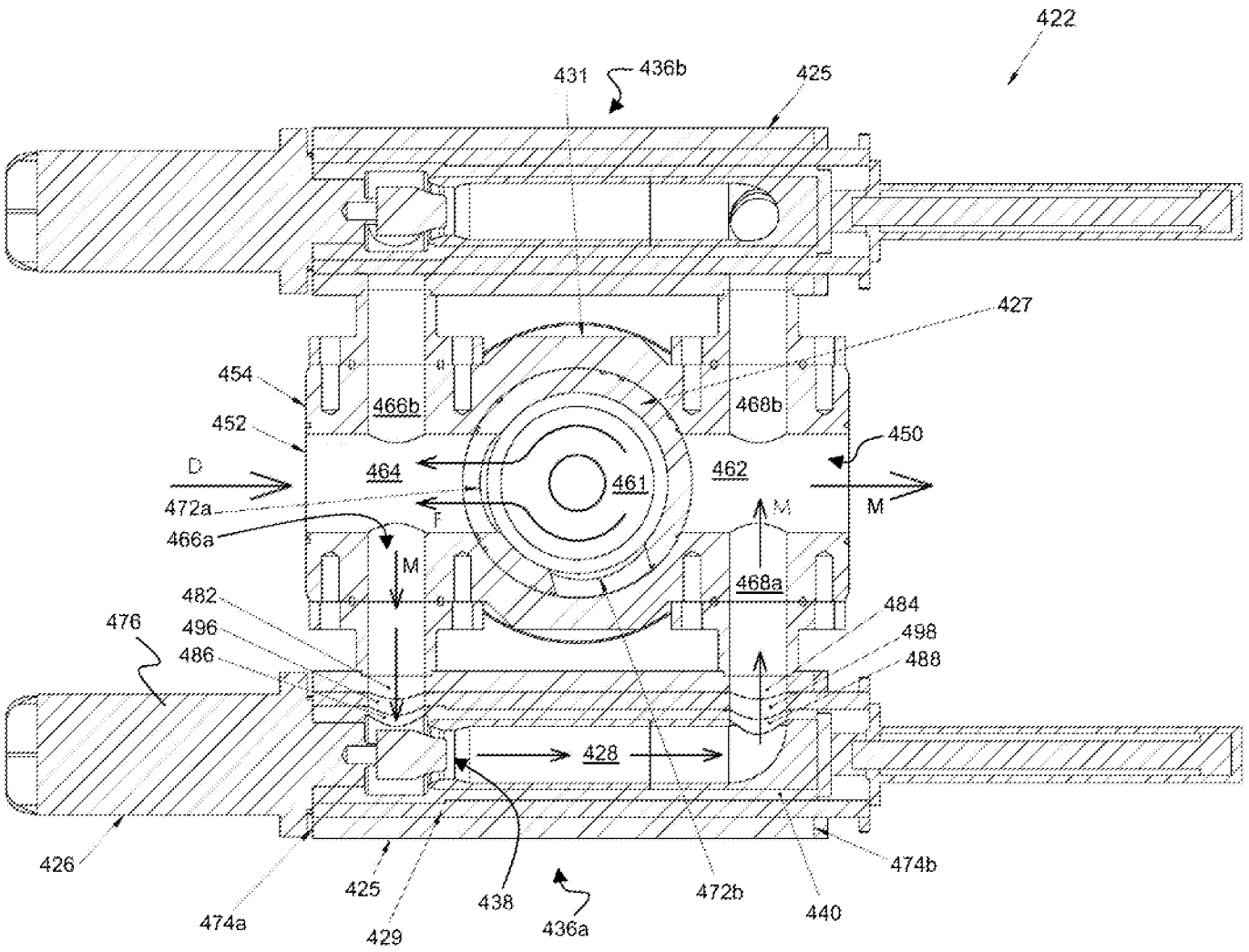
FIG. 24D is a cross-sectional view of the pressure management device of FIG. 23, shown in a single-choke position wherein the pressure management device is in fluid communication with a flow diverter.

In some embodiments, as shown for example in FIGS. 4 and 24D, the PMD 422 is configured to fluidly communicate with a flow diverter 20 such that the flow diverter can provide fluid to the PMD 422 when drilling is paused while new drill pipes are added to the drill string 4. In the illustrated embodiment, the first side 454 of PMD housing 431 is open to provide diverted pump flow inlet 452. The PMD housing 431 is operably coupled to the flow diverter 20 at inlet 452 via flow diverter line 21. The fluid from the flow diverter is denoted by the arrow "D". The fluid D from the flow diverter 20 enters the PMD 422 via inlet 452 and flows into choke flow passage 464. In the illustrated embodiment, the dual shutoff valve 429 of the first choke assembly 436*a* is open while the dual shutoff valve of the second choke assembly 436*b* is closed. It can be appreciated that in other embodiments, the dual shutoff valve of the second choke assembly 436*b* can be open while the dual shutoff valve of first choke assembly 436*a* is closed, or the dual shutoff valves 429 of both the first and second choke assemblies 436*a*,436*b* can be open while the PMD 422 receives fluid from the flow diverter 20. In this embodiment, there may also be drilling mud F entering choke flow passage 464 at the same time and mixing with fluid D. In the illustrated embodiment, the mixture of fluids, denoted by arrows "M", flows into first choke inlet passage 466*a* and enters the inner chamber 428, and exits the chamber 428 and PMD 422, all as described above with respect to FIG. 24B.

According to a broad aspect of the present disclosure, there is provided a pressure management device (PMD) having the function of the MPD manifold or the functions of both the RCD and the MPD manifold, such that there is no need to include a standalone MPD manifold in the drilling system.

According to another broad aspect of the present disclosure, there is provided a choke assembly that may be more compact and/or easier to replace than the chokes of the standalone MPD manifold.

According to a broad aspect of the present disclosure, there is provided a method comprising: diverting wellbore fluid immediately downstream of a BOP stack of a drilling system to either: flow through one or more chokes; or bypass the one or more chokes.

According to another broad aspect of the present disclosure, a PMD for use in a managed pressure drilling system, the system comprising a BOP stack, the pressure management device comprising: a housing having defined therein a bypass flow passage and a choke flow passage, and having an inlet; a directional valve positioned in the housing, the directional valve having defined therein a valve inner bore, the directional valve having a choke position and a bypass position, and the valve inner bore being in fluid communication with the inlet; and a first choke housing operably coupled to the housing, the first choke housing having a choke inlet and a choke outlet, the choke inlet being in fluid communication with the choke flow passage and the choke outlet being in fluid communication with the bypass flow passage; a first choke, at least a portion of which is removably supported in the first choke housing; and a first dual shutoff valve disposed in the first choke housing, the first dual shutoff valve having an open position and a closed position, wherein the PMD housing is attachable directly to the BOP stack for receiving fluid from the BOP stack at the inlet; wherein in the bypass position, the directional valve allows fluid communication between the valve inner bore and the bypass flow passage and restricts fluid communication between the valve inner bore and the choke flow passage; wherein in the choke position, the direction valve allows fluid communication between the valve inner bore and the choke flow passage and restricts fluid communication between the valve inner bore and the bypass flow passage; wherein in the closed position, the first dual shutoff valve closes the choke inlet and the choke outlet; and wherein in the open position, the first dual shutoff valve opens the choke inlet and the choke outlet.

According to another broad aspect of the present disclosure, there is provided a PMD housing for use in a pressure management device in a managed pressure drilling system comprising a BOP stack, the PMD housing comprising: a connector having defined therein an inlet, the connector configured for direct connection to the BOP stack; a body attached to the connector, the body having defined therein a bypass flow passage and a choke flow passage; and a directional valve positioned in the body, the directional valve having defined therein a valve inner bore, the directional valve having a choke position and a bypass position, and the valve inner bore being in fluid communication with the inlet, wherein in the bypass position, the directional valve allows fluid communication between the valve inner bore and the bypass flow passage and restricts fluid communication between the valve inner bore and the choke flow passage; and wherein in the choke position, the direction valve allows fluid communication between the valve inner bore and the choke flow passage and restricts fluid communication between the valve inner bore and the bypass flow passage.

According to another broad aspect of the present disclosure, there is provided a pressure management device (PMD) for use in a drilling system having a blowout preventor (BOP) stack and a drill string, the PMD comprising: an inlet for direct fluid connection with the BOP stack; an outlet; a housing having defined therein a choke gut line, a first choke inlet passage, and a first choke outlet passage, the choke gut line configured to fluidly connect the inlet and the outlet; and a first choke having a first choke inlet and a first choke outlet, the first choke operably coupled to the housing such that the first choke inlet and first choke outlet are fluidly connected to the first choke inlet passage and the first choke outlet passage, respectively, the choke gut line bypassing the first choke, and the PMD having a PMD bypass position and a PMD single-choke position, wherein in the PMD single-choke position, the first choke inlet and the first choke outlet are open, and the choke gut line is blocked, to permit fluid communication between the inlet and the outlet through the first choke; and in the PMD bypass position, one or both of the first choke inlet and the first choke outlet are closed or the first choke is shut-in, and the choke gut line is unblocked, to permit fluid communication between the inlet and the outlet through the choke gut line.

In some embodiments, the PMD comprises a directional valve in fluid communication with the choke gut line, the directional valve having a choke position in which the directional valve blocks the choke gut line, and a bypass position in which the directional valve unblocks the choke gut line, wherein in the PMD single-choke position, the directional valve is in the choke position; and in the PMD bypass position, the directional valve is in the bypass position.

In some embodiments, the directional valve is positioned between the inlet and an intersection between the first choke outlet passage and the choke gut line.

In some embodiments, the PMD comprises a dual shutoff valve operably coupled to the first choke and in communication with the first choke inlet and first choke outlet, the dual shutoff valve having an open position in which the first choke inlet and first choke outlet are opened by the dual shutoff valve, and a closed position in which one or both of the first choke inlet and first choke outlet are closed by the dual shutoff valve, wherein in the PMD single-choke position, the dual shutoff valve is in the open position; and in the PMD bypass position, the dual shutoff valve is in the closed position.

In some embodiments, the dual shutoff valve is configured to simultaneously open the first choke inlet and the first choke outlet; and/or simultaneously close the first choke inlet and the first choke outlet.

In some embodiments, the PMD has a trap wellbore pressure position in which the first choke inlet and the first choke outlet are closed or the first choke is shut-in, and the choke gut line is blocked, to restrict fluid communication between the inlet and the outlet.

In some embodiments, the PMD comprises a diverted pump flow inlet in fluid communication with the first choke inlet passage, and wherein the drilling system comprises a flow diverter and the PMD has a diverter pump flow position in which the first choke inlet and the first choke outlet are open, the choke gut line is blocked, and the diverted pump flow inlet is configured to fluidly connect with the flow diverter.

In some embodiments, the PMD comprises a second choke having a second choke inlet and a second choke outlet, and wherein the housing has defined therein a second choke inlet passage and a second choke outlet passage; and the second choke is operably coupled to the housing such that the second choke inlet and second choke outlet are fluidly connected to the second choke inlet passage and the second choke outlet passage, respectively.

In some embodiments, the PMD has a PMD double-choke position in which the first choke inlet and the first choke outlet are open, the second choke inlet and the second choke outlet are open, and the choke gut line is blocked, to permit fluid communication between the inlet and the outlet through the first choke and the second choke.

In some embodiments, the housing is configured to receive a segment of the drill string therethrough.

In some embodiments, the PMD comprises a wellbore sealing mechanism coupled to the housing for receiving a segment of the drill string therethrough and for sealingly engaging the drill string.

In some embodiments, the wellbore sealing mechanism is a bearing assembly releasably coupled to the housing.

In some embodiments, the first choke comprises a choke housing and a choke cartridge, and wherein at least a portion of the choke cartridge is supported in the choke housing.

In some embodiments, at least a portion of the dual shutoff valve is disposed in the choke housing.

In some embodiments, the dual shutoff valve is movable relative to the choke housing between the open position and the closed position.

In some embodiments, the PMD comprises a directional valve assembly and a first choke assembly, wherein at least a portion of the directional valve is supported in the directional valve assembly; at least a portion of the first choke is supported in the first choke assembly; and the directional valve assembly and the first choke assembly are coupled to the housing.

In some embodiments, at least a portion of the directional valve is rotatably supported in the housing, the directional valve having a body with an inner surface defining an inner bore, the inner bore being in fluid communication with the inlet, the body having a first opening and a second opening extending therethrough and in fluid communication with the inner bore, and wherein in the bypass position, the second opening is in fluid communication with the outlet and the first opening is closed; and in the choke position, the second opening is closed and the first opening is in fluid communication with the first choke inlet passage.

In some embodiments, the inner bore of the directional valve is configured to receive a segment of the drill string therethrough.

According to another broad aspect of the present disclosure, there is provided a method comprising: connecting an inlet of a housing of a pressure management device (PMD) directly to a blowout preventor (BOP) stack of a drilling system, the housing having an outlet and having defined therein a choke gut line between the inlet and outlet; releasably attaching and fluidly connecting one or more chokes to the housing; and providing a flow path from the inlet to the outlet, wherein providing the flow path comprises one of: blocking the choke gut line and opening at least one choke of the one or more chokes to allow fluid communication between the at least one choke and the inlet and outlet; blocking the choke gut line, opening a first choke of the one or more chokes, and closing a second choke of the one or more chokes to allow fluid communication between the first choke and the inlet and outlet; and unblocking the choke gut line and closing the one or more chokes to restrict fluid communication between the one or more chokes and the inlet and outlet, and to allow fluid communication between the inlet and outlet via the choke gut line.

In some embodiments, providing the flow path comprises blocking the choke gut line and opening the at least one choke, and the method comprises allowing fluid communication between the inlet and a diverted pump flow inlet of the housing, the diverted pump flow inlet being fluidly connected to a flow diverter of the drilling system.

In some embodiments, providing the flow path comprises blocking the choke gut line and opening the at least one choke; and providing the flow path further comprises synchronizing the blocking and the opening.

In some embodiments, providing the flow path comprises unblocking the choke gut line and closing the one or more chokes; and providing the flow path further comprises synchronizing the unblocking and the closing.

In some embodiments, providing the flow path comprises blocking the choke gut line, opening the first choke, and closing the second choke; and providing the flow path further comprises synchronizing the opening and the closing.

In some embodiments, blocking the choke gut line comprises placing a directional valve in a choke position, the directional valve being in fluid communication with the inlet and the outlet.

In some embodiments, unblocking the choke gut line comprises placing the directional valve in a bypass position.

In some embodiments, the directional valve is supported in a directional valve assembly and the method comprises, prior to providing the flow path, releasably attaching the directional valve assembly to the housing.

In some embodiments, placing the directional valve in the choke position or the bypass position comprises actuating the directional valve by a remotely controlled actuator.

In some embodiments, each of the one or more chokes has a respective choke inlet and a respective choke outlet, and (i) opening the at least one choke comprises opening the respective choke inlet and opening the respective choke outlet of each of the at least one choke; and/or (ii) closing the one or more chokes comprises closing one or both of the respective choke inlet and the respective choke outlet of each of the one or more chokes, or shutting in the one or more chokes.

In some embodiments, opening the at least one choke comprises synchronizing the opening of the respective choke inlet and the opening of the respective choke outlet.

In some embodiments, closing the one or more chokes comprises closing both of the respective choke inlet and respective choke outlet, and closing the one or more chokes further comprises synchronizing the closing of both of the respective choke inlet and the respective choke outlet.

In some embodiments, opening the at least one choke or closing the one or more chokes comprises actuating a dual shutoff valve operably coupled to each of the at least one choke or to each the one or more chokes.

In some embodiments, actuating the dual shutoff valve is performed by a remotely controlled actuator.

In some embodiments, the method comprises, prior to providing the flow path, releasably coupling a sealing mechanism to the housing, the sealing mechanism configured to sealingly engage a segment of a drill string of the drilling system.

According to another broad aspect of the present disclosure, there is provided a choke assembly comprising: a choke cartridge; a choke housing having a first end, a second end, a wall with an inner surface defining a chamber, and a choke inlet and a choke outlet extending through the wall and in fluid communication with the chamber, the first end having an opening providing open access to the chamber, and the chamber configured to removably receive at least a portion of the choke cartridge via the opening; and a dual shutoff valve in communication with one or both of the choke inlet and the choke outlet, the dual shutoff valve having an closed position in which the dual shutoff valve blocks one or both of the choke inlet and the choke outlet; and an open position in which the dual shutoff valve unblocks the choke inlet and the choke outlet.

In some embodiments, at least a portion of the dual shutoff valve is positioned in the chamber and is configured to removably receive at least a portion of the choke cartridge therein.

In some embodiments, the at least a portion of the dual shutoff valve is positioned between the wall of the choke housing and the choke cartridge, when the at least a portion of the choke cartridge is received in the dual shutoff valve.

In some embodiments, the choke assembly comprises an installation mechanism for supporting the choke cartridge and aligning the choke cartridge with the opening at the first end.

In some embodiments, the installation mechanism comprises a telescoping arm and a support bracket at or near a free end of the telescoping arm, the telescoping arm being selectively extendable and retractable relative to the choke housing, and the bracket being configured to engage and support a portion of the choke cartridge.

In some embodiments, the installation mechanism is configured to restrict axial movement of the choke cartridge while permitting rotational movement of the choke cartridge.

In some embodiments, the choke cartridge comprises a cartridge installation arm.

In some embodiments, the dual shutoff valve is rotatable relative to the choke housing between the open position and the closed position, and the choke cartridge is rotationally lockable to the dual shutoff valve or the choke housing.

In some embodiments, the dual shutoff valve comprises a wall having an inlet port and an outlet port extending therethrough, and wherein in the open position, the inlet port and outlet port are aligned with the choke inlet and choke outlet, respectively; and in the closed position, the inlet port and the outlet port are misaligned with the choke inlet and choke outlet, respectively.

In some embodiments, the choke cartridge has a cartridge inlet and a cartridge outlet, and wherein the cartridge inlet and the cartridge outlet are aligned with the inlet port and the outlet port, respectively, when the choke cartridge is received in the chamber.

In some embodiments, the choke cartridge has a first alignment profile and the choke housing or the dual shutoff valve has a second alignment profile configured to matingly engage the first alignment profile.

According to another broad aspect of the present disclosure, there is provided a method comprising: inserting a choke cartridge into a choke housing, via an open first end of the choke housing, the choke housing being operably coupled to a housing in fluid connection a blowout preventor stack of a drilling system.

In some embodiments, the method comprises, prior to inserting, engaging the choke cartridge with an installation mechanism, and inserting comprises actuating, by an installation mechanism actuator, the installation mechanism to move the choke cartridge relative to the choke housing.

In some embodiments, actuating the installation mechanism comprises detecting a torque of the installation mechanism actuator.

In some embodiments, the method comprises, prior to inserting, supporting the choke cartridge on a telescoping arm, wherein inserting comprises retracting the telescoping arm relative to the choke housing.

In some embodiments, the method comprises, prior to inserting, aligning an alignment profile of the choke cartridge with an alignment profile of the choke housing or an alignment profile of a dual shutoff valve coupled to the choke housing, wherein inserting comprises engaging the alignment profile of the choke cartridge with the alignment profile of the choke housing or the alignment profile of the dual shutoff valve.

In some embodiments, inserting comprises pulling an installation arm of the choke cartridge through an opening at a second end of the choke housing.

In some embodiments, the method comprises removing the choke cartridge from the choke housing.

In some embodiments, the method comprises, prior to removing, engaging the choke cartridge with an installation mechanism, wherein removing comprises actuating the installation mechanism to move the choke cartridge relative to the choke housing and disengaging the choke cartridge from the installation mechanism.

In some embodiments, the method comprises, prior to removing, supporting the choke cartridge on a telescoping arm, and wherein removing comprises extending the telescoping arm relative to the choke housing.

In some embodiments, removing comprises pushing an installation arm of the choke cartridge to eject the choke cartridge from the choke housing.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A pressure management device (PMD) for use in a drilling system having a blowout preventor (BOP) stack and a drill string, the PMD comprising:

an inlet for direct fluid connection with the BOP stack;

an outlet;

a housing having defined therein a choke gut line, a first choke inlet passage, and a first choke outlet passage, the choke gut line configured to fluidly connect the inlet and the outlet; and a first choke having a first choke inlet and a first choke outlet, the first choke operably coupled to the housing such that the first choke inlet and first choke outlet are fluidly connected to the first choke inlet passage and the first choke outlet passage, respectively, the choke gut line bypassing the first choke, and the PMD having a PMD bypass position and a PMD single-choke position, wherein in the PMD single-choke position, the first choke inlet and the first choke outlet are open, and the choke gut line is blocked, to permit fluid communication between the inlet and the outlet through the first choke; and in the PMD bypass position, one or both of the first choke inlet and the first choke outlet are closed or the first choke is shut-in, and the choke gut line is unblocked, to permit fluid communication between the inlet and the outlet through the choke gut line.

2. The PMD of claim 1 comprising a directional valve in fluid communication with the choke gut line, the directional valve having a choke position in which the directional valve blocks the choke gut line, and a bypass position in which the directional valve unblocks the choke gut line, wherein in the PMD single-choke position, the directional valve is in the choke position, and wherein in the PMD bypass position, the directional valve is in the bypass position.

3. The PMD of claim 2 wherein the directional valve is positioned between the inlet and an intersection between the first choke outlet passage and the choke gut line.

4. The PMD of claim 2 comprising a directional valve assembly and a first choke assembly, wherein at least a portion of the directional valve is supported in the directional valve assembly, wherein at least a portion of the first choke is supported in the first choke assembly, and wherein the directional valve assembly and the first choke assembly are coupled to the housing.

5. The PMD of claim 2 wherein at least a portion of the directional valve is rotatably supported in the housing, the directional valve having a body with an inner surface defining an inner bore, the inner bore being in fluid communication with the inlet, the body having a first opening and a second opening extending therethrough and in fluid communication with the inner bore, and wherein in the bypass position, the second opening is in fluid communication with the outlet and the first opening is closed, and wherein in the choke position, the second opening is closed and the first opening is in fluid communication with the first choke inlet passage.

6. The PMD of claim 5 wherein the inner bore of the directional valve is configured to receive a segment of the drill string therethrough.

7. The PMD of claim 1 comprising a dual shutoff valve operably coupled to the first choke and in communication with the first choke inlet and first choke outlet, the dual shutoff valve having an open position in which the first choke inlet and first choke outlet are opened by the dual shutoff valve, and a closed position in which one or both of the first choke inlet and first choke outlet are closed by the dual shutoff valve, wherein in the PMD single-choke position, the dual shutoff valve is in the open position, and wherein in the PMD bypass position, the dual shutoff valve is in the closed position.

8. The PMD of claim 7 wherein the dual shutoff valve is configured to simultaneously open the first choke inlet and the first choke outlet, and/or simultaneously close the first choke inlet and the first choke outlet.

9. The PMD of claim 7 wherein at least a portion of the dual shutoff valve is disposed in the choke housing.

10. The PMD of claim 9 wherein the dual shutoff valve is movable relative to the choke housing between the open position and the closed position.

11. The PMD of claim 1 wherein the PMD has a trap wellbore pressure position in which the first choke inlet and the first choke outlet are closed or the first choke is shut-in, and the choke gut line is blocked, to restrict fluid communication between the inlet and the outlet.

12. The PMD of claim 1 comprising a diverted pump flow inlet in fluid communication with the first choke inlet passage, and wherein the drilling system comprises a flow diverter and the PMD has a diverter pump flow position in which the first choke inlet and the first choke outlet are open, the choke gut line is blocked, and the diverted pump flow inlet is configured to fluidly connect with the flow diverter.

13. The PMD of claim 1 comprising a second choke having a second choke inlet and a second choke outlet, wherein the housing has defined therein a second choke inlet passage and a second choke outlet passage, and wherein the second choke is operably coupled to the housing such that the second choke inlet and second choke outlet are fluidly connected to the second choke inlet passage and the second choke outlet passage, respectively.

14. The PMD of claim 13 wherein the PMD has a PMD double-choke position in which the first choke inlet and the first choke outlet are open, the second choke inlet and the second choke outlet are open, and the choke gut line is blocked, to permit fluid communication between the inlet and the outlet through the first choke and the second choke.

15. The PMD of claim 1 wherein the housing is configured to receive a segment of the drill string therethrough.

16. The PMD of claim 1 comprising a wellbore sealing mechanism coupled to the housing for receiving a segment of the drill string therethrough and for sealingly engaging the drill string.

17. The PMD of claim 16 wherein the wellbore sealing mechanism is a bearing assembly releasably coupled to the housing.

18. The PMD of claim 1 wherein the first choke comprises a choke housing and a choke cartridge, and wherein at least a portion of the choke cartridge is supported in the choke housing.

19. A method comprising:

connecting an inlet of a housing of a pressure management device (PMD) directly to a blowout preventor (BOP) stack of a drilling system, the housing having an outlet and having defined therein a choke gut line between the inlet and outlet;

releasably attaching and fluidly connecting one or more chokes to the housing; and providing a flow path from the inlet to the outlet, wherein providing the flow path comprises one of:

blocking the choke gut line and opening at least one choke of the one or more chokes to allow fluid communication between the at least one choke and the inlet and outlet;

blocking the choke gut line, opening a first choke of the one or more chokes, and closing a second choke of the one or more chokes to allow fluid communication between the first choke and the inlet and outlet; and unblocking the choke gut line and closing the one or more chokes to restrict fluid communication between the one or more chokes and the inlet and outlet, and to allow fluid communication between the inlet and outlet via the choke gut line.

20. The method of claim 19 wherein providing the flow path comprises blocking the choke gut line and opening the at least one choke, and the method comprises allowing fluid communication between the inlet and a diverted pump flow inlet of the housing, the diverted pump flow inlet being fluidly connected to a flow diverter of the drilling system.

21. The method of claim 19 wherein providing the flow path comprises blocking the choke gut line and opening the at least one choke, and providing the flow path further comprises synchronizing the blocking and the opening.

22. The method of claim 19 wherein providing the flow path comprises unblocking the choke gut line and closing the one or more chokes, and providing the flow path further comprises synchronizing the unblocking and the closing.

23. The method of claim 19 wherein providing the flow path comprises blocking the choke gut line, opening the first choke, and closing the second choke, and providing the flow path further comprises synchronizing the opening and the closing.

24. The method of claim 19 wherein one or both of: blocking the choke gut line comprises placing a directional valve in a choke position, the directional valve being in fluid communication with the inlet and the outlet, and unblocking the choke gut line comprises placing the directional valve in a bypass position.

25. The method of claim 24 wherein the directional valve is supported in a directional valve assembly and the method comprises, prior to providing the flow path, releasably attaching the directional valve assembly to the housing.

26. The method of claim 24 wherein placing the directional valve in the choke position or the bypass position comprises actuating the directional valve by a remotely controlled actuator.

27. The method of claim 19 wherein each of the one or more chokes has a respective choke inlet and a respective choke outlet, and wherein one or both of:

opening the at least one choke comprises opening the respective choke inlet and opening the respective choke outlet of each of the at least one choke; and closing the one or more chokes comprises closing one or both of the respective choke inlet and the respective choke outlet of each of the one or more chokes, or shutting in the one or more chokes.

28. The method of claim 27 wherein opening the at least one choke comprises synchronizing the opening of the respective choke inlet and the opening of the respective choke outlet.

29. The method of claim 27 wherein closing the one or more chokes comprises closing both of the respective choke inlet and respective choke outlet, and wherein closing the one or more chokes further comprises synchronizing the closing of both of the respective choke inlet and the respective choke outlet.

30. The method of claim 27 wherein opening the at least one choke or closing the one or more chokes comprises actuating a dual shutoff valve operably coupled to each of the at least one choke or to each the one or more chokes.

31. The method of claim 30 wherein actuating the dual shutoff valve is performed by a remotely controlled actuator.

32. The method of claim 19 comprising, prior to providing the flow path, releasably coupling a sealing mechanism to the housing, the sealing mechanism configured to sealingly engage a segment of a drill string of the drilling system.

* * * * *